US011229094B2

(12) United States Patent
Ma et al.

(10) Patent No.: US 11,229,094 B2
(45) Date of Patent: Jan. 18, 2022

(54) COMBINED RF AND THERMAL HEATING SYSTEM AND METHODS OF OPERATION THEREOF

(71) Applicant: NXP USA, Inc., Austin, TX (US)

(72) Inventors: Minyang Ma, Tempe, AZ (US); Lionel Mongin, Chandler, AZ (US); Jamison Michael McCarville, Tempe, AZ (US)

(73) Assignee: NXP USA, Inc., Austin, TX (US)

( * ) Notice: Subject to any disclaimer, the term of this patent is extended or adjusted under 35 U.S.C. 154(b) by 394 days.

(21) Appl. No.: 16/227,853

(22) Filed: Dec. 20, 2018

(65) Prior Publication Data

US 2020/0205245 A1 Jun. 25, 2020

(51) Int. Cl.

| | |
|---|---|
| ***H05B 6/68*** | (2006.01) |
| ***H05B 6/64*** | (2006.01) |
| ***H05B 6/72*** | (2006.01) |
| ***H05B 6/66*** | (2006.01) |

(52) U.S. Cl.

CPC ..... *H05B 6/687* (2013.01); *H05B 6/6467* (2013.01); *H05B 6/6473* (2013.01); *H05B 6/6485* (2013.01); *H05B 6/664* (2013.01); *H05B 6/686* (2013.01); *H05B 6/72* (2013.01)

(58) Field of Classification Search

CPC ..... H05B 6/50; H05B 6/62; H05B 6/6467; H05B 6/6473; H05B 6/6485; H05B 6/664; H05B 6/686; H05B 6/687; H05B 6/72

USPC ..... 219/683, 497, 505, 506, 501, 771, 778, 219/779, 780, 756, 716, 709, 770;

(Continued)

(56) References Cited

U.S. PATENT DOCUMENTS

| | | | |
|---|---|---|---|
| 2,388,824 | A | 11/1945 | Brown |
| 2,608,638 | A | 8/1952 | Daiger |
| 4,241,937 | A | 12/1980 | Eggen et al. |

(Continued)

FOREIGN PATENT DOCUMENTS

| | | | |
|---|---|---|---|
| CN | 100595502 | C | 3/2010 |
| CN | 108141925 | A | 6/2018 |

(Continued)

OTHER PUBLICATIONS

Seto, James; NXP/Freescale Semiconductor; "Quiescent Current Control for the RF Integrated Circuit Device Family—AN1987—Rev. 1"; 8 pages (May 2004).

(Continued)

*Primary Examiner* — Quang T Van
(74) *Attorney, Agent, or Firm* — Sherry W. Gourlay

(57) ABSTRACT

An embodiment of a heating system includes a cavity configured to contain a load, a thermal heating system (e.g., a convection, radiant, and/or gas heating system) in fluid communication with the cavity and configured to heat air, and an RF heating system. The RF heating system includes an RF signal source configured to generate an RF signal, first and second electrodes positioned across the cavity and capacitively coupled, a transmission path electrically coupled between the RF signal source and one or more of the first and second electrodes, and a variable impedance matching network electrically coupled along the transmission path between the RF signal source and the one or more electrodes. At least one of the first and second electrodes receives the RF signal and converts the RF signal into electromagnetic energy that is radiated into the cavity.

19 Claims, 10 Drawing Sheets

(58) Field of Classification Search
USPC ..... 426/238, 230, 240, 242, 243; 427/121; 324/664
See application file for complete search history.

(56) References Cited

U.S. PATENT DOCUMENTS

| | | | | |
|---|---|---|---|---|
| 4,341,937 | A | 7/1982 | Staats et al. | |
| 6,063,233 | A * | 5/2000 | Collins | H01J 37/32458 156/345.37 |
| 6,784,405 | B2 | 8/2004 | Flugstad et al. | |
| 7,078,661 | B2 | 7/2006 | Kim et al. | |
| 8,207,479 | B2 | 6/2012 | Ben-Shmuel et al. | |
| 9,215,756 | B2 | 12/2015 | Bilchinsky et al. | |
| 9,992,924 | B2 | 6/2018 | van Vooren et al. | |
| 10,337,745 | B2 | 7/2019 | McKee et al. | |
| 10,616,963 | B2 | 4/2020 | Scott et al. | |
| 2003/0127451 | A1 | 7/2003 | Lile | |
| 2005/0019938 | A1 | 1/2005 | Markert et al. | |
| 2006/0081624 | A1 | 4/2006 | Takada et al. | |
| 2010/0193507 | A1 | 8/2010 | Zimmer et al. | |
| 2012/0013973 | A1 | 1/2012 | Yeo | |
| 2012/0122072 | A1 | 5/2012 | Bilchinsky et al. | |
| 2013/0080098 | A1 | 3/2013 | Hadad et al. | |
| 2015/0150270 | A1* | 6/2015 | Barnett | A21B 1/48 34/266 |
| 2015/0351164 | A1 | 12/2015 | Wesson et al. | |
| 2016/0209213 | A1* | 7/2016 | Stark | G01C 19/661 |
| 2017/0055769 | A1 | 3/2017 | Grimaldi et al. | |
| 2018/0042073 | A1 | 2/2018 | Scott et al. | |
| 2018/0042074 | A1 | 2/2018 | Qiu et al. | |
| 2018/0152996 | A1 | 5/2018 | Carcano et al. | |
| 2020/0205243 | A1 | 6/2020 | Lester et al. | |

FOREIGN PATENT DOCUMENTS

| | | | |
|---|---|---|---|
| CN | 108521691 | A | 9/2018 |
| CN | 108812854 | | 11/2018 |
| EP | 3280225 | A1 | 2/2018 |
| GB | 621320 | | 4/1949 |
| JP | H05-99437 | A | 4/1993 |
| JP | 2003024025 | A | 1/2003 |
| JP | 2005242629 | A | 9/2005 |
| WO | WO 2018/125144 | A1 | 7/2018 |

OTHER PUBLICATIONS

U.S. Appl. No. 16/414,626; not yet published; 113 pages (filed Mar. 16, 2019).
Wolf Appliance Company, LLC "Convection Microwave Oven, Use & Care Information", 36 pgs, May 2006.
Non Final Office Action; U.S. Appl. No. 16/414,626; 8 pages (dated Sep. 7, 2021).

* cited by examiner

COMBINED RF AND THERMAL HEATING SYSTEM AND METHODS OF OPERATION THEREOF

TECHNICAL FIELD

Embodiments of the subject matter described herein relate generally to apparatus and methods of heating a load within a cavity using multiple heating sources.

BACKGROUND

Conventional food heating systems come in several forms, with a primary differentiator being the heating source used to heat food within a system cavity. The most common food heating systems include a conventional oven, a convection oven, and a microwave oven. A conventional oven includes an oven cavity in which one or more radiant heating elements are disposed. Electric current is passed through the heating element(s), and the element resistance causes each element and ambient air around the element to heat up. A convection oven includes an oven cavity, a heating element, and/or a fan assembly, where the heating element may be included in the fan assembly or may be located within the oven cavity. Essentially, the fan assembly is used to circulate air warmed by the heating element throughout the oven cavity, resulting in a more even temperature distribution throughout the cavity, and thus faster and more even cooking than a conventional oven. Finally, a microwave oven includes an oven cavity, a cavity magnetron, and a waveguide. The cavity magnetron produces electromagnetic energy that is directed into the oven cavity through the waveguide. The electromagnetic energy (or microwave radiation) impinges on the food load to heat the outer layer of the food. For example, at a typical microwave oven frequency of 2.54 gigahertz, about the outer 30 millimeters of a homogenous, high water food mass may be evenly heated using microwave heating.

Each of the above-described, conventional food heating systems has advantages and disadvantages when it comes to heating and/or cooking food. For example, conventional ovens are simple in construction, reliable, and relatively inexpensive. In addition, they are very good at producing a Maillard reaction in the outer surface of food, which is essential for browning and crisping. However, conventional ovens are relatively slow at cooking food. Convection ovens may have similar cooking performance as a conventional oven, but with faster cooking times. However, the convection oven fan assembly renders the oven more expensive to manufacture and repair. Finally, a microwave oven is capable of cooking food much faster than conventional and convection ovens. However, microwave energy does not tend to produce the desired Maillard reactions in food, and accordingly microwave ovens are not good at browning and crisping. Given the above-listed characteristics of conventional food heating systems, appliance manufacturers strive to develop improved systems that have the advantages of the various systems while overcoming their deficiencies.

BRIEF DESCRIPTION OF THE DRAWINGS

A more complete understanding of the subject matter may be derived by referring to the detailed description and claims when considered in conjunction with the following figures, wherein like reference numbers refer to similar elements throughout the figures.

DETAILED DESCRIPTION

Figure 1:
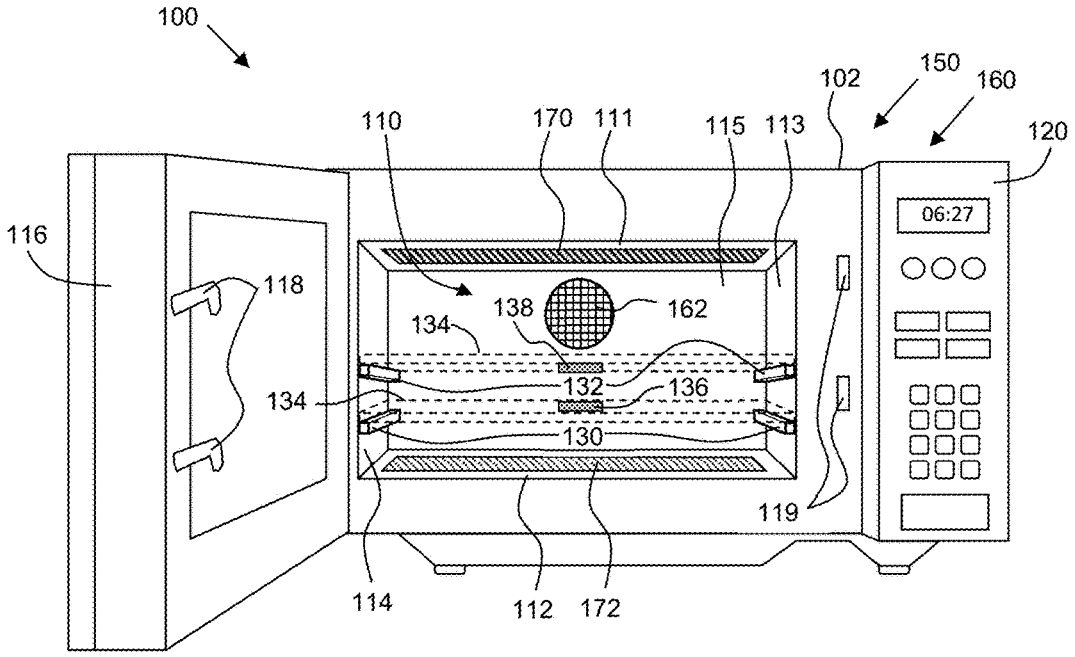
FIG. 1 is a perspective view of a heating appliance with a radio frequency (RF) heating system and a convection heating system, in accordance with an example embodiment.

The following detailed description is merely illustrative in nature and is not intended to limit the embodiments of the subject matter or the application and uses of such embodiments. As used herein, the words "exemplary" and "example" mean "serving as an example, instance, or illustration." Any implementation described herein as exemplary or an example is not necessarily to be construed as preferred or advantageous over other implementations. Furthermore, there is no intention to be bound by any expressed or implied theory presented in the preceding technical field, background, or the following detailed description.

Embodiments of the subject matter described herein relate to heating appliances, apparatus, and/or systems that include multiple heating systems that can operate simultaneously in order to heat a load (e.g., a food load) within a system cavity. The multiple heating systems include a radio frequency (RF) heating system and a "thermal" heating system. The RF heating system includes a solid-state RF signal source, a variable impedance matching network, and two electrodes, where the two electrodes are separated by the system cavity. More specifically, the RF heating system is a "capacitive" heating system, in that the two electrodes function as electrodes (or plates) of a capacitor, and the capacitor dielectric essentially includes the portion of the system cavity between the two electrodes and any load contained therein. The thermal heating system can include any one or more systems that heat the air within the cavity, such as one or more resistive heating elements, a convection blower, a convection fan plus a resistive heating element, a gas heating system, among others. The RF heating system produces an electromagnetic field within the cavity and between the electrodes to capacitively heat the load. The thermal heating system heats the air within the cavity. The combined RF and thermal heating system may more rapidly heat the load than could a thermal heating system alone. In addition, the RF energy radiated in the cavity may provide more even heating of the center of the load and, thus, shorter cooking times. The electromagnetic fields generated using embodiments of the inventive subject matter have been found to penetrate more deeply into food loads than is possible using conventional microwave energy fields and conventional thermal heating systems alone. In addition, the combined RF and thermal heating system can achieve browning and crisping of the load that is not easily achievable using a conventional microwave oven system alone.

Embodiments of thermal heating systems include, at the least, a heating element and a cavity temperature control system. Thermal heating systems may include, for example, convection heating systems, radiant heating systems, and gas heating systems. A convection heating system includes a fan that is configured to circulate air within a system cavity. In some embodiments, the convection heating system also includes a heating element that heats the air (e.g., the convection heating system may include a convection blower with an integrated heating element). In other embodiments, a distinct heating element may be used to heat the air within the system cavity, and the convection system may simply circulate the heated air. A radiant heating system may include one or more heating elements (e.g., heating coils) disposed within the system cavity and configured to heat the air within the cavity. Finally, a gas heating system includes a gas nozzle subsystem and a pilot lighting subsystem configured to ignite natural gas that is released through the nozzle subsystem. The burning natural gas results in heating of the air within the cavity. Each of these thermal heating systems also include a cavity temperature control system, which is configured to sense the temperature of the air within the system cavity, and to activate, deactivate, or adjust the functioning of the thermal heating system's heating element to maintain the air temperature within the cavity within a relatively small temperature range that encompasses a defined processing temperature (e.g., a cavity temperature setpoint specified by a user through the user interface).

Embodiments of the RF heating system, which is included in the heating appliance along with the thermal heating system, differ from a conventional microwave oven system in several respects. For example, embodiments of the RF heating system include a solid-state RF signal source, as opposed to a magnetron that is utilized in a conventional microwave oven system. Utilization of a solid-state RF signal source may be advantageous over a magnetron, in that a solid-state RF signal source may be significantly lighter and smaller, and may be less likely to exhibit performance degradation (e.g., power output loss) over time. In addition, embodiments of the RF heating system generate electromagnetic energy in the system cavity at frequencies that are significantly lower than the 2.54 gigahertz (GHz) frequency that is typically used in conventional microwave oven systems. In some embodiments, for example, embodiments of the RF heating system generate electromagnetic energy in the system cavity at frequencies within the VHF (very high frequency) range (e.g., from 30 megahertz (MHz) to 300 MHz). The significantly lower frequencies utilized in the various embodiments may result in deeper energy penetration into the load, and thus potentially faster and more even heating. Further still, embodiments of the RF heating system include a single-ended or double-ended variable impedance matching network, which is dynamically controlled based on the magnitude of reflected RF power. This dynamic control enables the system to provide a good match between the RF signal generator and the system cavity (plus load) throughout a heating process, which may result in increased system efficiency and reduced heating time.

Generally, the term "heating" means to elevate the temperature of a load (e.g., a food load or other type of load). The term "defrosting", which also may be considered a "heating" operation, means to elevate the temperature of a frozen load (e.g., a frozen food load or other type of load) to a temperature at which the load is no longer frozen (e.g., a temperature at or near 0 degrees Celsius). As used herein, the term "heating" more broadly means a process by which the thermal energy or temperature of a load (e.g., a food load or other type of load) is increased through provision of thermal radiation of air particles and/or RF electromagnetic energy to the load. Accordingly, in various embodiments, a "heating operation" may be performed on a load with any initial temperature (e.g., any initial temperature above or below 0 degrees Celsius), and the heating operation may be ceased at any final temperature that is higher than the initial temperature (e.g., including final temperatures that are above or below 0 degrees Celsius). That said, the "heating operations" and "heating systems" described herein alternatively may be referred to as "thermal increase operations" and "thermal increase systems."

FIG. 1 is a perspective view of a heating system 100 (or appliance), in accordance with an example embodiment. Heating system 100 includes a heating cavity 110 (e.g., cavity 960, 1260, FIGS. 9, 12), a control panel 120, an RF heating system 150 (e.g., RF heating system 910, 1210, FIGS. 9, 12), and a convection heating system 160 (e.g., an embodiment of thermal heating system 950, 1250, FIGS. 9, 12), all of which are secured within a system housing 102.

The heating cavity 110 is defined by interior surfaces of top, bottom, side, and back cavity walls 111, 112, 113, 114, 115 and an interior surface of door 116. As shown in FIG. 1, door 116 may include a latching mechanism 118, which engages with a corresponding securing structure 119 of the system housing 102 to hold door 116 closed. With door 116 closed, the heating cavity 110 defines an enclosed air cavity. As used herein, the terms "air cavity" or "oven cavity" may mean an enclosed area that contains air or other gasses (e.g., heating cavity 110).

In some embodiments, one or more shelf support structures 130, 132 are accessible within the heating cavity 110, and the shelf support structures 130, 132 are configured to hold a removable and repositionable shelf 134 (shown with dashed lines in FIG. 1, as the shelf is not inserted) at some height above the bottom cavity wall 112. For example, as shown in FIG. 1, first shelf support structures 130 include a first set of rails attached to opposed cavity walls 113, 114 at a first height above the bottom cavity wall 112, and second shelf support structures 132 include a second set of rails attached to opposed cavity walls 113, 114 at a second height above the bottom cavity wall 112. The rails protrude into the cavity 110 from the primary plane of each of the opposed cavity walls 113, 114. A user may insert a shelf 134 into the cavity 110 by sliding the shelf 134 into the cavity 110, and resting the left and right bottom edges of the shelf 134 on top of the rails of either of the shelf support structures 130, 132. In an alternate embodiment, the shelf support structures 130, 132 may alternatively be configured as sets of protrusions (e.g., two protrusions on each of the opposed cavity walls 113, 114) that extend a short distance into the cavity 110. In another alternate embodiment, the shelf support structures 130, 132 may alternatively be configured as sets of grooves that are recessed below the primary plane of each of the opposed cavity walls 113, 114, and into which the shelf 134 may be slid. However the shelf support structures 130, 132 are configured (e.g., as rails, protrusions, grooves, or otherwise), the shelf support structures 130, 132 are positioned to hold the shelf 134 parallel with but elevated above the bottom cavity wall 112. In some embodiments, the shelf support structures 130, 132 are configured to provide an electrical connection between the shelf 134 (e.g., an electrode embodied in the shelf) and other portions of the RF heating system or a ground reference. In other embodiments, the shelf support structures 130, 132 may be configured to electrically isolate the shelf 134 from the cavity walls and/or from other portions of the system.

In some embodiments, the shelf 134 may simply be configured to hold a load (e.g., a food load) at a desired height above the bottom cavity wall 112. In other embodiments, the shelf 134 may consist of or include an electrode associated with the RF heating system (e.g., electrode 942, 1450, FIGS. 9, 12). Accordingly, the shelf support structures 130, 132 alternatively may be considered to be electrode support structures, which are configured to hold a removable and repositionable electrode at some height above the bottom cavity wall 112. In such embodiments, the shelf 134 and/or its integrated electrode may be electrically connected to other portions of the RF heating system or to a ground reference through conductive features (not shown) of the shelf support structures 130, 132, as indicated above. Alternatively, the shelf 134 and/or its integrated electrode may be electrically connected to other portions of the RF heating system or to a ground reference through a conductive connector 136, 138 in one of the cavity sidewalls (e.g., one of walls 113-115, such as the back cavity wall 115 as shown in FIG. 1). Further, in some embodiments, an electrode-containing shelf 134 may replace the below-described bottom (or second) electrode 172. In other words, an electrode integrated within an electrode-containing shelf 134 may be connected within the system and perform the functions of the below-described bottom electrode 172.

Figure 2:
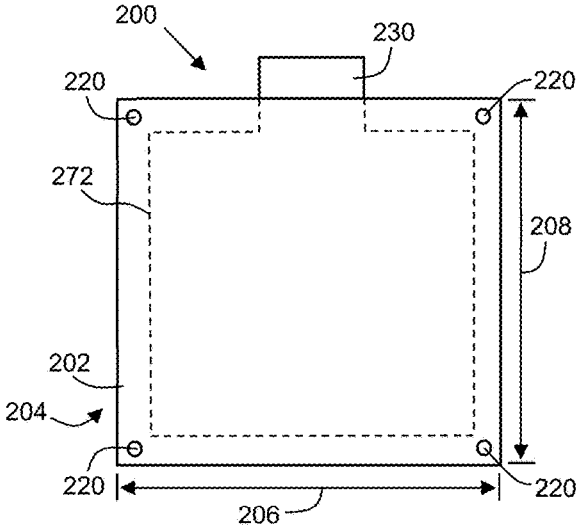
FIG. 2 is a top view of a planar structure (e.g., shelf or electrode), in accordance with an example embodiment.

FIG. 2 is a top view of a planar structure 200, which may be used as a shelf and/or an electrode in system 100 (and/or in systems 600, 800, FIGS. 6, 8), in accordance with an example embodiment. Structure 200 has planar top and bottom surfaces 202, 204. A thickness between the surfaces 202, 204 may be in a range of 1 to 3 centimeters, in an embodiment, although the thickness may be smaller or larger, as well. Structure 200 has a width 206 that may be approximately equal to (or slightly smaller or larger than, in various embodiments) the width of the cavity (e.g., cavity 110, FIG. 1) into which the structure 200 will be inserted. Further, structure 200 has a depth 208 that may be approximately equal to (or slightly smaller than) the depth of the cavity (e.g., the distance between the closed door 116 and back wall 115 of cavity 110, FIG. 1).

When configured simply as a shelf (e.g., shelf 134, FIG. 1) that does not function as or include an electrode, structure 200 desirably is formed from one or more materials (e.g., plastic or other dielectric materials) that do not significantly affect the electromagnetic field produced in the cavity during operation. Alternatively, as indicated previously, structure 200 may be configured as an electrode, in which case structure 200 may be formed from one or more planar, electrically conductive materials (e.g., copper, aluminum, and so on), which may (or may not) be coated with or embedded within a protective dielectric material (e.g., plastic or other dielectric materials). In still other embodiments, an electrode 272 (indicated with dashed lines in FIG. 2) may be included within structure 200, where the electrode is formed from one or more planar, electrically conductive materials (e.g., copper, aluminum, and so on). In such an embodiment, the electrode 272 may be embedded within protective dielectric material that supports the electrode 272 and forms the remaining planar portions of the structure 200.

In the embodiments in which the entire structure 200 is configured as an electrode, or an electrode 272 is included as a part of the structure 200, the structure 200 is configured to be electrically connected with other portions of the RF heating system or to a ground reference. For example, as indicated previously, the structure 200 could include conductive features on bottom edges of the structure, which contact corresponding conductive features of the shelf support structures (e.g., shelf support structures 130, 132, FIG. 1).

Alternatively, structure 200 may include a conductive connector 230, which is configured to engage with a corresponding connector (e.g., either of conductive connectors 136, 138, FIG. 1) in a cavity sidewall (e.g., one of walls 113-115, such as the back cavity wall 115 as shown in FIG. 1). When the entire structure 200 is configured as an electrode, the connector 230 may simply be an integrally-formed, protruding portion of the structure 200. Alternatively, when the structure 200 includes a distinct electrode 272, the connector 230 may be an integrally-formed, protruding portion of the electrode 272, or the connector 230 may otherwise be electrically connected to the electrode 272. Either way, when the structure 200 is slid into or otherwise inserted into the cavity, the connector 230 engages with the corresponding connector (e.g., either of conductive connectors 136, 138, FIG. 1) in a cavity sidewall to electrically connect the structure 200 or the electrode 272 to other portions of the RF heating system or to a ground reference.

In some embodiments, structure 200 may include additional openings 220 or other features that facilitate securing the structure 200 to one or more walls of the cavity (e.g., cavity 110, FIG. 1) into which structure 200 is inserted. For example, openings 220 may be configured to receive screws or other attachment means therethrough, and the screws or other attachment means may be connectable to other features within the cavity. In some cases, electrical connection of the structure 200 or an electrode 272 within the structure 200 may be electrically grounded through the screws or other attachment means.

The structure 200 of FIG. 2 is a planar structure, and accordingly is not adapted to enable a significant amount of air flow or electromagnetic energy to pass through structure 200. In some embodiments, it may be desirable to allow significant amounts of air flow or electromagnetic energy to pass through a shelf or support structure. Accordingly, in some embodiments, a shelf (e.g., shelf 134, FIG. 1) or electrode may have openings between the top and bottom surfaces of the shelf or electrode. Such openings could be elongated channels, circular openings, rectangular openings, or any of a number of differently-configured openings. By way of example, but not of limitation, a grid-type structure will be described below. Those of skill in the art would understand, based on the description herein, that "perforated" structures having other types of openings alternatively could be used.

Figure 3:
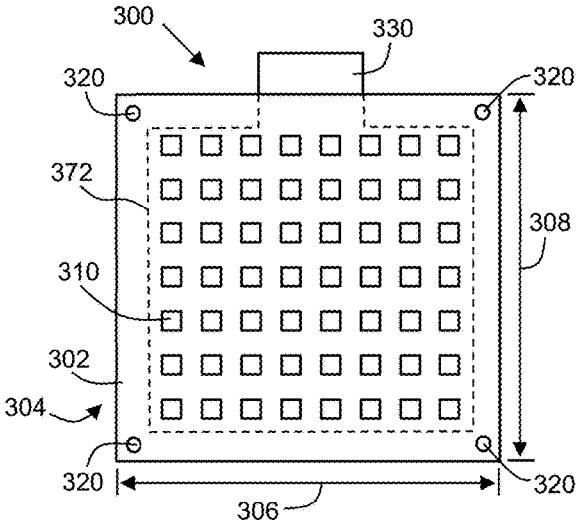
FIG. 3 is a top view of a grid-type structure (e.g., shelf or electrode), in accordance with an example embodiment.

FIG. 3 is a top view of a grid-type structure 300, which may be used as a shelf or electrode in system 100 (and/or in systems 600, 800, FIGS. 6, 8), in accordance with an example embodiment. Structure 300 has planar top and bottom surfaces 302, 304, and a plurality of openings 310 extending between the top and bottom surfaces 302, 304 to provide fluid communication between areas below and above the structure 300. In the embodiment of FIG. 3, structure 300 has a grid-type configuration in which the openings 310 are rectangular in shape and arranged in a two-dimensional array. In other embodiments, the openings may be elongated and/or may have different shapes and arrangements.

A thickness between the surfaces 302, 304 may be in a range of 1 to 3 centimeters, in an embodiment, although the thickness may be smaller or larger, as well. Structure 300 has a width 306 that may be approximately equal to (or slightly smaller or larger than, in various embodiments) the width of the cavity (e.g., cavity 110, FIG. 1) into which the structure 300 will be inserted. Further, structure 300 has a depth 308 that may be approximately equal to (or slightly smaller than) the depth of the cavity (e.g., the distance between the closed door 116 and back wall 115 of cavity 110, FIG. 1).

When configured simply as a shelf (e.g., shelf 134, FIG. 1) that does not function as or include an electrode, structure 300 desirably is formed from one or more materials (e.g., plastic or other dielectric materials) that do not significantly affect the electromagnetic field produced in the cavity during operation. Alternatively, as indicated previously, structure 300 may be configured as an electrode, in which case structure 300 may be formed from one or more perforated, electrically conductive materials (e.g., copper, aluminum, and so on), which may (or may not) be coated with or embedded within a protective dielectric material (e.g., plastic or other dielectric materials). In still other embodiments, an electrode 372 (indicated with dashed lines in FIG. 3) may be included within structure 300, where the electrode is formed from one or more perforated, electrically conductive materials (e.g., copper, aluminum, and so on). In such an embodiment, the electrode 372 may be embedded within protective dielectric material that supports the electrode 372 and forms the remaining planar portions of the structure 300.

In the embodiments in which the entire structure 300 is configured as an electrode, or an electrode 372 is included as a part of the structure 300, the structure 300 is configured to be electrically connected with other portions of the RF heating system or to a ground reference. For example, as indicated previously, the structure 300 could include conductive features on bottom edges of the structure, which contact corresponding conductive features of the shelf support structures (e.g., shelf support structures 130, 132, FIG. 1).

Alternatively, structure 300 may include a conductive connector 330, which is configured to engage with a corresponding connector (e.g., either of conductive connectors 136, 138, FIG. 1) in a cavity sidewall (e.g., one of walls 113-115, such as the back cavity wall 115 as shown in FIG. 1). When the entire structure 300 is configured as an electrode, the connector 330 may simply be an integrally-formed, protruding portion of the structure 300. Alternatively, when the structure 300 includes a distinct electrode 372, the connector 330 may be an integrally-formed, protruding portion of the electrode 372, or the connector 330 may otherwise be electrically connected to the electrode 372. Either way, when the structure 300 is slid into or otherwise inserted into the cavity, the connector 330 engages with the corresponding connector (e.g., either of conductive connectors 136, 138, FIG. 1) in a cavity sidewall to electrically connect the structure 300 or the electrode 372 to other portions of the RF heating system or to a ground reference.

In some embodiments, structure 300 may include additional openings 320 or other features that facilitate securing the structure 300 to one or more walls of the cavity (e.g., cavity 110, FIG. 1) into which structure 300 is inserted. For example, openings 320 may be configured to receive screws or other attachment means therethrough, and the screws or other attachment means may be connectable to other features within the cavity. In some cases, electrical connection of the structure 300 or an electrode 372 within the structure 300 may be electrically grounded through the screws or other attachment means.

Figure 9:
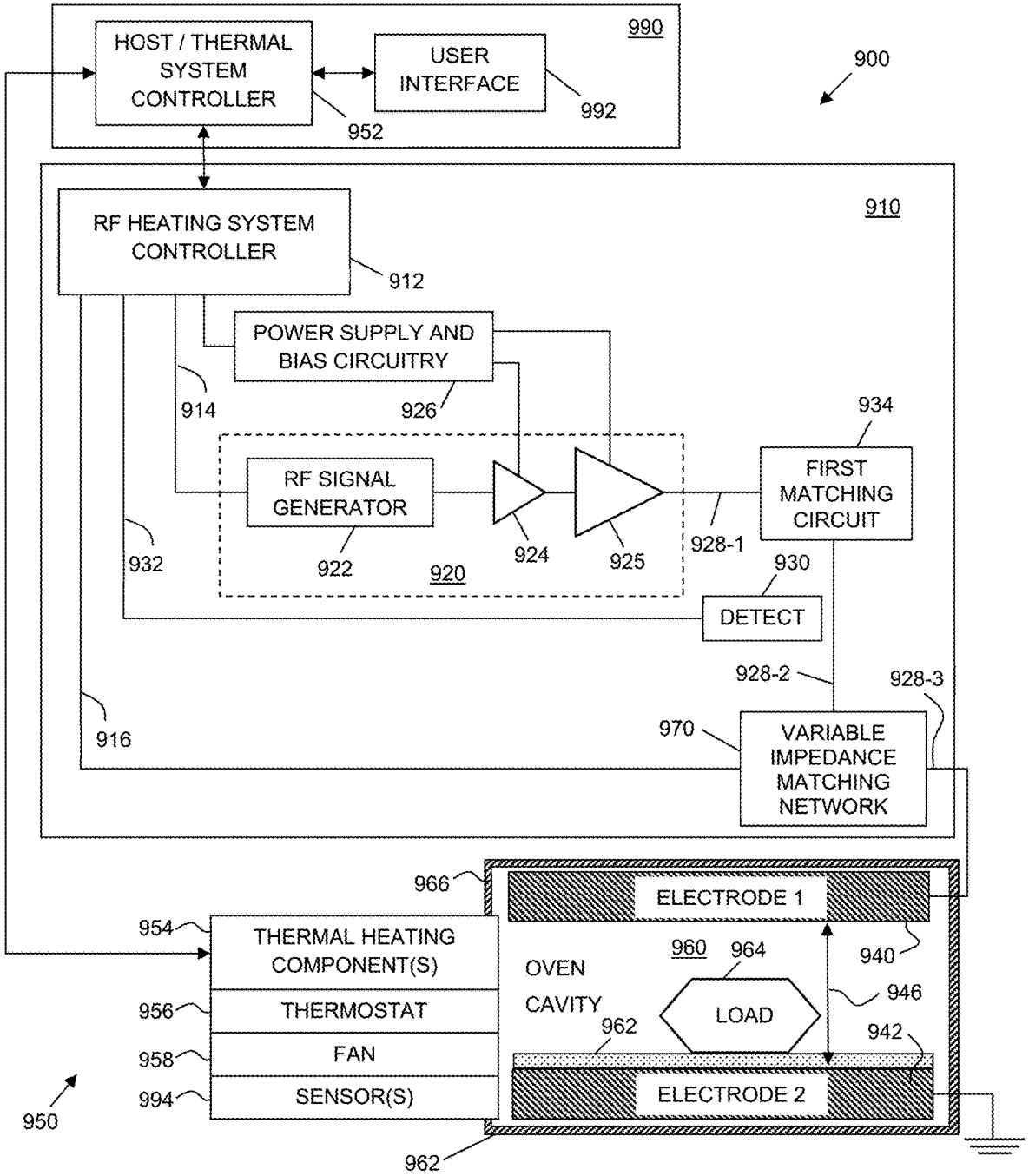
FIG. 9 is a simplified block diagram of an unbalanced heating apparatus with an RF heating system and a thermal heating system, in accordance with an example embodiment.
Figure 11:
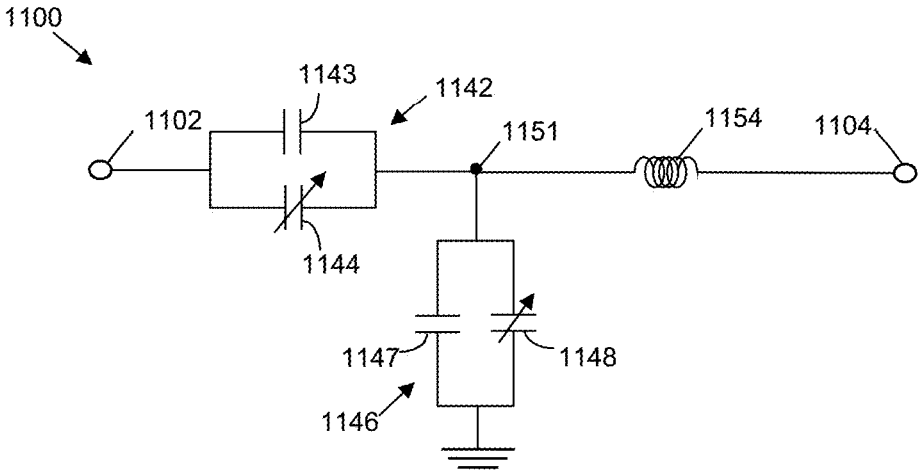
FIG. 11 is a schematic diagram of a single-ended variable capacitive matching network, in accordance with an example embodiment.
Figure 12:
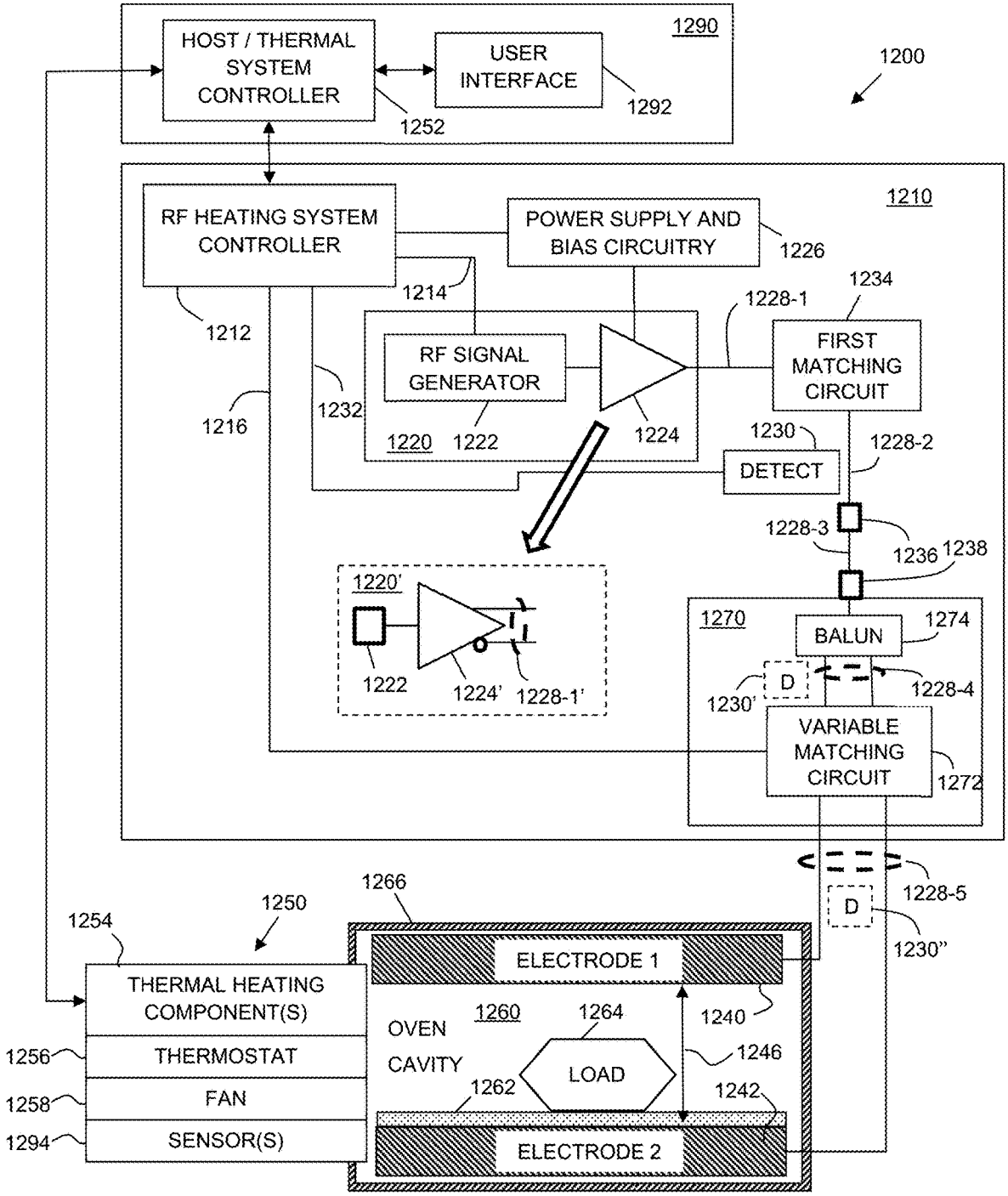
FIG. 12 is a simplified block diagram of a balanced heating apparatus with an RF heating system and a thermal heating system, in accordance with another example embodiment.

Referring again to FIG. 1, and as mentioned above, heating system 100 includes both an RF heating system 150 (e.g., RF heating system 910, 1210, FIGS. 9, 12), and a convection heating system 160 (e.g., convection heating system 950, 1250, FIGS. 9, 12). As will be described in greater detail below, the RF heating system 150 includes one or more radio frequency (RF) signal sources (e.g., RF signal source 920, 1420, FIGS. 9, 12), a power supply (e.g., power supply 926, 1426, FIGS. 9, 12), a first electrode 170 (e.g., electrode 940, 1240, FIGS. 9, 12), a second electrode 172 (e.g., electrode 942, 1242, FIGS. 9, 12), impedance matching circuitry (e.g., circuits 934, 970, 1000, 1100, 1234, 1272, 1300, 1400, FIGS. 9-14), power detection circuitry (e.g., power detection circuitry 930, 1430, FIGS. 9, 12), and an RF heating system controller (e.g., system controller 912, 1212, FIGS. 9, 12).

The first electrode 170 is arranged proximate to a cavity wall (e.g., top wall 111), and the second electrode 172 is arranged proximate to an opposite, second cavity wall (e.g., bottom wall 112). Alternatively, as indicated above in conjunction with the description of shelf 134, the second electrode 172 may be replaced by a shelf structure (e.g., shelf 200, 300, FIGS. 2, 3) or an electrode (e.g., electrode 272, 372, FIGS. 2, 3) within such a shelf structure. Either way, the first and second electrodes 170, 172 (and/or shelf 200, 300, or electrode 272, 372, FIGS. 2, 3) are electrically isolated from the remaining cavity walls (e.g., walls 113-115 and door 116), and the cavity walls are grounded. In either configuration, the system may be simplistically modeled as a capacitor, where the first electrode 170 functions as one conductive plate (or electrode), the second electrode 172 (or structure 200, 300 or electrode 272, 372, FIGS. 2, 3) functions as a second conductive plate (or electrode), and the air cavity between the electrodes (including any load contained therein) functions as a dielectric medium between the first and second conductive plates. Although not shown in FIG. 1, a non-electrically conductive barrier (e.g., barrier 962, 1462, FIGS. 9, 12) also may be included in the system 100, and the non-conductive barrier may function to electrically and physically isolate the load from the second electrode 172 and/or the bottom cavity wall 112.

The RF heating system 150 may be an "unbalanced" RF heating system or a "balanced" RF heating system, in various embodiments. As will be described in more detail later in conjunction with FIG. 9, when configured as an "unbalanced" RF heating system, the system 150 includes a single-ended amplifier arrangement (e.g., amplifier arrangement 920, FIG. 9), and a single-ended impedance matching network (e.g., including networks 934, 970, FIG. 9) coupled between an output of the amplifier arrangement and the first electrode 170, and the second electrode 172 (or structure 200, 300 or electrode 272, 372, FIGS. 2, 3) is grounded. Although alternatively the first electrode 170 could be grounded, and the second electrode 172 could be coupled to the amplifier arrangement. In contrast, and as will be described in more detail later in conjunction with FIG. 12, when configured as a "balanced" RF heating system, the system 150 includes a single-ended or double-ended amplifier arrangement (e.g., amplifier arrangement 1220 or 1220', FIG. 12), and a double-ended impedance matching network (e.g., including networks 1234, 1272, FIG. 12) coupled between an output of the amplifier arrangement and the first and second electrodes 170, 172. In either the balanced or unbalanced embodiments, the impedance matching network includes a variable impedance matching network that can be adjusted during the heating operation to improve matching between the amplifier arrangement and the cavity (plus load). Further, a measurement and control system can detect certain conditions related to the heating operation (e.g., an empty system cavity, a poor impedance match, and/or completion of a heating operation).

The convection system 160 includes a thermal system controller (e.g., thermal system controller 952, 1452, FIGS. 9, 12), a power supply, a heating element, a fan, and a thermostat, in an embodiment. The heating element may be, for example, a resistive heating element, which is configured to heat air surrounding the heating element when current from the power supply is passed through the heating element. The thermostat (or oven sensor) senses the temperature of the air within the system cavity, and based on the sensed cavity temperature, controls the power supply to provide current to the heating element. More specifically, the thermostat operates to maintain the cavity air temperature at or near the temperature setpoint. In addition, the thermal system controller may selectively activate and deactivate the convection fan to circulate air warmed by the heating element within the system cavity 110. In the system 100 illustrated in FIG. 1, the fan is located in a fan compartment outside of the system cavity 110, and fluid (air) communication between the fan and the system cavity 110 is provided through one or more openings in one or more cavity walls. For example, FIG. 1 illustrates an opening 162 corresponding to an air outlet in cavity wall 115 between a fan compartment and the system cavity 110.

Figure 4:
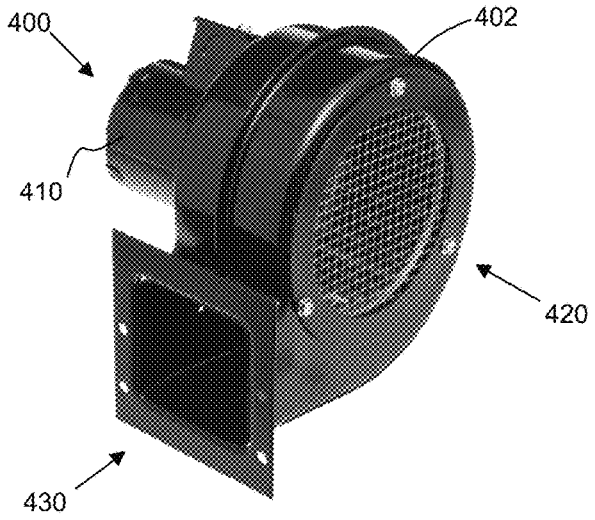
FIG. 4 is a perspective view of a convection blower with an integrated heating element that could be used in the appliance of FIG. 1, in accordance with an example embodiment.

In some embodiments, the heating element and the fan form portions of a complete convection unit (referred to as a "convection blower") that is configured both to heat air and circulate the heated air. For example, FIG. 4 is a perspective view of a convection blower 400 with a fan and an integrated heating element that could be used in the appliance of FIG. 1, in accordance with an example embodiment. The components of convection blower 400 are contained within a housing 402, which has features that enable the blower 400 to be securely mounted within a fan compartment of a heating system (e.g., system 100, FIG. 1). Blower 400 includes a fan motor 410 configured to operate an internal fan (hidden in FIG. 4) in response to a power input (from a power supply, not shown). In addition, an internal heating element (also hidden in FIG. 4) is used to heat air within an internal compartment. While operating, the fan causes air (e.g., from a system cavity 110, FIG. 1) to be drawn into the internal compartment through an air intake 420, and causes heated air within the internal compartment to be forced out of the blower 400 (e.g., back into the system cavity 110, FIG. 1) through an air outlet 430. When installed in a system (e.g., system 100, FIG. 1), the air outlet 430 is coupled to an opening in the cavity wall(s) to provide fluid communication between the blower 400 and the system cavity.

Figure 5:
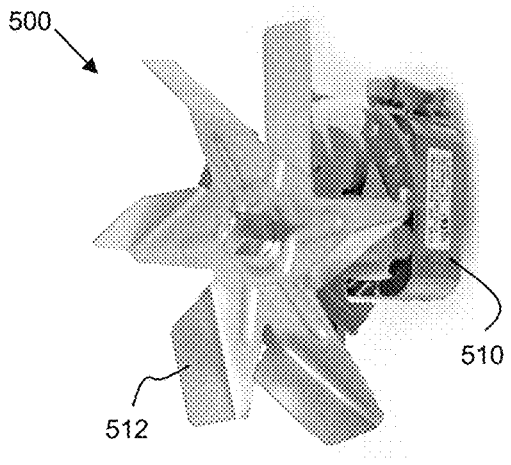
FIG. 5 is a perspective view of a convection fan that could be used in the appliance of FIG. 1, in accordance with an example embodiment.
Figure 6:
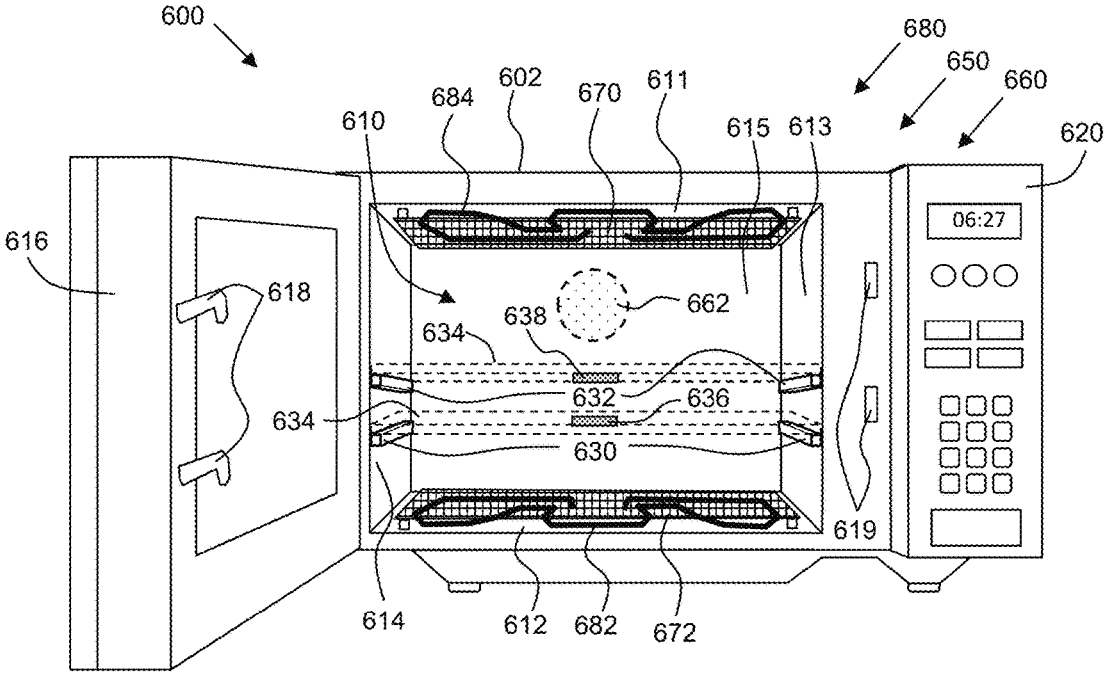
FIG. 6 is a perspective view of a heating appliance with an RF heating system and a radiant heating system, in accordance with an example embodiment.
Figure 8:
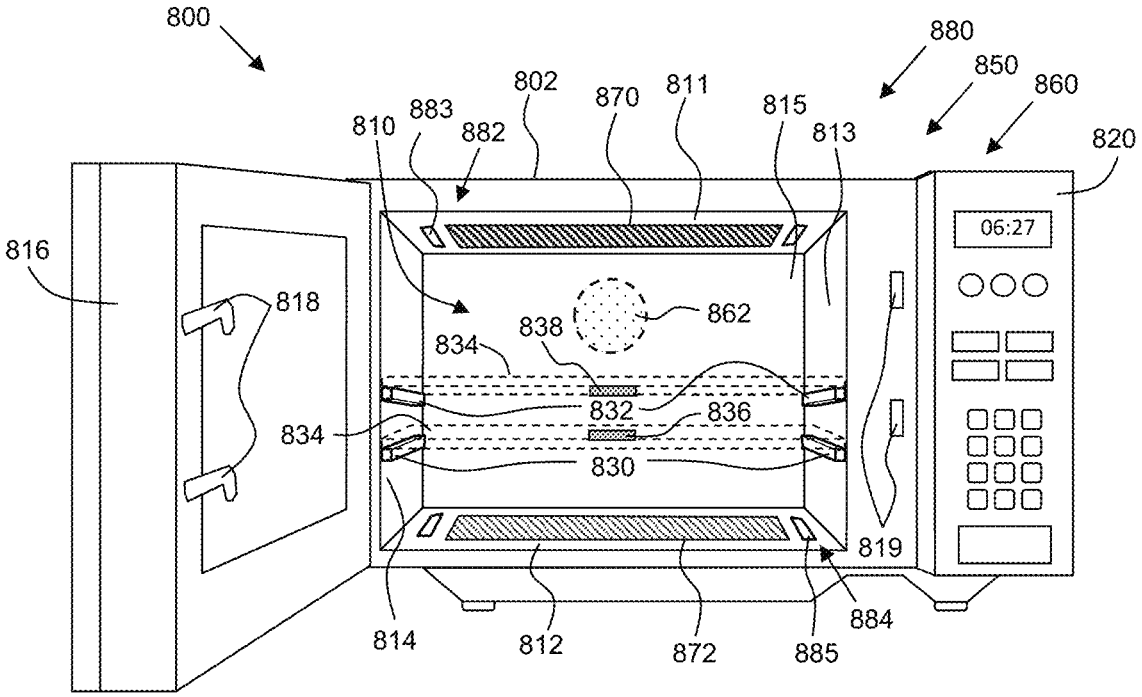
FIG. 8 is a perspective view of a heating appliance with an RF heating system and a gas heating system, in accordance with an example embodiment.

In other embodiments, such as the systems 600, 800 of FIGS. 6 and 8, air circulated by the convection system may be heated by a heating source that is not internal to the convection system, such as a distinct heating element within the cavity (e.g., heating element 682, 684, FIG. 6) or an activated burner (e.g., gas burner 882, 884, FIG. 8). In such embodiments, the convection system may include a simple fan contained within a fan compartment of the heating system (e.g., systems 600, 800, FIGS. 6, 8), which is in fluid communication with the system cavity (e.g., cavity 610, 810, FIGS. 6, 8) through an air intake and an air outlet. For example, FIG. 5 is a perspective view of a convection fan 500 that could be used in a heating system when the system includes an external heating source, such as in the appliances 600, 800 of FIGS. 6 and 8, in accordance with other example embodiments. Convection fan 500 simply includes a fan motor 510 coupled to a fan 512, and the fan motor 510 is configured to operate the fan 512 in response to a power input (from a power supply, not shown). While operating, the fan causes heated air (e.g., air heated by a heating source within a system cavity 610, 810, FIGS. 6, 8) to be drawn into the fan compartment through an air intake between the system cavity and the fan compartment, and causes the heated air to be forced back out of the fan compartment into the system cavity through an air outlet between the fan compartment and the system cavity (e.g., opening 662, 862, FIGS. 6, 8).

Referring again to FIG. 1, and according to an embodiment, during operation of the heating system 100, a user (not illustrated) may first place one or more loads (e.g., food and/or liquids) into the heating cavity 110, and close the door 116. As indicated previously, the user may place the load(s) on the bottom cavity wall 112, on an insulating layer over the bottom cavity wall, or on a rotating plate (not illustrated). Alternatively, as indicated previously, the user may place the load(s) on a shelf 134 that is inserted into the cavity 110 at any supported position. When utilizing the RF heating system during a cooking operation, and when the shelf 134 (or an electrode 272, 372, FIGS. 2, 3 within the shelf) functions as a bottom electrode (e.g., replacing electrode 172), it may be desirable to insert the shelf 134 at a position that results in a minimum distance between the top of the load and the first electrode 170 (or the top cavity wall 111). This may enable the capacitive cooking provided by the RF heating system to operate more efficiently than when the top of the load is farther from the first electrode 170 (or the top cavity wall 111).

As will be described in more detail later in conjunction with FIG. 16, to initiate a cooking process, the user may specify a type of cooking (or cooking mode) that the user would like the system 100 to implement. The user may specify the cooking mode through the control panel 120 (e.g., by pressing a button or making a cooking mode menu selection). According to an embodiment, the system 100 is capable of implementing at least the following distinct cooking modes: 1) convection-only cooking; 2) RF-only cooking; and 3) combined convection and RF cooking. For the convection-only cooking mode (mode 1, above), the convection system 160 is activated during the cooking process, and the RF heating system 150 is idle or deactivated. For the RF-only cooking mode (mode 2, above, including RF-only defrosting), the RF heating system 150 is activated during the cooking process, and the convection system 160 is idle or deactivated. Finally, for combined convection and RF cooking mode (mode 3, above), both the convection system 160 and the RF heating system 150 are activated during the cooking process. In this mode, both the convection system 160 and the RF heating system 150 may be activated simultaneously and continuously, or either system may be deactivated during portions of the process.

When implementing the convection-only cooking mode (mode 1, above) or the combined convection and RF cooking mode (mode 3, above), the system 100 may enable the user to provide inputs via the control panel 120 that specify a cavity temperature setpoint (or target oven temperature) for the cooking process (e.g., in a range of about 65-260 degrees Celsius (or 150-500 degrees Fahrenheit)). Alternatively, the cavity temperature setpoint may otherwise be obtained or determined by the system 100. In some embodiments, the cavity temperature setpoint may be varied throughout the process (e.g., the system 100 may run a software program that varies the oven temperature throughout the cooking process). In addition to specifying the cavity temperature setpoint, the system 100 also may enable the user to provide inputs via the control panel 120 that specify a cooking start time, stop time, and/or duration. In such an embodiment, the system 100 may monitor a system clock to determine when to activate and deactivate the RF and convection heating systems 150, 160.

The RF-only cooking mode may be particularly useful when gentle warming of the load is desired, such as for a defrosting operation. When implementing the RF-only cooking mode, the system 100 may enable the user to provide inputs via the control panel 120 that specify a type of operation to be performed (e.g., a defrost operation, or another RF-only warming operation). For a defrost operation, the system 100 may be configured to monitor feedback from the RF system that may indicate when the load has reached a desired temperature (e.g., −2 degrees Celsius, or some other temperature), and the system 100 may terminate operation when the desired load temperature is reached.

In some embodiments, the system also may enable the user optionally to provide inputs via the control panel 120 that specify characteristics of the load(s). For example, the specified characteristics may include an approximate weight of the load. In addition, the specified load characteristics may indicate the material(s) from which the load is formed (e.g., meat, bread, liquid). In alternate embodiments, the load characteristics may be obtained in some other way, such as by scanning a barcode on the load packaging or receiving a radio frequency identification (RFID) signal from an RFID tag on or embedded within the load. Either way, as will be described in more detail later, information regarding such load characteristics enables the RF heating system controller (e.g., RF heating system controller 912, 1212, FIGS. 9, 12) to establish an initial state for the impedance matching network of the system at the beginning of the heating operation, where the initial state may be relatively close to an optimal state that enables maximum RF power transfer into the load. Alternatively, load characteristics may not be entered or received prior to commencement of a heating operation, and the RF heating system controller may establish a default initial state for the impedance matching network.

To begin the heating operation, the user may provide a "start" input via the control panel 120 (e.g., the user may depress a "start" button). In response, a host system controller (e.g., host/thermal system controller 952, 1252, FIGS. 9, 12) sends appropriate control signals to the convection system 150 and/or the RF heating system 160 throughout the cooking process, depending on which cooking mode is being implemented. The particulars of system operation will be described in more detail later in conjunction with FIGS. 16-18.

Essentially, when performing convection-only cooking or combined convection and RF cooking, the system 100 selectively activates, deactivates, and otherwise controls the convention heating system 160 to pre-heat the system cavity 110 to the cavity temperature setpoint, and to maintain the temperature within the system cavity 110 at or near the cavity temperature setpoint. The system 100 may establish and maintain the temperature within the cavity 110 based on thermostat signals and/or based on feedback from the convection heating system 160.

When performing RF-only cooking or combined convection and RF cooking, the system selectively activates and controls the RF heating system 150 in a manner in which maximum RF power transfer may be absorbed by the load throughout the cooking process. During the heating operation, the impedance of the load (and thus the total input impedance of the cavity 110 plus load) changes as the thermal energy of the load increases. The impedance changes alter the absorption of RF energy into the load, and thus alter the magnitude of reflected power. According to an embodiment, power detection circuitry (e.g., power detection circuitry 930, 1430, FIGS. 9, 12) continuously or periodically measures the reflected power along a transmission path between the RF signal source and the system electrode(s) 170 and/or 172 (or shelf 134 or electrodes 272, 372 within shelf 134). Based on these measurements, an RF heating system controller (e.g., RF heating system controller 912, 1212, FIGS. 9, 12) may alter the state of the variable impedance matching network (e.g., networks 970, 1272, FIGS. 9, 12) during the heating operation to increase the absorption of RF power by the load. In addition, in some embodiments, the RF system controller may detect completion of the heating operation (e.g., when the load temperature has reached a target temperature) based on feedback from the power detection circuitry.

Heating system 100 is described as a combination of an RF heating system 150 and a thermal heating system in the form of a convection heating system 160. In other embodiments, an RF heating system also or alternatively may be combined with a radiant heating system or a gas heating system, both of which also may be characterized as "thermal heating systems". For example, FIG. 6 is a perspective view of a heating appliance 600 with an RF heating system 650 and a radiant heating system 680, in accordance with another example embodiment. Heating system 600 is similar to heating system 100 (FIG. 1), in that the components of heating system 600 are secured within a system housing 602, and heating system 600 includes a heating cavity 610 (e.g., cavity 960, 1260, FIGS. 9, 12), a control panel 620, and an RF heating system 650 (e.g., RF heating system 910, 1210, FIGS. 9, 12). In addition, in an embodiment, heating system 600 also may include a convection heating system 660, although the convection heating system 660 is optional. In contrast with heating system 100 (FIG. 1), however, system 600 includes a radiant heating system 680 (e.g., one embodiment of thermal heating system 950, 1250, FIGS. 9, 12) with heating elements 682, 684 disposed in the heating cavity 610.

The heating cavity 610 is defined by interior surfaces of top, bottom, side, and back cavity walls 611, 612, 613, 614, 615 and an interior surface of door 616. As shown in FIG. 6, door 616 may include a latching mechanism 618, which engages with a corresponding securing structure 619 of the system housing 602 to hold door 616 closed. In some embodiments, one or more shelf support structures 630, 632 are accessible within the heating cavity 610, and the shelf support structures 630, 632 are configured to hold a removable and repositionable shelf 634 (shown with dashed lines in FIG. 6, as the shelf is not inserted) at various heights above the bottom cavity wall 612. As discussed above in conjunction with FIG. 1, the shelf 634 may be configured as an electrode or contain an electrode. Further, the shelf 634 may have a simple planar structure (e.g., similar to structure 200, FIG. 2), or the shelf 634 may have a grid-type structure (e.g., similar to structure 300, FIG. 3). In such embodiments, the shelf 634 (or an electrode integrated within the shelf) may be electrically connected to other portions of the RF heating system or to a ground reference through conductive features (not shown) of the shelf support structures 630, 632. Alternatively, the shelf 634 and/or its integrated electrode may be electrically connected to other portions of the RF heating system or to a ground reference through a conductive connector 636, 638 in one of the cavity sidewalls.

The cavity walls 611-615, door 616, latching mechanism 618, securing structure 619, control panel 620, shelf support structures 630, 632, and repositionable shelf 634 may be substantially similar or identical to the cavity walls 111-115, door 116, latching mechanism 118, securing structure 119, control panel 120, shelf support structures 130, 132, and repositionable shelf 134, respectively, which were discussed above in conjunction with FIG. 1, including all of the various alternate embodiments of those system components. Accordingly, the description associated with cavity walls 111-115, door 116, latching mechanism 118, securing structure 119, control panel 120, shelf support structures 130, 132, and repositionable shelf 134 is intended to apply also to cavity walls 611-615, door 616, latching mechanism 618, securing structure 619, control panel 620, shelf support structures 630, 632, and repositionable shelf 634, but for purposes of brevity, that description is not repeated here.

As mentioned above, heating system 600 includes both an RF heating system 650 (e.g., RF heating system 910, 1210, FIGS. 9, 12), and a radiant heating system 680 (e.g., radiant heating system 950, 1250, FIGS. 9, 12). The radiant heating system 680 includes a thermal system controller (e.g., host/thermal system controller 952, 1252, FIGS. 9, 12), a power supply, one or more radiant heating elements 682, 684, and a thermostat (or oven sensor), in an embodiment. As will be described in more detail below, each heating element 682, 684 may be, for example, a resistive heating element, which is configured to heat air surrounding the heating element when current from the power supply is passed through the heating element. The thermostat (or oven sensor) senses the temperature of the air within the system cavity 610. Based on the sensed cavity temperature, the thermostat (or the thermal system controller) controls the supply of current provided by the power supply to the heating element(s) 682, 684. More specifically, the thermostat (or the thermal system controller) operates to maintain the cavity air temperature at or near the temperature setpoint.

According to an embodiment, the heating elements 682, 684 may be positioned at or near the bottom and/or top of the system cavity 610, respectively. In other embodiments, one or more heating elements may be located elsewhere (e.g., at or near the sides of the system cavity 610, and/or in separate compartments from the system cavity 610). Either way, the heating elements 682, 684 are in fluid communication with the system cavity 610, meaning that air heated by the heating elements 682, 684 may flow throughout the system cavity 610. The heating element 682 located at the bottom of the system cavity 610 provides heat to a load within the cavity 610 from below (e.g., for warming and baking), and the heating element 684 located at the top of the system cavity 610 provides heat to a load within the cavity 610 from above (e.g., for warming, baking, broiling, and/or browning).

Figure 7:
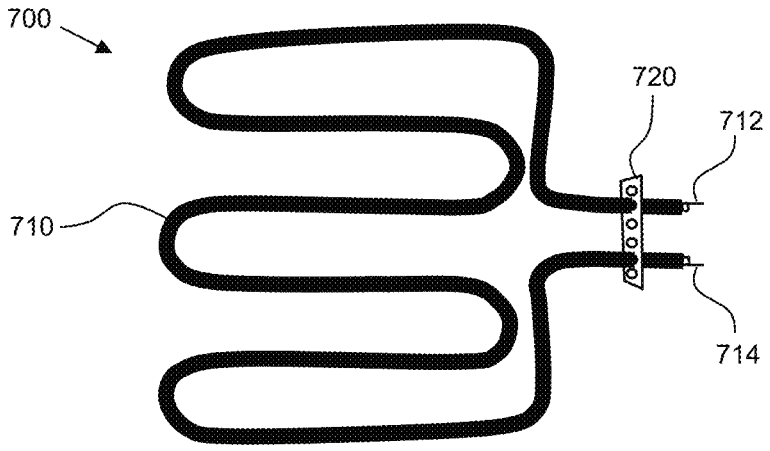
FIG. 7 is a top view of a heating element that could be used in the appliance of FIG. 6, in accordance with an example embodiment.

Each heating element 682, 684 is configured to heat air surrounding the heating element 682, 684 when electrical current is passed through the element. For example, each heating element 682, 684 may include a sheath heating element that is configured to heat surrounding air through the process of resistive or Joule heating. An example of such a heating element is illustrated in FIG. 7, which is a top view of a heating element 700 that could be used in the appliance of FIG. 6 (e.g., as either or both of heating elements 682, 684, FIG. 6), in accordance with an example embodiment. Heating element 700 includes a tubular heating element 710 that has an undulating shape within a two-dimensional area (or plane), so that an outer perimeter of the tubular heating element 710 fits within the perimeter of a given space (e.g., within the perimeter of the top or bottom cavity wall 611, 612). The tubular heating element 710 may include an inner conductor comprised of a wire or coil formed from an electrically-conductive and electrically-resistive material (e.g., nichrome (NiCr)), a surrounding metallic tube (e.g., formed from copper or a stainless steel alloy), and an outer insulating coating (e.g., magnesium oxide powder). Ends of the heating element 710 may be held in place with a bracket 720, in some embodiments, so that exposed ends 712, 714 of the inner conductor can be inserted into corresponding pairs of connectors in a radiant heating system (e.g., connector pairs in one or more walls 611-615 of the system). When current is passed through the wire of the heating element 710, the current encounters resistance, resulting in heating of the element 710 and the surrounding air.

Referring back to FIG. 6, the RF heating system 650 includes one or more RF signal sources (e.g., RF signal source 920, 1220, FIGS. 9, 12), a power supply (e.g., power supply 926, 1226, FIGS. 9, 12), a first electrode 670 (e.g., electrode 940, 1240, FIGS. 9, 12), a second electrode 672 (e.g., electrode 942, 1242, FIGS. 9, 12), impedance matching circuitry (e.g., circuits 934, 970, 1000, 1100, 1234, 1272, 1300, 1400, FIGS. 9-14), power detection circuitry (e.g., power detection circuitry 930, 1230, FIGS. 9, 12), and an RF heating system controller (e.g., system controller 912, 1212, FIGS. 9, 12).

The RF signal source(s), power supply, first electrode 670, second electrode 672, impedance matching circuitry, power detection circuitry, and RF heating system controller of RF heating system 650 may be substantially similar or identical to the RF signal source(s), power supply, first electrode 170, second electrode 172, impedance matching circuitry, power detection circuitry, and RF heating system controller, respectively, which were discussed above in conjunction with FIG. 1, including all of the various alternate embodiments of those system components. Accordingly, the description associated with these components in conjunction with FIG. 1 apply also to the analogous components in RF heating system 650, but for purposes of brevity, that description is not repeated here.

That said, the first electrode 670 and/or the second electrode 672 (and/or shelf 634) may be specifically designed so as not to substantially restrict or interfere with the movement of air heated by the heating elements 682, 684. Further, the heating elements 682, 684 and the first and second electrodes 670, 672 may be oriented with respect to each other so that the heating elements 682, 684 do not substantially alter or interfere with the electromagnetic field produced by either or both electrodes 670, 672.

According to one embodiment, when both a heating element and an electrode are proximate to a same cavity wall, the heating element is positioned between the electrode and the cavity wall. For example, in the embodiment of FIG. 6, on the top side of cavity 610, electrode 670 is positioned proximate to cavity wall 611, and heating element 684 is positioned between the electrode 670 and the cavity wall 611. On the bottom side of cavity 610, electrode 672 is positioned proximate to cavity wall 612, and heating element 682 is positioned between the electrode 672 and the cavity wall 612. Posts or other structures may be utilized to hold the electrodes 670, 672 and the heating elements 682, 684 in their desired orientations with respect to each other and the cavity walls 611, 612. In an embodiment, and as illustrated in FIG. 6, each of electrodes 670, 672 includes a plurality of openings that provide fluid communication between the area proximate to heating element 684, 682, respectively, and the system cavity 610. For example, each of electrodes 670, 672 may have a grid-like structure similar to structure 300 (FIG. 3), in an embodiment.

In other embodiments, either of heating elements 682, 684 may be excluded from system 600. In an embodiment in which heating element 682 is excluded, electrode 672 alternatively may be a simple planar electrode (e.g., similar to structure 200, FIG. 2). In another embodiment in which heating element 684 is excluded, electrode 670 alternatively may be a simple planar electrode (e.g., similar to structure 200, FIG. 2). In still other alternate embodiments, either or both of electrodes 670, 672 could be positioned between their corresponding heating elements 684, 682 and the proximate cavity walls 611, 612, and in such embodiments, the electrode 670, 672 could be a simple planar electrode (e.g., similar to structure 200, FIG. 2).

As mentioned above, system 600 optionally could include a convection system 660, as well. When included, convection system 660 could simply include a power supply and a fan, since heating of the air in the cavity 610 can be achieved by the heating elements 682, 684. However, convection system 660 also could include an integrated heating element and a thermostat, in some embodiments. Either way, the convection system fan may be selectively activated and deactivated by the system controller to circulate within the system cavity 610. In the system 600 illustrated in FIG. 6, the fan is located in a fan compartment outside of the system cavity 610, and fluid (air) communication between the fan and the system cavity 610 is provided through one or more openings in one or more cavity walls (e.g., through opening 662 in cavity wall 615).

During operation of the heating system 600, a user (not illustrated) may first place one or more loads (e.g., food and/or liquids) into the heating cavity 610, and close the door 616. The user may place the load on the bottom electrode 672 (or the bottom cavity wall 612 if electrode 672 and heating element 682 are excluded), or on an insulating structure over the bottom electrode 672, heating element 682, and/or cavity wall 612. Alternatively, as indicated previously, the user may place the load on a shelf 634 that is inserted into the cavity 610 at any supported position.

Again, as will be described in more detail later in conjunction with FIG. 16, to initiate a cooking process, the user may specify a type of cooking (or cooking mode) that the user would like the system 600 to implement. The user may specify the cooking mode through the control panel 620 (e.g., by pressing a button or making a cooking mode menu selection). According to an embodiment, the system 600 is capable of implementing at least the following distinct cooking modes: 1) radiant-only cooking; 2) RF-only cooking; and 3) combined radiant and RF cooking. When the system 600 also includes a convection heating system 660, the system 600 also may be capable of implementing the following additional cooking modes: 4) combined convection and radiant cooking; and 5) combined convection, radiant, and RF cooking.

When implementing the radiant-only cooking mode (mode 1, above), the combined radiant and RF cooking mode (mode 3, above), the convention and radiant cooking mode (mode 4, above), or the combined convection, radiant, and RF cooking mode (mode 5, above), the system 600 may enable the user to provide inputs via the control panel 620 that specify a cavity temperature setpoint for the cooking process (e.g., in a range of about 65-260 degrees Celsius (or 150-500 degrees Fahrenheit)). Alternatively, the cavity temperature setpoint may otherwise be obtained or determined by the system 600. In some embodiments, the cavity temperature setpoint may be varied throughout the process (e.g., the system 600 may run a software program that varies the oven temperature throughout the cooking process). In addition to specifying the cavity temperature setpoint, the system 600 also may enable the user to provide inputs via the control panel 620 that specify a cooking start time, stop time, and/or duration. In such an embodiment, the system 600 may monitor a system clock to determine when to activate and deactivate the RF and radiant heating systems 650, 680.

For the RF-only cooking mode (mode 2, above, including RF-only defrosting), the RF heating system 650 is activated during the cooking process, and the radiant heating system 680 and convection system 660 are idle or deactivated. Conversely, for combined radiant and RF cooking mode (mode 3, above), and the combined convection, radiant, and RF cooking mode (mode 5, above), of the RF heating system 650 and the radiant heating system 680 and/or the convection system 660 are activated during the cooking process. In these modes, RF heating system 650 and the radiant heating system 680 and/or the convection system 660 may be activated simultaneously and continuously, or either system may be deactivated during portions of the process.

To begin the heating operation, the user may provide a "start" input via the control panel 620 (e.g., the user may depress a "start" button). In response, a host system controller (e.g., host/thermal system controller 952, 1252, FIGS. 9, 12) sends appropriate control signals to the radiant heating system 680, the RF heating system 660, and/or the convection system 660 (when included) throughout the cooking process, depending on which cooking mode is being implemented. The particulars of system operation will be described in more detail later in conjunction with FIGS. 16-18.

Essentially, when performing radiant-only cooking or combined radiant and RF cooking, the system 600 selectively activates, deactivates, and otherwise controls the radiant heating system 680 to pre-heat the system cavity 610 to the cavity temperature setpoint, and to maintain the temperature within the system cavity 610 at or near the cavity temperature setpoint. The system 600 may establish and maintain the temperature within the cavity 610 based on thermostat readings and/or based on feedback from the radiant heating system 680. When performing RF-only cooking or combined radiant and RF cooking, the system selectively activates and controls the RF heating system 650 in a manner in which maximum RF power transfer may be absorbed by the load throughout the cooking process.

In still other embodiments, an RF heating system also or alternatively may be combined with a gas heating system, as mentioned above. For example, FIG. 8 is a perspective view of a heating appliance 800 with an RF heating system 850 and a gas heating system 880, in accordance with another example embodiment. Heating system 800 is similar to heating systems 100, 600 (FIGS. 1, 6), in that the components of heating system 800 are secured within a system housing 802, and heating system 800 includes a heating cavity 810 (e.g., cavity 960, 1260, FIGS. 9, 12), a control panel 820, and an RF heating system 850 (e.g., RF heating system 910, 1210, FIGS. 9, 12). In addition, in an embodiment, heating system 800 also may include a convection heating system 860, although the convection heating system 860 is optional. In contrast with heating systems 100, 600 (FIGS. 1, 6), however, system 800 includes a gas heating system 880 (e.g., one embodiment of thermal heating system 950, 1250, FIGS. 9, 12) with gas burners 882, 884 in fluid (air) communication with the heating cavity 810.

The heating cavity 810 is defined by interior surfaces of top, bottom, side, and back cavity walls 811, 812, 813, 814, 815 and an interior surface of door 816. As shown in FIG. 8, door 816 may include a latching mechanism 818, which engages with a corresponding securing structure 819 of the system housing 802 to hold door 816 closed. In some embodiments, one or more shelf support structures 830, 832 are accessible within the heating cavity 810, and the shelf support structures 830, 832 are configured to hold a removable and repositionable shelf 834 (shown with dashed lines in FIG. 8, as the shelf is not inserted) at various heights above the bottom cavity wall 812. As discussed above in conjunction with FIG. 1, the shelf 834 may be configured as an electrode or contain an electrode. Further, the shelf 834 may have a simple planar structure (e.g., similar to structure 200, FIG. 2), or the shelf 834 may have a grid-type structure (e.g., similar to structure 300, FIG. 3). In such embodiments, the shelf 834 (or an electrode integrated within the shelf) may be electrically connected to other portions of the RF heating system or to a ground reference through conductive features (not shown) of the shelf support structures 830, 832. Alternatively, the shelf 834 and/or its integrated electrode may be electrically connected to other portions of the RF heating system or to a ground reference through a conductive connector 836, 838 in one of the cavity sidewalls.

The cavity walls 811-815, door 816, latching mechanism 818, securing structure 819, control panel 820, shelf support structures 830, 832, and repositionable shelf 834 may be substantially similar or identical to the cavity walls 111-115, door 116, latching mechanism 118, securing structure 119, control panel 120, shelf support structures 130, 132, and repositionable shelf 134, respectively, which were discussed above in conjunction with FIG. 1, including all of the various alternate embodiments of those system components. Accordingly, the description associated with cavity walls 111-115, door 116, latching mechanism 118, securing structure 119, control panel 120, shelf support structures 130, 132, and repositionable shelf 134 is intended to apply also to cavity walls 811-815, door 816, latching mechanism 818, securing structure 819, control panel 820, shelf support structures 830, 832, and repositionable shelf 834, but for purposes of brevity, that description is not repeated here.

As mentioned above, heating system 800 includes both an RF heating system 850 (e.g., RF heating system 910, 1210, FIGS. 9, 12), and a gas heating system 880 (e.g., gas heating system 950, 1250, FIGS. 9, 12). The gas heating system 880 includes a gas heating system controller (e.g., host/thermal system controller 952, 1252, FIGS. 9, 12), an ignition source (e.g., a hot surface or glow bar ignitor), a gas valve, one or more burners 882, 884, and a thermostat (or oven sensor), in an embodiment. The thermostat (or oven sensor) senses the temperature of the air within the system cavity 810. Based on the sensed cavity temperature, the thermostat (or the gas heating system controller) controls the gas valve to increase or decrease a supply of gas provided by to the burner(s) 882, 884. More specifically, the thermostat (or the gas heating system controller) operates to maintain the cavity air temperature at or near the temperature setpoint.

According to an embodiment, the burners 882, 884 may be positioned at or near the bottom and/or top of the system cavity 810, respectively (e.g., in separate compartments from the system cavity 810). The burners 882, 884 are in fluid communication with the system cavity 810, meaning that air heated by ignited gas at the burners 882, 884 may flow throughout the system cavity 810. The burner 882 located at the bottom of the system cavity 810 provides heat to a load within the cavity 810 from below (e.g., for warming and baking), and the burner 884 located at the top of the system cavity 810 provides heat to a load within the cavity 810 from above (e.g., for warming, baking, broiling, and/or browning).

The RF heating system 850 includes one or more RF signal sources (e.g., RF signal source 920, 1220, FIGS. 9, 12), a power supply (e.g., power supply 926, 1226, FIGS. 9, 12), a first electrode 870 (e.g., electrode 940, 1240, FIGS. 9, 12), a second electrode 872 (e.g., electrode 942, 1242, FIGS. 9, 12), impedance matching circuitry (e.g., circuits 934, 970, 1000, 1100, 1234, 1272, 1300, 1400, FIGS. 9-14), power detection circuitry (e.g., power detection circuitry 930, 1230, FIGS. 9, 12), and an RF heating system controller (e.g., system controller 912, 1212, FIGS. 9, 12).

The RF signal source(s), power supply, first electrode 870, second electrode 872, impedance matching circuitry, power detection circuitry, and RF heating system controller of RF heating system 850 may be substantially similar or identical to the RF signal source(s), power supply, first electrode 170, second electrode 172, impedance matching circuitry, power detection circuitry, and RF heating system controller, respectively, which were discussed above in conjunction with FIG. 1, including all of the various alternate embodiments of those system components. Accordingly, the description associated with these components in conjunction with FIG. 1 apply also to the analogous components in RF heating system 850, but for purposes of brevity, that description is not repeated here.

That said, the first electrode 870 and/or the second electrode 872 (and/or shelf 834) may be specifically designed so as not to substantially restrict or interfere with the movement of air heated by the burners 882, 884. Further, the burners 882, 884 and the first and second electrodes 870, 872 may be oriented with respect to each other so that the burners 882, 884 do not substantially alter or interfere with the electromagnetic field produced by either or both electrodes 870, 872.

According to one embodiment, when both a burner and an electrode are proximate to a same cavity wall, the electrode is positioned between the burner and the cavity 810. For example, in the embodiment of FIG. 8, on the top side of cavity 810, electrode 870 is positioned proximate to cavity wall 811, and burner 884 is positioned in a separate burner cavity behind (above) the cavity wall 811. On the bottom side of cavity 810, electrode 872 is positioned proximate to cavity wall 812, and burner 882 is positioned in a separate burner cavity behind (below) the cavity wall 812. Air heated by ignited gas at the burners 882, 884 may enter the system cavity 810 through slots 883, 885. In other embodiments, either of burners 882, 884 may be excluded from system 800.

As mentioned above, system 800 optionally could include a convection system 860, as well. When included, convection system 860 could simply include a power supply and a fan, since heating of the air in the cavity 810 can be achieved by the ignited gas at the burners 882, 884. However, convection system 860 also could include an integrated heating element and a thermostat, in some embodiments. Either way, the convection system fan may be selectively activated and deactivated by the system controller to circulate within the system cavity 810. In the system 800 illustrated in FIG. 8, the fan is located in a fan compartment outside of the system cavity 810, and fluid (air) communication between the fan and the system cavity 810 is provided through one or more openings in one or more cavity walls (e.g., through opening 862 in cavity wall 815).

During operation of the heating system 800, a user (not illustrated) may first place one or more loads (e.g., food and/or liquids) into the heating cavity 810, and close the door 816. The user may place the load on the bottom electrode 872 (or the bottom cavity wall 812), or on an insulating structure over the bottom electrode 872 and/or cavity wall 812. Alternatively, as indicated previously, the user may place the load on a shelf 834 that is inserted into the cavity 810 at any supported position.

Again, as will be described in more detail later in conjunction with FIG. 16, to initiate a cooking process, the user may specify a type of cooking (or cooking mode) that the user would like the system 800 to implement. The user may specify the cooking mode through the control panel 820 (e.g., by pressing a button or making a cooking mode menu selection). According to an embodiment, the system 800 is capable of implementing at least the following distinct cooking modes: 1) gas-only cooking; 2) RF-only cooking; and 3) combined gas and RF cooking. When the system 800 also includes a convection heating system 860, the system 800 also may be capable of implementing the following additional cooking modes: 4) combined convection and gas cooking; and 5) combined convection, gas, and RF cooking.

When implementing the gas-only cooking mode (mode 1, above), the combined gas and RF cooking mode (mode 3, above), the convention and gas cooking mode (mode 4, above), or the combined convection, gas, and RF cooking mode (mode 5, above), the system 800 may enable the user to provide inputs via the control panel 820 that specify a cavity temperature setpoint for the cooking process (e.g., in a range of about 85-260 degrees Celsius (or 150-500 degrees Fahrenheit)). Alternatively, the cavity temperature setpoint may otherwise be obtained or determined by the system 800. In some embodiments, the cavity temperature setpoint may be varied throughout the process (e.g., the system 800 may run a software program that varies the oven temperature throughout the cooking process). In addition to specifying the cavity temperature setpoint, the system 800 also may enable the user to provide inputs via the control panel 820 that specify a cooking start time, stop time, and/or duration. In such an embodiment, the system 800 may monitor a system clock to determine when to activate and deactivate the RF and gas heating systems 850, 880.

For the RF-only cooking mode (mode 2, above, including RF-only defrosting), the RF heating system 850 is activated during the cooking process, and the gas heating system 880 and convection system 860 are idle or deactivated. Conversely, for combined gas and RF cooking mode (mode 3, above), and the combined convection, gas, and RF cooking mode (mode 5, above), of the RF heating system 850 and the gas heating system 880 and/or the convection system 860 are activated during the cooking process. In these modes, RF heating system 850 and the gas heating system 880 and/or the convection system 860 may be activated simultaneously and continuously, or either system may be deactivated during portions of the process.

To begin the heating operation, the user may provide a "start" input via the control panel 820 (e.g., the user may depress a "start" button). In response, a host system controller (e.g., host/thermal system controller 952, 1252, FIGS. 9, 12) sends appropriate control signals to the gas heating system 880, the RF heating system 860, and/or the convection system 860 (when included) throughout the cooking process, depending on which cooking mode is being implemented. The particulars of system operation will be described in more detail later in conjunction with FIGS. 16-18.

Essentially, when performing gas-only cooking or combined gas and RF cooking, the system 800 selectively activates, deactivates, and otherwise controls the gas heating system 880 to pre-heat the system cavity 810 to the cavity temperature setpoint, and to maintain the temperature within the system cavity 810 at or near the cavity temperature setpoint. The system 800 may establish and maintain the temperature within the cavity 810 based on thermostat readings and/or based on feedback from the gas heating system 880. When performing RF-only cooking or combined gas and RF cooking, the system selectively activates and controls the RF heating system 850 in a manner in which maximum RF power transfer may be absorbed by the load throughout the cooking process.

The heating systems 100, 600, 800 of FIGS. 1, 6, 8 each are embodied as a counter-top type of appliance. Those of skill in the art would understand, based on the description herein, that embodiments of heating systems may be incorporated into systems or appliances having other configurations, as well. Accordingly, the above-described implementations of heating systems in a stand-alone appliance are not meant to limit use of the embodiments only to those types of systems. Instead, various embodiments of heating systems may be incorporated into wall-cavity installed appliances, and systems that include multiple types of appliances incorporated in a common housing.

Further, although heating systems 100, 600, 800 are shown with their components in particular relative orientations with respect to one another, it should be understood that the various components may be oriented differently, as well. In addition, the physical configurations of the various components may be different. For example, control panels 120, 620, 820 may have more, fewer, or different user interface elements, and/or the user interface elements may be differently arranged. In addition, although a substantially cubic heating cavity 110 is illustrated in FIGS. 1, 6, and 8, it should be understood that a heating cavity may have a different shape, in other embodiments (e.g., cylindrical, and so on). Further, heating systems 100, 600, 800 may include additional components (e.g., a stationary or rotating plate within the cavity, an electrical cord, and so on) that are not specifically depicted in FIGS. 1, 6, and 8.

FIG. 9 is a simplified block diagram of an unbalanced heating system 900 (e.g., heating system 100, 600, 800, FIGS. 1, 6, 8), in accordance with an example embodiment. Heating system 900 includes host/thermal system controller 952, RF heating system 910, thermal heating system 950, user interface 992, and a containment structure 966 that defines an oven cavity 960, in an embodiment. It should be understood that FIG. 9 is a simplified representation of a heating system 900 for purposes of explanation and ease of description, and that practical embodiments may include other devices and components to provide additional functions and features, and/or the heating system 900 may be part of a larger electrical system.

The containment structure 966 may include bottom, top, and side walls, the interior surfaces of which define the cavity 960 (e.g., cavity 110, 610, 810, FIGS. 1, 6, 8). According to an embodiment, the cavity 960 may be sealed (e.g., with a door 116, 616, 816, FIGS. 1, 6, 8) to contain the heat and electromagnetic energy that is introduced into the cavity 960 during a heating operation. The system 900 may include one or more interlock mechanisms (e.g., latching mechanisms and securing structures 118, 119, 618, 619, 818, 819, FIGS. 1, 6, 8) that ensure that the seal is intact during a heating operation. If one or more of the interlock mechanisms indicates that the seal is breached, the host/thermal system controller 952 may cease the heating operation.

User interface 992 may correspond to a control panel (e.g., control panel 120, 620, 820, FIGS. 1, 6, 8), for example, which enables a user to provide inputs to the system regarding parameters for a heating operation (e.g., the cooking mode, characteristics of the load to be heated, and so on), start and cancel buttons, mechanical controls (e.g., a door/drawer open latch), and so on. In addition, the user interface may be configured to provide user-perceptible outputs indicating the status of a heating operation (e.g., a countdown timer, visible indicia indicating progress or completion of the heating operation, and/or audible tones indicating completion of the heating operation) and other information.

Figure 18:
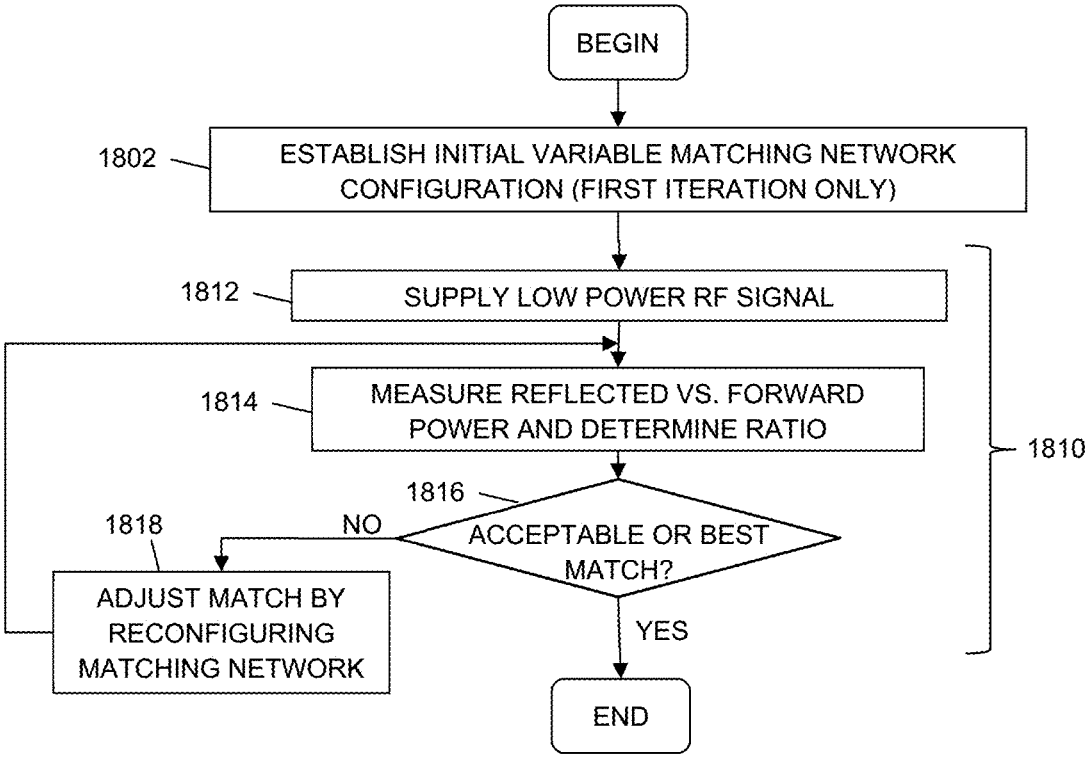
FIG. 18 is a flowchart of a method of performing a variable matching network calibration process, in accordance with an example embodiment.

As will be described in more detail in conjunction with FIGS. 16 and 18, the host/thermal system controller 952 may perform functions associated with the overall system 900 (e.g., "host control functions"), and functions associated more particularly with the thermal heating system 950 (e.g., "thermal system control functions"). Because, in an embodiment, the host control functions and the thermal system control functions may be performed by one hardware controller, the host/thermal system controller 952 is shown as a dual-function controller. In alternate embodiments, the host controller and the thermal system controller may be distinct controllers that are communicatively coupled.

The thermal heating system 950 includes host/thermal system controller 952, one or more thermal heating components 954, thermostat 956, and in some embodiments, a fan 958. Host/thermal system controller 952 may include one or more general purpose or special purpose processors (e.g., a microprocessor, microcontroller, Application Specific Integrated Circuit (ASIC), and so on), volatile and/or non-volatile memory (e.g., Random Access Memory (RAM), Read Only Memory (ROM), flash, various registers, and so on), one or more communication busses, and other components. According to an embodiment, host/thermal system controller 952 is coupled to user interface 992, RF heating system controller 912, thermal heating components 954, thermostat 956, fan 958, and sensors 994 (if included). In some embodiments, host/thermal system controller 952 and portions of user interface 992 may be included together in a host module 990.

Host/thermal system controller 952 is configured to receive signals indicating user inputs received via user interface 992, and to provide signals to the user interface 992 that enable the user interface 992 to produce user-perceptible outputs (e.g., via a display, speaker, and so on) indicating various aspects of the system operation. In addition, host/thermal system controller 952 sends control signals to other components of the thermal heating system 950 (e.g., to thermal heating components 954 and fan 958) to selectively activate, deactivate, and otherwise control those other components in accordance with desired system operation. The host/thermal system controller 952 also may receive signals from the thermal heating system components 954, thermostat 956, and sensors 994 (if included), indicating operational parameters of those components, and the host/thermal system controller 952 may modify operation of the system 900 accordingly, as will be described later. Further still, host/thermal system controller 952 receives signals from the RF heating system controller 912 regarding operation of the RF heating system 910. Responsive to the received signals and measurements from the user interface 992 and from the RF heating system controller 912, host/thermal system controller 952 may provide additional control signals to the RF heating system controller 912, which affects operation of the RF heating system 910.

The one or more thermal heating components 954 may include, for example, one or more heating elements (e.g., heating elements 682, 684, FIG. 6, and/or heating element(s) within a convection system 160, 660, 860, FIGS. 1, 6, 8), one or more gas burners (e.g., gas burners 882, 884, FIG. 8), and/or other components that are configured to heat air within the oven cavity 960. The thermostat 956 (or an oven sensor) is configured to sense the air temperature within the oven cavity 960, and to control operation of the one or more thermal heating components 954 to maintain the air temperature within the oven cavity at or near a temperature setpoint (e.g., a temperature setpoint established by the user through the user interface 992). This temperature control process may be performed by the thermostat 956 in a closed loop system with the thermal heating components 954, or the thermostat 956 may communicate with the host/thermal system controller 952, which also participates in controlling operation of the one or more thermal heating components 954. Finally, fan 958 is included when the system 900 includes a convection system (e.g., convection system 160, 660, 860, FIGS. 1, 6, 8), and the fan 958 is selectively activated and deactivated to circulate the air within the oven cavity 960.

The RF heating system 910 includes RF heating system controller 912, RF signal source 920, power supply and bias circuitry 926, first impedance matching circuit 934 (herein "first matching circuit"), variable impedance matching network 970, first and second electrodes 940, 942, and power detection circuitry 930, in an embodiment. RF heating system controller 912 may include one or more general purpose or special purpose processors (e.g., a microprocessor, microcontroller, ASIC, and so on), volatile and/or non-volatile memory (e.g., RAM, ROM, flash, various registers, and so on), one or more communication busses, and other components. According to an embodiment, RF heating system controller 912 is coupled to host/thermal system controller 952, RF signal source 920, variable impedance matching network 970, power detection circuitry 930, and sensors 994 (if included). RF heating system controller 912 is configured to receive control signals from the host/thermal system controller 952 indicating various operational parameters, and to receive signals indicating RF signal reflected power (and possibly RF signal forward power) from power detection circuitry 930. Responsive to the received signals and measurements, and as will be described in more detail later, RF heating system controller 912 provides control signals to the power supply and bias circuitry 926 and to the RF signal generator 922 of the RF signal source 920. In addition, RF heating system controller 912 provides control signals to the variable impedance matching network 970, which cause the network 970 to change its state or configuration.

Oven cavity 960 includes a capacitive heating arrangement with first and second parallel plate electrodes 940, 942 that are separated by an air cavity 960 within which a load 964 to be heated may be placed. For example, a first electrode 940 may be positioned above the air cavity 960, and a second electrode 942 may be positioned below the air cavity 960. In some embodiments, the second electrode 942 may be implemented in the form of a shelf or contained within a shelf (e.g., shelf 134, 200, 300, 634, 834, FIGS. 1-3, 6, 8) that is inserted in the cavity 960 as previously described. In other embodiments, a distinct second electrode 942 may be excluded, and the functionality of the second electrode may be provided by a portion of the containment structure 966 (i.e., the containment structure 966 may be considered to be the second electrode, in such an embodiment).

According to an embodiment, the containment structure 966 and/or the second electrode 942 are connected to a ground reference voltage (i.e., containment structure 966 and second electrode 942 are grounded). Alternatively, at least the portion of the containment structure 966 that corresponds to the bottom surface of the cavity 960 may be formed from conductive material and grounded when the containment structure 966 (or at least the portion of the containment structure 966 that is parallel with the first electrode 940) functions as a second electrode of the capacitive heating arrangement. To avoid direct contact between the load 964 and the second electrode 942 (or the grounded bottom surface of the cavity 960), a non-conductive barrier 962 may be positioned over the second electrode 942 or the bottom surface of the cavity 960.

Again, oven cavity 960 includes a capacitive heating arrangement with first and second parallel plate electrodes 940, 942 that are separated by an air cavity 960 within which a load 964 to be heated may be placed. The first and second electrodes 940, 942 are positioned within containment structure 966 to define a distance 946 between the electrodes 940, 942, where the distance 946 renders the cavity 960 a sub-resonant cavity, in an embodiment.

In various embodiments, the distance 946 is in a range of about 0.10 meters to about 1.0 meter, although the distance may be smaller or larger, as well. According to an embodiment, distance 946 is less than one wavelength of the RF signal produced by the RF subsystem 910. In other words, as mentioned above, the cavity 960 is a sub-resonant cavity. In some embodiments, the distance 946 is less than about half of one wavelength of the RF signal. In other embodiments, the distance 946 is less than about one quarter of one wavelength of the RF signal. In still other embodiments, the distance 946 is less than about one eighth of one wavelength of the RF signal. In still other embodiments, the distance 946 is less than about one 50th of one wavelength of the RF signal. In still other embodiments, the distance 946 is less than about one 100th of one wavelength of the RF signal.

In general, an RF heating system 910 designed for lower operational frequencies (e.g., frequencies between 10 MHz and 100 MHz) may be designed to have a distance 946 that is a smaller fraction of one wavelength. For example, when system 910 is designed to produce an RF signal with an operational frequency of about 10 MHz (corresponding to a wavelength of about 30 meters), and distance 946 is selected to be about 0.5 meters, the distance 946 is about one 60th of one wavelength of the RF signal. Conversely, when system 910 is designed for an operational frequency of about 300 MHz (corresponding to a wavelength of about 1 meter), and distance 946 is selected to be about 0.5 meters, the distance 946 is about one half of one wavelength of the RF signal.

With the operational frequency and the distance 946 between electrodes 940, 942 being selected to define a sub-resonant interior cavity 960, the first and second electrodes 940, 942 are capacitively coupled. More specifically, the first electrode 940 may be analogized to a first plate of a capacitor, the second electrode 942 may be analogized to a second plate of a capacitor, and the load 964, barrier 962 (if included), and air within the cavity 960 may be analogized to a capacitor dielectric. Accordingly, the first electrode 940 alternatively may be referred to herein as an "anode," and the second electrode 942 may alternatively be referred to herein as a "cathode."

Essentially, the voltage across the first electrode 940 and the second electrode 942 contributes to heating the load 964 within the cavity 960. According to various embodiments, the RF heating system 910 is configured to generate the RF signal to produce voltages between the electrodes 940, 942 in a range of about 90 volts to about 3000 volts, in one embodiment, or in a range of about 3000 volts to about 10,000 volts, in another embodiment, although the system 910 may be configured to produce lower or higher voltages between the electrodes 940, 942, as well.

The first electrode 940 is electrically coupled to the RF signal source 920 through a first matching circuit 934, a variable impedance matching network 970, and a conductive transmission path, in an embodiment. The first matching circuit 934 is configured to perform an impedance transformation from an impedance of the RF signal source 920 (e.g., less than about 10 ohms) to an intermediate impedance (e.g., 50 ohms, 75 ohms, or some other value). According to an embodiment, the conductive transmission path includes a plurality of conductors 928-1, 928-2, and 928-3 connected in series, and referred to collectively as transmission path 928. According to an embodiment, the conductive transmission path 928 is an "unbalanced" path, which is configured to carry an unbalanced RF signal (i.e., a single RF signal referenced against ground). In some embodiments, one or more connectors (not shown, but each having male and female connector portions) may be electrically coupled along the transmission path 928, and the portion of the transmission path 928 between the connectors may comprise a coaxial cable or other suitable connector. Such a connection is shown in FIG. 12 and described later (e.g., including connectors 1236, 1238 and a conductor 1228-3 such as a coaxial cable between the connectors 1236, 1238).

As will be described in more detail later, the variable impedance matching circuit 970 is configured to perform an impedance transformation from the above-mentioned intermediate impedance to an input impedance of oven cavity 960 as modified by the load 964 (e.g., on the order of hundreds or thousands of ohms, such as about 1000 ohms to about 4000 ohms or more). In an embodiment, the variable impedance matching network 970 includes a network of passive components (e.g., inductors, capacitors, resistors).

Figure 10:
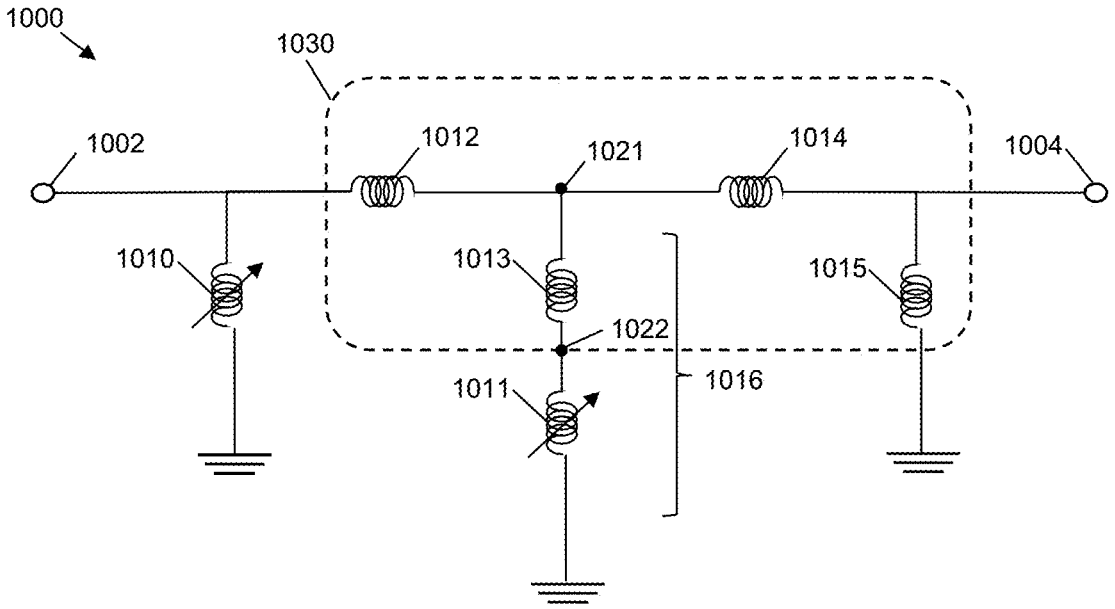
FIG. 10 is a schematic diagram of a single-ended variable inductance matching network, in accordance with an example embodiment.

According to one more specific embodiment, the variable impedance matching network 970 includes a plurality of fixed-value lumped inductors (e.g., inductors 1012-1015, 1154. FIGS. 10, 11) that are positioned within the cavity 960 and which are electrically coupled to the first electrode 940. In addition, in one embodiment, the variable impedance matching network 970 includes a plurality of variable inductance networks (e.g., networks 1010, 1011, FIG. 10), which may be located inside or outside of the cavity 960. According to another embodiment, the variable impedance matching network 970 includes a plurality of variable capacitance networks (e.g., networks 1142, 1146, FIG. 11), which may be located inside or outside of the cavity 960. The inductance or capacitance value provided by each of the variable inductance or capacitance networks is established using control signals from the RF heating system controller 912, as will be described in more detail later. In any event, by changing the state of the variable impedance matching network 970 over the course of a heating operation to dynamically match the ever-changing cavity plus load impedance, the amount of RF power that is absorbed by the load 964 may be maintained at a high level despite variations in the load impedance during the heating operation.

According to an embodiment, RF signal source 920 includes an RF signal generator 922 and a power amplifier (e.g., including one or more power amplifier stages 924, 925). In response to control signals provided by RF heating system controller 912 over connection 914, RF signal generator 922 is configured to produce an oscillating electrical signal having a frequency in the ISM (industrial, scientific, and medical) band, although the system could be modified to support operations in other frequency bands, as well. The RF signal generator 922 may be controlled to produce oscillating signals of different power levels and/or different frequencies, in various embodiments. For example, the RF signal generator 922 may produce a signal that oscillates in the VHF (very high frequency) range (i.e., in a range between about 30.0 megahertz (MHz) and about 300 MHz), and/or in a range of about 10.0 MHz to about 100 MHz, and/or from about 100 MHz to about 3.0 gigahertz (GHz). Some desirable frequencies may be, for example, 13.56 MHz (+/−5 percent), 27.125 MHz (+/−5 percent), 40.68 MHz (+/−5 percent), and 2.45 GHz (+/−5 percent). In one particular embodiment, for example, the RF signal generator 922 may produce a signal that oscillates in a range of about 40.66 MHz to about 40.70 MHz and at a power level in a range of about 10 decibel-milliwatts (dBm) to about 15 dBm. Alternatively, the frequency of oscillation and/or the power level may be lower or higher.

In the embodiment of FIG. 9, the power amplifier includes a driver amplifier stage 924 and a final amplifier stage 925. The power amplifier is configured to receive the oscillating signal from the RF signal generator 922, and to amplify the signal to produce a significantly higher-power signal at an output of the power amplifier. For example, the output signal may have a power level in a range of about 100 watts to about 400 watts or more. The gain applied by the power amplifier may be controlled using gate bias voltages and/or drain supply voltages provided by the power supply and bias circuitry 926 to each amplifier stage 924, 925. More specifically, power supply and bias circuitry 926 provides bias and supply voltages to each RF amplifier stage 924, 925 in accordance with control signals received from RF heating system controller 912.

In an embodiment, each amplifier stage 924, 925 is implemented as a power transistor, such as a field effect transistor (FET), having an input terminal (e.g., a gate or control terminal) and two current carrying terminals (e.g., source and drain terminals). Impedance matching circuits (not illustrated) may be coupled to the input (e.g., gate) of the driver amplifier stage 924, between the driver and final amplifier stages 925, and/or to the output (e.g., drain terminal) of the final amplifier stage 925, in various embodiments. In an embodiment, each transistor of the amplifier stages 924, 925 includes a laterally diffused metal oxide semiconductor FET (LDMOSFET) transistor. However, it should be noted that the transistors are not intended to be limited to any particular semiconductor technology, and in other embodiments, each transistor may be realized as a gallium nitride (GaN) transistor, another type of MOSFET transistor, a bipolar junction transistor (BJT), or a transistor utilizing another semiconductor technology.

In FIG. 9, the power amplifier arrangement is depicted to include two amplifier stages 924, 925 coupled in a particular manner to other circuit components. In other embodiments, the power amplifier arrangement may include other amplifier topologies and/or the amplifier arrangement may include only one amplifier stage (e.g., as shown in the embodiment of amplifier 1224, FIG. 12), or more than two amplifier stages. For example, the power amplifier arrangement may include various embodiments of a single-ended amplifier, a Doherty amplifier, a Switch Mode Power Amplifier (SMPA), or another type of amplifier.

Oven cavity 960 and any load 964 (e.g., food, liquids, and so on) positioned in the oven cavity 960 present a cumulative load for the electromagnetic energy (or RF power) that is radiated into the cavity 960 by the first electrode 940. More specifically, the cavity 960 and the load 964 present an impedance to the system, referred to herein as a "cavity plus load impedance." The cavity plus load impedance changes during a heating operation as the temperature of the load 964 increases. The cavity plus load impedance has a direct effect on the magnitude of reflected signal power along the conductive transmission path 928 between the RF signal source 920 and electrode 940. In most cases, it is desirable to maximize the magnitude of transferred signal power into the cavity 960, and/or to minimize the reflected-to-forward signal power ratio along the conductive transmission path 928.

In order to at least partially match the output impedance of the RF signal generator 920 to the cavity plus load impedance, a first matching circuit 934 is electrically coupled along the transmission path 928, in an embodiment. The first matching circuit 934 may have any of a variety of configurations. According to an embodiment, the first matching circuit 934 includes fixed components (i.e., components with non-variable component values), although the first matching circuit 934 may include one or more variable components, in other embodiments. For example, the first matching circuit 934 may include any one or more circuits selected from an inductance/capacitance (LC) network, a series inductance network, a shunt inductance network, or a combination of bandpass, high-pass and low-pass circuits, in various embodiments. Essentially, the fixed matching circuit 934 is configured to raise the impedance to an intermediate level between the output impedance of the RF signal generator 920 and the cavity plus load impedance.

According to an embodiment, power detection circuitry 930 is coupled along the transmission path 928 between the output of the RF signal source 920 and the electrode 940. In a specific embodiment, the power detection circuitry 930 forms a portion of the RF subsystem 910, and is coupled to the conductor 928-2 between the output of the first matching circuit 934 and the input to the variable impedance matching network 970, in an embodiment. In alternate embodiments, the power detection circuitry 930 may be coupled to the portion 928-1 of the transmission path 928 between the output of the RF signal source 920 and the input to the first matching circuit 934, or to the portion 928-3 of the transmission path 928 between the output of the variable impedance matching network 970 and the first electrode 940.

Wherever it is coupled, power detection circuitry 930 is configured to monitor, measure, or otherwise detect the power of the reflected signals traveling along the transmission path 928 between the RF signal source 920 and electrode 940 (i.e., reflected RF signals traveling in a direction from electrode 940 toward RF signal source 920). In some embodiments, power detection circuitry 930 also is configured to detect the power of the forward signals traveling along the transmission path 928 between the RF signal source 920 and the electrode 940 (i.e., forward RF signals traveling in a direction from RF signal source 920 toward electrode 940). Over connection 932, power detection circuitry 930 supplies signals to RF heating system controller 912 conveying the magnitudes of the reflected signal power (and the forward signal power, in some embodiments). In embodiments in which both the forward and reflected signal power magnitudes are conveyed, RF heating system controller 912 may calculate a reflected-to-forward signal power ratio, or an S11 parameter, or a voltage standing wave ration (VSWR) value. As will be described in more detail below, when the reflected signal power magnitude exceeds a reflected signal power threshold, or when the reflected-to-forward signal power ratio exceeds an S11 parameter threshold, or when a VSWR value exceeds a VSWR threshold, this indicates that the system 900 is not adequately matched to the cavity plus load impedance, and that energy absorption by the load 964 within the cavity 960 may be sub-optimal. In such a situation, RF heating system controller 912 orchestrates a process of altering the state of the variable matching network 970 to drive the reflected signal power or the S11 parameter or the VSWR value toward or below a desired level (e.g., below the reflected signal power threshold, and/or the reflected-to-forward signal power ratio threshold, and/or the S11 parameter threshold, and/or the VSWR threshold), thus re-establishing an acceptable match and facilitating more optimal energy absorption by the load 964.

For example, the RF heating system controller 912 may provide control signals over control path 916 to the variable matching circuit 970, which cause the variable matching circuit 970 to vary inductive, capacitive, and/or resistive values of one or more components within the circuit, thus adjusting the impedance transformation provided by the circuit 970. Adjustment of the configuration of the variable matching circuit 970 desirably decreases the magnitude of reflected signal power, which corresponds to decreasing the magnitude of the S11 parameter and/or VSWR, and increasing the power absorbed by the load 964.

As discussed above, the variable impedance matching network 970 is used to match the cavity plus load impedance of the oven cavity 960 plus load 964 to maximize, to the extent possible, the RF power transfer into the load 964. The initial impedance of the oven cavity 960 and the load 964 may not be known with accuracy at the beginning of a heating operation. Further, the impedance of the load 964 changes during a heating operation as the load 964 warms up. According to an embodiment, the RF heating system controller 912 may provide control signals to the variable impedance matching network 970, which cause modifications to the state of the variable impedance matching network 970. This enables the RF heating system controller 912 to establish an initial state of the variable impedance matching network 970 at the beginning of the heating operation that has a relatively low reflected to forward power ratio, and thus a relatively high absorption of the RF power by the load 964. In addition, this enables the RF heating system controller 912 to modify the state of the variable impedance matching network 970 so that an adequate match may be maintained throughout the heating operation, despite changes in the impedance of the load 964.

Non-limiting examples of configurations for the variable matching network 970 are shown in FIGS. 10 and 11. For example, the network 970 may include any one or more circuits selected from an inductance/capacitance (LC) network, an inductance-only network, a capacitance-only network, or a combination of bandpass, high-pass and low-pass circuits, in various embodiments. In an embodiment, the variable matching network 970 includes a single-ended network (e.g., network 1000, 1100, FIG. 10, 11). The inductance, capacitance, and/or resistance values provided by the variable matching network 970, which in turn affect the impedance transformation provided by the network 970, are established using control signals from the RF heating system controller 912, as will be described in more detail later. In any event, by changing the state of the variable matching network 970 over the course of a heating operation to dynamically match the ever-changing impedance of the cavity 960 plus the load 964 within the cavity 960, the system efficiency may be maintained at a high level throughout the heating operation.

The variable matching network 970 may have any of a wide variety of circuit configurations, and non-limiting examples of such configurations are shown in FIGS. 10 and 11. According to an embodiment, as exemplified in FIG. 10, the variable impedance matching network 970 may include a single-ended network of passive components, and more specifically a network of fixed-value inductors (e.g., lumped inductive components) and variable inductors (or variable inductance networks). According to another embodiment, as exemplified in FIG. 11, the variable impedance matching network 970 may include a single-ended network of passive components, and more specifically a network of variable capacitors (or variable capacitance networks). As used herein, the term "inductor" means a discrete inductor or a set of inductive components that are electrically coupled together without intervening components of other types (e.g., resistors or capacitors). Similarly, the term "capacitor" means a discrete capacitor or a set of capacitive components that are electrically coupled together without intervening components of other types (e.g., resistors or inductors).

Referring first to the variable-inductance impedance matching network embodiment, FIG. 10 is a schematic diagram of a single-ended variable impedance matching network 1000 (e.g., variable impedance matching network 970, FIG. 9) that may be incorporated into a heating system (e.g., system 100, 600, 800, 900, FIGS. 1, 6, 8, 9), in accordance with an example embodiment. As will be explained in more detail below, the variable impedance matching network 970 essentially has two portions: one portion to match the RF signal source (or the final stage power amplifier), and another portion to match the cavity plus load.

Variable impedance matching network 1000 includes an input node 1002, an output node 1004, first and second variable inductance networks 1010, 1011, and a plurality of fixed-value inductors 1012-1015, according to an embodiment. When incorporated into a heating system (e.g., system 900, FIG. 9), the input node 1002 is electrically coupled to an output of the RF signal source (e.g., RF signal source 920, FIG. 9), and the output node 1004 is electrically coupled to an electrode (e.g., first electrode 940, FIG. 9) within the heating cavity (e.g., oven cavity 960, FIG. 9).

Between the input and output nodes 1002, 1004, the variable impedance matching network 1000 includes first and second, series coupled lumped inductors 1012, 1014, in an embodiment. The first and second lumped inductors 1012, 1014 are relatively large in both size and inductance value, in an embodiment, as they may be designed for relatively low frequency (e.g., about 40.66 MHz to about 40.70 MHz) and high power (e.g., about 50 watts (W) to about 500 W) operation. For example, inductors 1012, 1014 may have values in a range of about 200 nanohenries (nH) to about 600 nH, although their values may be lower and/or higher, in other embodiments.

The first variable inductance network 1010 is a first shunt inductive network that is coupled between the input node 1002 and a ground reference terminal (e.g., the grounded containment structure 966, FIG. 9). According to an embodiment, the first variable inductance network 1010 is configurable to match the impedance of the RF signal source (e.g., RF signal source 920, FIG. 9) as modified by the first matching circuit (e.g., circuit 934, FIG. 9), or more particularly to match the impedance of the final stage power amplifier (e.g., amplifier 925, FIG. 9) as modified by the first matching circuit (e.g., circuit 934, FIG. 9). Accordingly, the first variable inductance network 1010 may be referred to as the "RF signal source matching portion" of the variable impedance matching network 1000. According to an embodiment, the first variable inductance network 1010 includes a network of inductive components that may be selectively coupled together to provide inductances in a range of about 10 nH to about 400 nH, although the range may extend to lower or higher inductance values, as well.

In contrast, the "cavity matching portion" of the variable impedance matching network 1000 is provided by a second shunt inductive network 1016 that is coupled between a node 1022 between the first and second lumped inductors 1012, 1014 and the ground reference terminal. According to an embodiment, the second shunt inductive network 1016 includes a third lumped inductor 1013 and a second variable inductance network 1011 coupled in series, with an intermediate node 1022 between the third lumped inductor 1013 and the second variable inductance network 1011. Because the state of the second variable inductance network 1011 may be changed to provide multiple inductance values, the second shunt inductive network 1016 is configurable to optimally match the impedance of the cavity plus load (e.g., cavity 960 plus load 964, FIG. 9). For example, inductor 1013 may have a value in a range of about 400 nH to about 800 nH, although its value may be lower and/or higher, in other embodiments. According to an embodiment, the second variable inductance network 1011 includes a network of inductive components that may be selectively coupled together to provide inductances in a range of about 50 nH to about 800 nH, although the range may extend to lower or higher inductance values, as well.

Finally, the variable impedance matching network 1000 includes a fourth lumped inductor 1015 coupled between the output node 1004 and the ground reference terminal. For example, inductor 1015 may have a value in a range of about 400 nH to about 800 nH, although its value may be lower and/or higher, in other embodiments.

The set 1030 of lumped inductors 1012-1015 may form a portion of a module that is at least partially physically located within the cavity (e.g., cavity 960, FIG. 9), or at least within the confines of the containment structure (e.g., containment structure 966, FIG. 9). This enables the radiation produced by the lumped inductors 1012-1015 to be safely contained within the system, rather than being radiated out into the surrounding environment. In contrast, the variable inductance networks 1010, 1011 may or may not be contained within the cavity or the containment structure, in various embodiments.

According to an embodiment, the variable impedance matching network 1000 embodiment of FIG. 10 includes "only inductors" to provide a match for the input impedance of the oven cavity 960 plus load 964. Thus, the network 1000 may be considered an "inductor-only" matching network. As used herein, the phrases "only inductors" or "inductor-only" when describing the components of the variable impedance matching network means that the network does not include discrete resistors with significant resistance values or discrete capacitors with significant capacitance values. In some cases, conductive transmission lines between components of the matching network may have minimal resistances, and/or minimal parasitic capacitances may be present within the network. Such minimal resistances and/or minimal parasitic capacitances are not to be construed as converting embodiments of the "inductor-only" network into a matching network that also includes resistors and/or capacitors. Those of skill in the art would understand, however, that other embodiments of variable impedance matching networks may include differently configured inductor-only matching networks, and matching networks that include combinations of discrete inductors, discrete capacitors, and/or discrete resistors.

FIG. 11 is a schematic diagram of a single-ended variable capacitive matching network 1100 (e.g., variable impedance matching network 970, FIG. 9) that may be incorporated into a heating system (e.g., system 100, 600, 800, 900, FIGS. 1, 6, 8, 9), and which may be implemented instead of the variable-inductance impedance matching network 1000 (FIG. 10), in accordance with an example embodiment. Variable impedance matching network 1100 includes an input node 1102, an output node 1104, first and second variable capacitance networks 1142, 1146, and at least one inductor 1154, according to an embodiment. When incorporated into a heating system (e.g., system 900, FIG. 9), the input node 1102 is electrically coupled to an output of the RF signal source (e.g., RF signal source 920, FIG. 9), and the output node 1104 is electrically coupled to an electrode (e.g., first electrode 940, FIG. 9) within the heating cavity (e.g., oven cavity 960, FIG. 9).

Between the input and output nodes 1102, 1104, the variable impedance matching network 1100 includes a first variable capacitance network 1142 coupled in series with an inductor 1154, and a second variable capacitance network 1146 coupled between an intermediate node 1151 and a ground reference terminal (e.g., the grounded containment structure 966, FIG. 9), in an embodiment. The inductor 1154 may be designed for relatively low frequency (e.g., about 40.66 MHz to about 40.70 MHz) and high power (e.g., about 50 W to about 500 W) operation, in an embodiment. For example, inductor 1154 may have a value in a range of about 200 nH to about 600 nH, although its value may be lower and/or higher, in other embodiments. According to an embodiment, inductor 1154 is a fixed-value, lumped inductor (e.g., a coil). In other embodiments, the inductance value of inductor 1154 may be variable.

The first variable capacitance network 1142 is coupled between the input node 1102 and the intermediate node 1111, and the first variable capacitance network 1142 may be referred to as a "series matching portion" of the variable impedance matching network 1100. According to an embodiment, the first variable capacitance network 1142 includes a first fixed-value capacitor 1143 coupled in parallel with a first variable capacitor 1144. The first fixed-value capacitor 1143 may have a capacitance value in a range of about 1 picofarad (pF) to about 100 pF, in an embodiment. The first variable capacitor 1144 may include a network of capacitive components that may be selectively coupled together to provide capacitances in a range of 0 pF to about 100 pF. Accordingly, the total capacitance value provided by the first variable capacitance network 1142 may be in a range of about 1 pF to about 200 pF, although the range may extend to lower or higher capacitance values, as well.

A "shunt matching portion" of the variable impedance matching network 1100 is provided by the second variable capacitance network 1146, which is coupled between node 1151 (located between the first variable capacitance network 1142 and lumped inductor 1154) and the ground reference terminal. According to an embodiment, the second variable capacitance network 1146 includes a second fixed-value capacitor 1147 coupled in parallel with a second variable capacitor 1148. The second fixed-value capacitor 1147 may have a capacitance value in a range of about 1 pF to about 100 pF, in an embodiment. The second variable capacitor 1148 may include a network of capacitive components that may be selectively coupled together to provide capacitances in a range of 0 pF to about 100 pF. Accordingly, the total capacitance value provided by the second variable capacitance network 1146 may be in a range of about 1 pF to about 200 pF, although the range may extend to lower or higher capacitance values, as well. The states of the first and second variable capacitance networks 1142, 1146 may be changed to provide multiple capacitance values, and thus may be configurable to optimally match the impedance of the cavity plus load (e.g., cavity 960 plus load 964, FIG. 9) to the RF signal source (e.g., RF signal source 920, FIG. 9).

Referring again to FIG. 9, some embodiments of heating system 900 may include temperature sensor(s), IR sensor(s), and/or weight sensor(s) 994. The temperature sensor(s) and/or IR sensor(s) may be positioned in locations that enable the temperature of the load 964 to be sensed during the heating operation. When provided to the host/thermal system controller 952 and/or the RF heating system controller 912, for example, the temperature information enables the host/thermal system controller 952 and/or the RF heating system controller 912 to alter the power of the thermal energy produced by the thermal heating components 954 and/or the RF signal supplied by the RF signal source 920 (e.g., by controlling the bias and/or supply voltages provided by the power supply and bias circuitry 926), and/or to determine when the heating operation should be terminated. In addition, the RF heating system controller 912 may use the temperature information to adjust the state of the variable impedance matching network 970. The weight sensor(s) are positioned under the load 964, and are configured to provide an estimate of the weight of the load 964 to the host/thermal system controller 952 and/or the RF heating system controller 912. The host/thermal system controller 952 and/or RF heating system controller 912 may use this information, for example, to determine an approximate duration for the heating operation. Further, the RF heating system controller 912 may use this information to determine a desired power level for the RF signal supplied by the RF signal source 920, and/or to determine an initial setting for the variable impedance matching network 970.

The description associated with FIGS. 9-11 discuss, in detail, an "unbalanced" heating apparatus, in which an RF signal is applied to one electrode (e.g., electrode 940, FIG. 9), and the other electrode (e.g., electrode 942 or the containment structure 966, FIG. 9) is grounded. As mentioned above, an alternate embodiment of a heating apparatus comprises a "balanced" heating apparatus. In such an apparatus, balanced RF signals are provided to both electrodes.

For example, FIG. 12 is a simplified block diagram of a balanced heating system 1200 (e.g., heating system 100, 600, 800, FIGS. 1, 6, 8), in accordance with an example embodiment. Heating system 1200 includes host/thermal system controller 1252, RF heating system 1210, thermal heating system 1250, user interface 1292, and a containment structure 1266 that defines an oven cavity 1260, in an embodiment. It should be understood that FIG. 12 is a simplified representation of a heating system 1200 for purposes of explanation and ease of description, and that practical embodiments may include other devices and components to provide additional functions and features, and/or the heating system 1200 may be part of a larger electrical system.

The containment structure 1266 may include bottom, top, and side walls, the interior surfaces of which define the cavity 1260 (e.g., cavity 110, 610, 810, FIGS. 1, 6, 8). According to an embodiment, the cavity 1260 may be sealed (e.g., with a door 116, 616, 816, FIGS. 1, 6, 8) to contain the heat and electromagnetic energy that is introduced into the cavity 1260 during a heating operation. The system 1200 may include one or more interlock mechanisms (e.g., latching mechanisms and securing structures 118, 119, 618, 619, 818, 819, FIGS. 1, 6, 8) that ensure that the seal is intact during a heating operation. If one or more of the interlock mechanisms indicates that the seal is breached, the host/thermal system controller 1252 may cease the heating operation.

User interface 1292 may correspond to a control panel (e.g., control panel 120, 620, 820, FIGS. 1, 6, 8), for example, which enables a user to provide inputs to the system regarding parameters for a heating operation (e.g., the cooking mode, characteristics of the load to be heated, and so on), start and cancel buttons, mechanical controls (e.g., a door/drawer open latch), and so on. In addition, the user interface may be configured to provide user-perceptible outputs indicating the status of a heating operation (e.g., a countdown timer, visible indicia indicating progress or completion of the heating operation, and/or audible tones indicating completion of the heating operation) and other information.

As will be described in more detail in conjunction with FIGS. 16 and 18, the host/thermal system controller 1252 may perform functions associated with the overall system 1200 (e.g., "host control functions"), and functions associated more particularly with the thermal heating system 1250 (e.g., "thermal system control functions"). Because, in an embodiment, the host control functions and the thermal system control functions may be performed by one hardware controller, the host/thermal system controller 1252 is shown as a dual-function controller. In alternate embodiments, the host controller and the thermal system controller may be distinct controllers that are communicatively coupled.

The thermal heating system 1250 includes host/thermal system controller 1252, one or more thermal heating components 1254, thermostat 1256, and in some embodiments, a fan 1258. Host/thermal system controller 1252 may include one or more general purpose or special purpose processors (e.g., a microprocessor, microcontroller, ASIC, and so on), volatile and/or non-volatile memory (e.g., RAM, ROM, flash, various registers, and so on), one or more communication busses, and other components. According to an embodiment, host/thermal system controller 1252 is coupled to user interface 1292, RF heating system controller 1212, thermal heating components 1254, thermostat 1256, fan 1258, and sensors 1294 (if included). In some embodiments, host/thermal system controller 1252 and portions of user interface 1292 may be included together in a host module 1290.

Host/thermal system controller 1252 is configured to receive signals indicating user inputs received via user interface 1292, and to provide signals to the user interface 1292 that enable the user interface 1292 to produce user-perceptible outputs (e.g., via a display, speaker, and so on) indicating various aspects of the system operation. In addition, host/thermal system controller 1252 sends control signals to other components of the thermal heating system 1250 (e.g., to thermal heating components 1254 and fan 1258) to selectively activate, deactivate, and otherwise control those other components in accordance with desired system operation. The host/thermal system controller 1252 also may receive signals from the thermal heating system components 1254, thermostat 1256, and sensors 1294 (if included), indicating operational parameters of those components, and the host/thermal system controller 1252 may modify operation of the system 1200 accordingly, as will be described later. Further still, host/thermal system controller 1252 receives signals from the RF heating system controller 1212 regarding operation of the RF heating system 1210. Responsive to the received signals and measurements from the user interface 1292 and from the RF heating system controller 1212, host/thermal system controller 1252 may provide additional control signals to the RF heating system controller 1212, which affects operation of the RF heating system 1210.

The one or more thermal heating components 1254 may include, for example, one or more heating elements (e.g., heating elements 682, 684, FIG. 6, and/or heating element(s) within a convection system 160, 660, 860, FIGS. 1, 6, 8), one or more gas burners (e.g., gas burners 882, 884, FIG. 8), and/or other components that are configured to heat air within the oven cavity 1260. The thermostat 1256 (or an oven sensor) is configured to sense the air temperature within the oven cavity 1260, and to control operation of the one or more thermal heating components 1254 to maintain the air temperature within the oven cavity at or near a temperature setpoint (e.g., a temperature setpoint established by the user through the user interface 1292). This temperature control process may be performed by the thermostat 1256 in a closed loop system with the thermal heating components 1254, or the thermostat 1256 may communicate with the host/thermal system controller 1252, which also participates in controlling operation of the one or more thermal heating components 1254. Finally, fan 1258 is included when the system 1200 includes a convection system (e.g., convection system 160, 660, 860, FIGS. 1, 6, 8), and the fan 1258 is selectively activated and deactivated to circulate the air within the oven cavity 1260.

The RF subsystem 1210 includes an RF heating system controller 1212, an RF signal source 1220, a first impedance matching circuit 1234 (herein "first matching circuit"), power supply and bias circuitry 1226, and power detection circuitry 1230, in an embodiment. RF heating system controller 1212 may include one or more general purpose or special purpose processors (e.g., a microprocessor, microcontroller, ASIC, and so on), volatile and/or non-volatile memory (e.g., RAM, ROM, flash, various registers, and so on), one or more communication busses, and other components. According to an embodiment, RF heating system controller 1212 is coupled to host/thermal system controller 1252, RF signal source 1220, variable impedance matching network 1270, power detection circuitry 1230, and sensors 1294 (if included). RF heating system controller 1212 is configured to receive control signals from the host/thermal system controller 1252 indicating various operational parameters, and to receive signals indicating RF signal reflected power (and possibly RF signal forward power) from power detection circuitry 1230. Responsive to the received signals and measurements, and as will be described in more detail later, RF heating system controller 1212 provides control signals to the power supply and bias circuitry 1226 and to the RF signal generator 1222 of the RF signal source 1220. In addition, RF heating system controller 1212 provides control signals to the variable impedance matching network 1270, which cause the network 1270 to change its state or configuration.

Oven cavity 1260 includes a capacitive heating arrangement with first and second parallel plate electrodes 1240, 1242 that are separated by an air cavity 1260 within which a load 1264 to be heated may be placed. For example, a first electrode 1240 may be positioned above the air cavity 1260, and a second electrode 1242 may be positioned below the air cavity 1260. In some embodiments, the second electrode 1242 may be implemented in the form of a shelf or contained within a shelf (e.g., shelf 134, 200, 300, 634, 834, FIGS. 1-3, 6, 8) that is inserted in the cavity 1260 as previously described. To avoid direct contact between the load 1264 and the second electrode 1242 (or the grounded bottom surface of the cavity 1260), a non-conductive barrier 1262 may be positioned over the second electrode 1242.

Again, oven cavity 1260 includes a capacitive heating arrangement with first and second parallel plate electrodes 1240, 1242 that are separated by an air cavity 1260 within which a load 1264 to be heated may be placed. The first and second electrodes 1240, 1242 are positioned within containment structure 1266 to define a distance 1246 between the electrodes 1240, 1242, where the distance 1246 renders the cavity 1260 a sub-resonant cavity, in an embodiment.

In various embodiments, the distance 1246 is in a range of about 0.10 meters to about 1.0 meter, although the distance may be smaller or larger, as well. According to an embodiment, distance 1246 is less than one wavelength of the RF signal produced by the RF subsystem 1210. In other words, as mentioned above, the cavity 1260 is a sub-resonant cavity. In some embodiments, the distance 1246 is less than about half of one wavelength of the RF signal. In other embodiments, the distance 1246 is less than about one quarter of one wavelength of the RF signal. In still other embodiments, the distance 1246 is less than about one eighth of one wavelength of the RF signal. In still other embodiments, the distance 1246 is less than about one 50th of one wavelength of the RF signal. In still other embodiments, the distance 1246 is less than about one 100th of one wavelength of the RF signal.

In general, an RF heating system 1210 designed for lower operational frequencies (e.g., frequencies between 10 MHz and 100 MHz) may be designed to have a distance 1246 that is a smaller fraction of one wavelength. For example, when system 1210 is designed to produce an RF signal with an operational frequency of about 10 MHz (corresponding to a wavelength of about 30 meters), and distance 1246 is selected to be about 0.5 meters, the distance 1246 is about one 60th of one wavelength of the RF signal. Conversely, when system 1210 is designed for an operational frequency of about 300 MHz (corresponding to a wavelength of about 1 meter), and distance 1246 is selected to be about 0.5 meters, the distance 1246 is about one half of one wavelength of the RF signal.

With the operational frequency and the distance 1246 between electrodes 1240, 1242 being selected to define a sub-resonant interior cavity 1260, the first and second electrodes 1240, 1242 are capacitively coupled. More specifically, the first electrode 1240 may be analogized to a first plate of a capacitor, the second electrode 1242 may be analogized to a second plate of a capacitor, and the load 1264, barrier 1262 (if included), and air within the cavity 1260 may be analogized to a capacitor dielectric. Accordingly, the first electrode 1240 alternatively may be referred to herein as an "anode," and the second electrode 1242 may alternatively be referred to herein as a "cathode."

Essentially, the voltage across the first electrode 1240 and the second electrode 1242 contributes to heating the load 1264 within the cavity 1260. According to various embodiments, the RF heating system 1210 is configured to generate the RF signal to produce voltages between the electrodes 1240, 1242 in a range of about 90 volts to about 3000 volts, in one embodiment, or in a range of about 3000 volts to about 10,000 volts, in another embodiment, although the system 1210 may be configured to produce lower or higher voltages between the electrodes 1240, 1242, as well.

An output of the RF subsystem 1210, and more particularly an output of RF signal source 1220, is electrically coupled to the variable matching subsystem 1270 through a conductive transmission path, which includes a plurality of conductors 1228-1, 1228-2, 1228-3, 1228-4, and 1228-5 connected in series, and referred to collectively as transmission path 1228. According to an embodiment, the conductive transmission path 1228 includes an "unbalanced" portion and a "balanced" portion, where the "unbalanced" portion is configured to carry an unbalanced RF signal (i.e., a single RF signal referenced against ground), and the "balanced" portion is configured to carry a balanced RF signal (i.e., two signals referenced against each other). The "unbalanced" portion of the transmission path 1228 may include unbalanced first and second conductors 1228-1, 1228-2 within the RF subsystem 1210, one or more connectors 1236, 1238 (each having male and female connector portions), and an unbalanced third conductor 1228-3 electrically coupled between connectors 1236, 1238. According to an embodiment, the third conductor 1228-3 comprises a coaxial cable, although the electrical length may be shorter or longer, as well. In an alternate embodiment, the variable matching subsystem 1270 may be housed with the RF subsystem 1210, and in such an embodiment, the conductive transmission path 1228 may exclude the connectors 1236, 1238 and the third conductor 1228-3. Either way, the "balanced" portion of the conductive transmission path 1228 includes a balanced fourth conductor 1228-4 within the variable matching subsystem 1270, and a balanced fifth conductor 1228-5 electrically coupled between the variable matching subsystem 1270 and electrodes 1240, 1250, in an embodiment.

As indicated in FIG. 12, the variable matching subsystem 1270 houses an apparatus configured to receive, at an input of the apparatus, the unbalanced RF signal from the RF signal source 1220 over the unbalanced portion of the transmission path (i.e., the portion that includes unbalanced conductors 1228-1, 1228-2, and 1228-3), to convert the unbalanced RF signal into two balanced RF signals (e.g., two RF signals having a phase difference between 120 and 340 degrees, such as about 180 degrees), and to produce the two balanced RF signals at two outputs of the apparatus. For example, the conversion apparatus may be a balun 1274, in an embodiment. The balanced RF signals are conveyed over balanced conductors 1228-4 to the variable matching circuit 1272 and, ultimately, over balanced conductors 1228-5 to the electrodes 1240, 1250.

In an alternate embodiment, as indicated in a dashed box in the center of FIG. 12, and as will be discussed in more detail below, an alternate RF signal generator 1220' may produce balanced RF signals on balanced conductors 1228-1', which may be directly coupled to the variable matching circuit 1272 (or coupled through various intermediate conductors and connectors). In such an embodiment, the balun 1274 may be excluded from the system 1200. Either way, as will be described in more detail below, a double-ended variable matching circuit 1272 (e.g., variable matching circuit 1300, 1400, FIGS. 13, 14) is configured to receive the balanced RF signals (e.g., over connections 1228-4 or 1228-1'), to perform an impedance transformation corresponding to a then-current configuration of the double-ended variable matching circuit 1272, and to provide the balanced RF signals to the first and second electrodes 1240, 1250 over connections 1228-5.

According to an embodiment, RF signal source 1220 includes an RF signal generator 1222 and a power amplifier 1224 (e.g., including one or more power amplifier stages). In response to control signals provided by RF heating system controller 1212 over connection 1214, RF signal generator 1222 is configured to produce an oscillating electrical signal having a frequency in an ISM (industrial, scientific, and medical) band, although the system could be modified to support operations in other frequency bands, as well. The RF signal generator 1222 may be controlled to produce oscillating signals of different power levels and/or different frequencies, in various embodiments. For example, the RF signal generator 1222 may produce a signal that oscillates in the VHF range (i.e., in a range between about 30.0 MHz and about 300 MHz), and/or in a range of about 10.0 MHz to about 100 MHz and/or in a range of about 100 MHz to about 3.0 GHz. Some desirable frequencies may be, for example, 13.56 MHz (+/−12 percent), 27.125 MHz (+/−12 percent), 40.68 MHz (+/−12 percent), and 2.45 GHz (+/−12 percent). Alternatively, the frequency of oscillation may be lower or higher than the above-given ranges or values.

The power amplifier 1224 is configured to receive the oscillating signal from the RF signal generator 1222, and to amplify the signal to produce a significantly higher-power signal at an output of the power amplifier 1224. For example, the output signal may have a power level in a range of about 100 watts to about 400 watts or more, although the power level may be lower or higher, as well. The gain applied by the power amplifier 1224 may be controlled using gate bias voltages and/or drain bias voltages provided by the power supply and bias circuitry 1226 to one or more stages of amplifier 1224. More specifically, power supply and bias circuitry 1226 provides bias and supply voltages to the inputs and/or outputs (e.g., gates and/or drains) of each RF amplifier stage in accordance with control signals received from RF heating system controller 1212.

The power amplifier may include one or more amplification stages. In an embodiment, each stage of amplifier 1224 is implemented as a power transistor, such as a FET, having an input terminal (e.g., a gate or control terminal) and two current carrying terminals (e.g., source and drain terminals). Impedance matching circuits (not illustrated) may be coupled to the input (e.g., gate) and/or output (e.g., drain terminal) of some or all of the amplifier stages, in various embodiments. In an embodiment, each transistor of the amplifier stages includes an LDMOS FET. However, it should be noted that the transistors are not intended to be limited to any particular semiconductor technology, and in other embodiments, each transistor may be realized as a GaN transistor, another type of MOS FET transistor, a BJT, or a transistor utilizing another semiconductor technology.

In FIG. 12, the power amplifier arrangement 1224 is depicted to include one amplifier stage coupled in a particular manner to other circuit components. In other embodiments, the power amplifier arrangement 1224 may include other amplifier topologies and/or the amplifier arrangement may include two or more amplifier stages (e.g., as shown in the embodiment of amplifier 924/925, FIG. 9). For example, the power amplifier arrangement may include various embodiments of a single-ended amplifier, a double-ended (balanced) amplifier, a push-pull amplifier, a Doherty amplifier, an SMPA, or another type of amplifier.

For example, as indicated in the dashed box in the center of FIG. 12, an alternate RF signal generator 1220' may include a push-pull or balanced amplifier 1224', which is configured to receive, at an input, an unbalanced RF signal from the RF signal generator 1222, to amplify the unbalanced RF signal, and to produce two balanced RF signals at two outputs of the amplifier 1224', where the two balanced RF signals are thereafter conveyed over conductors 1228-1' to the electrodes 1240, 1250. In such an embodiment, the balun 1274 may be excluded from the system 1200, and the conductors 1228-1' may be directly connected to the variable matching circuit 1272 (or connected through multiple coaxial cables and connectors or other multi-conductor structures).

Heating cavity 1260 and any load 1264 (e.g., food, liquids, and so on) positioned in the heating cavity 1260 present a cumulative load for the electromagnetic energy (or RF power) that is radiated into the interior chamber 1262 by the electrodes 1240, 1250. More specifically, and as described previously, the heating cavity 1260 and the load 1264 present an impedance to the system, referred to herein as a "cavity plus load impedance." The cavity plus load impedance changes during a heating operation as the temperature of the load 1264 increases. The cavity plus load impedance has a direct effect on the magnitude of reflected signal power along the conductive transmission path 1228 between the RF signal source 1220 and the electrodes 1240, 1250. In most cases, it is desirable to maximize the magnitude of transferred signal power into the cavity 1260, and/or to minimize the reflected-to-forward signal power ratio along the conductive transmission path 1228.

In order to at least partially match the output impedance of the RF signal generator 1220 to the cavity plus load impedance, a first matching circuit 1234 is electrically coupled along the transmission path 1228, in an embodiment. The first matching circuit 1234 is configured to perform an impedance transformation from an impedance of the RF signal source 1220 (e.g., less than about 10 ohms) to an intermediate impedance (e.g., 120 ohms, 75 ohms, or some other value). The first matching circuit 1234 may have any of a variety of configurations. According to an embodiment, the first matching circuit 1234 includes fixed components (i.e., components with non-variable component values), although the first matching circuit 1234 may include one or more variable components, in other embodiments. For example, the first matching circuit 1234 may include any one or more circuits selected from an inductance/capacitance (LC) network, a series inductance network, a shunt inductance network, or a combination of bandpass, high-pass and low-pass circuits, in various embodiments. Essentially, the first matching circuit 1234 is configured to raise the impedance to an intermediate level between the output impedance of the RF signal generator 1220 and the cavity plus load impedance.

According to an embodiment, and as mentioned above, power detection circuitry 1230 is coupled along the transmission path 1228 between the output of the RF signal source 1220 and the electrodes 1240, 1250. In a specific embodiment, the power detection circuitry 1230 forms a portion of the RF subsystem 1210, and is coupled to the conductor 1228-2 between the RF signal source 1220 and connector 1236. In alternate embodiments, the power detection circuitry 1230 may be coupled to any other portion of the transmission path 1228, such as to conductor 1228-1, to conductor 1228-3, to conductor 1228-4 between the RF signal source 1220 (or balun 1274) and the variable matching circuit 1272 (i.e., as indicated with power detection circuitry 1230'), or to conductor 1228-5 between the variable matching circuit 1272 and the electrode(s) 1240, 1250 (i.e., as indicated with power detection circuitry 1230"). For purposes of brevity, the power detection circuitry is referred to herein with reference number 1230, although the circuitry may be positioned in other locations, as indicated by reference numbers 1230' and 1230".

Wherever it is coupled, power detection circuitry 1230 is configured to monitor, measure, or otherwise detect the power of the reflected signals traveling along the transmission path 1228 between the RF signal source 1220 and one or both of the electrode(s) 1240, 1250 (i.e., reflected RF signals traveling in a direction from electrode(s) 1240, 1250 toward RF signal source 1220). In some embodiments, power detection circuitry 1230 also is configured to detect the power of the forward signals traveling along the transmission path 1228 between the RF signal source 1220 and the electrode(s) 1240, 1250 (i.e., forward RF signals traveling in a direction from RF signal source 1220 toward electrode(s) 1240, 1250).

Over connection 1232, power detection circuitry 1230 supplies signals to RF heating system controller 1212 conveying the measured magnitudes of the reflected signal power, and in some embodiments, also the measured magnitude of the forward signal power. In embodiments in which both the forward and reflected signal power magnitudes are conveyed, RF heating system controller 1212 may calculate a reflected-to-forward signal power ratio, or the S11 parameter, and/or a VSWR value. As will be described in more detail below, when the reflected signal power magnitude exceeds a reflected signal power threshold, or when the reflected-to-forward signal power ratio exceeds an S11 parameter threshold, or when the VSWR value exceeds a VSWR threshold, this indicates that the system 1200 is not adequately matched to the cavity plus load impedance, and that energy absorption by the load 1264 within the cavity 1260 may be sub-optimal. In such a situation, RF heating system controller 1212 orchestrates a process of altering the state of the variable matching circuit 1272 to drive the reflected signal power or the S11 parameter or the VSWR value toward or below a desired level (e.g., below the reflected signal power threshold, and/or the reflected-to-forward signal power ratio threshold, and/or the VSWR threshold), thus re-establishing an acceptable match and facilitating more optimal energy absorption by the load 1264.

More specifically, the system controller 1212 may provide control signals over control path 1216 to the variable matching circuit 1272, which cause the variable matching circuit 1272 to vary inductive, capacitive, and/or resistive values of one or more components within the circuit, thus adjusting the impedance transformation provided by the circuit 1272. Adjustment of the configuration of the variable matching circuit 1272 desirably decreases the magnitude of reflected signal power, which corresponds to decreasing the magnitude of the S11 parameter and/or the VSWR value, and increasing the power absorbed by the load 1264.

As discussed above, the variable matching circuit 1272 is used to match the input impedance of the heating cavity 1260 plus load 1264 to maximize, to the extent possible, the RF power transfer into the load 1264. The initial impedance of the heating cavity 1260 and the load 1264 may not be known with accuracy at the beginning of a heating operation. Further, the impedance of the load 1264 changes during a heating operation as the load 1264 warms up. According to an embodiment, the system controller 1212 may provide control signals to the variable matching circuit 1272, which cause modifications to the state of the variable matching circuit 1272. This enables the system controller 1212 to establish an initial state of the variable matching circuit 1272 at the beginning of the heating operation that has a relatively low reflected to forward power ratio, and thus a relatively high absorption of the RF power by the load 1264. In addition, this enables the system controller 1212 to modify the state of the variable matching circuit 1272 so that an adequate match may be maintained throughout the heating operation, despite changes in the impedance of the load 1264.

The variable matching circuit 1272 may have any of a variety of configurations. For example, the circuit 1272 may include any one or more circuits selected from an inductance/capacitance (LC) network, an inductance-only network, a capacitance-only network, or a combination of bandpass, high-pass and low-pass circuits, in various embodiments. In an embodiment in which the variable matching circuit 1272 is implemented in a balanced portion of the transmission path 1228, the variable matching circuit 1272 is a double-ended circuit with two inputs and two outputs. In an alternate embodiment in which the variable matching circuit is implemented in an unbalanced portion of the transmission path 1228, the variable matching circuit may be a single-ended circuit with a single input and a single output (e.g., similar to matching circuit 1000 or 1100, FIGS. 10, 11). According to a more specific embodiment, the variable matching circuit 1272 includes a variable inductance network (e.g., double-ended network 1300, FIG. 13). According to another more specific embodiment, the variable matching circuit 1272 includes a variable capacitance network (e.g., double-ended network 1400, FIG. 14). In still other embodiments, the variable matching circuit 1272 may include both variable inductance and variable capacitance elements. The inductance, capacitance, and/or resistance values provided by the variable matching circuit 1272, which in turn affect the impedance transformation provided by the circuit 1272, are established through control signals from the RF heating system controller 1212, as will be described in more detail later. In any event, by changing the state of the variable matching circuit 1272 over the course of a heating operation to dynamically match the ever-changing impedance of the cavity 1260 plus the load 1264 within the cavity 1260, the system efficiency may be maintained at a high level throughout the heating operation.

Figure 13:
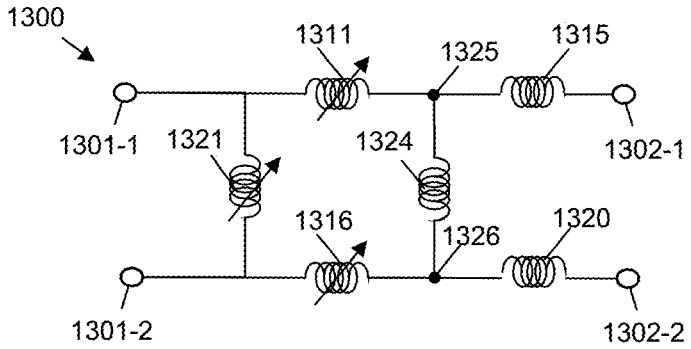
FIG. 13 is a schematic diagram of a double-ended variable inductance matching network, in accordance with an example embodiment.
Figure 14:
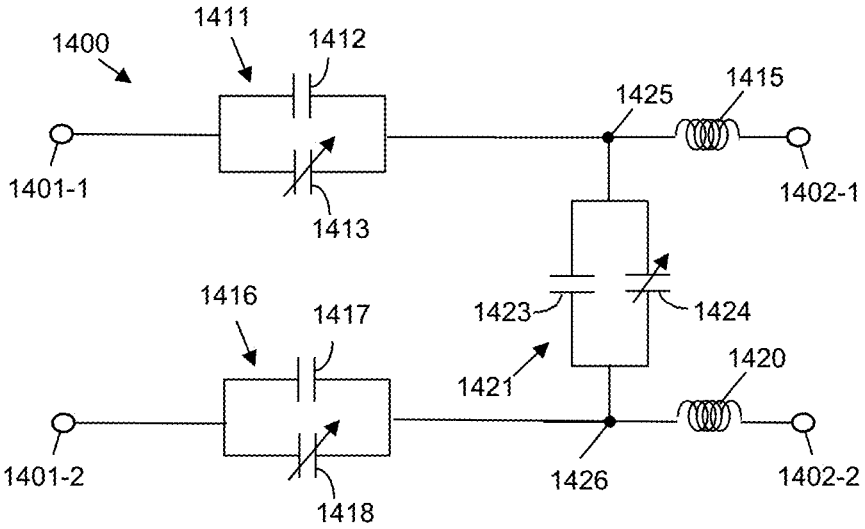
FIG. 14 is a schematic diagram of a double-ended variable capacitance matching network, in accordance with an example embodiment.

The variable matching circuit 1272 may have any of a wide variety of circuit configurations, and non-limiting examples of such configurations are shown in FIGS. 13 and 14. For example, FIG. 13 is a schematic diagram of a double-ended variable impedance matching circuit 1300 (e.g., matching circuit 1272, FIG. 12) that may be incorporated into a heating system (e.g., system 100, 600, 800, 1200, FIGS. 1, 6, 8, 12), in accordance with an example embodiment. According to an embodiment, the variable matching circuit 1300 includes a network of fixed-value and variable passive components.

Circuit 1300 includes a double-ended input 1301-1, 1301-2 (referred to as input 1301), a double-ended output 1302-1, 1302-2 (referred to as output 1302), and a network of passive components connected in a ladder arrangement between the input 1301 and output 1302. For example, when connected into system 1200, the first input 1301-1 may be connected to a first conductor of balanced conductor 1228-4, and the second input 1301-2 may be connected to a second conductor of balanced conductor 1228-4. Similarly, the first output 1302-1 may be connected to a first conductor of balanced conductor 1228-5, and the second output 1302-2 may be connected to a second conductor of balanced conductor 1228-5.

In the specific embodiment illustrated in FIG. 13, circuit 1300 includes a first variable inductor 1311 and a first fixed inductor 1315 connected in series between input 1301-1 and output 1302-1, a second variable inductor 1316 and a second fixed inductor 1320 connected in series between input 1301-2 and output 1302-2, a third variable inductor 1321 connected between inputs 1301-1 and 1301-2, and a third fixed inductor 1324 connected between nodes 1325 and 1326.

According to an embodiment, the third variable inductor 1321 corresponds to an "RF signal source matching portion", which is configurable to match the impedance of the RF signal source (e.g., RF signal source 1220, FIG. 12) as modified by the first matching circuit (e.g., circuit 1234, FIG. 12), or more particularly to match the impedance of the final stage power amplifier (e.g., amplifier 1224, FIG. 12) as modified by the first matching circuit (e.g., circuit 1234, FIG. 12). According to an embodiment, the third variable inductor 1321 includes a network of inductive components that may be selectively coupled together to provide inductances in a range of about 5 nH to about 200 nH, although the range may extend to lower or higher inductance values, as well.

In contrast, the "cavity matching portion" of the variable impedance matching network 1300 is provided by the first and second variable inductors 1311, 1316, and fixed inductors 1315, 1320, and 1324. Because the states of the first and second variable inductors 1311, 1316 may be changed to provide multiple inductance values, the first and second variable inductors 1311, 1316 are configurable to optimally match the impedance of the cavity plus load (e.g., cavity 1260 plus load 1264, FIG. 12). For example, inductors 1311, 1316 each may have a value in a range of about 10 nH to about 200 nH, although their values may be lower and/or higher, in other embodiments.

The fixed inductors 1315, 1320, 1324 also may have inductance values in a range of about 50 nH to about 800 nH, although the inductance values may be lower or higher, as well. Inductors 1311, 1315, 1316, 1320, 1321, 1324 may include discrete inductors, distributed inductors (e.g., printed coils), wirebonds, transmission lines, and/or other inductive components, in various embodiments. In an embodiment, variable inductors 1311 and 1316 are operated in a paired manner, meaning that their inductance values during operation are controlled to be equal to each other, at any given time, in order to ensure that the RF signals conveyed to outputs 1302-1 and 1302-2 are balanced.

As discussed above, variable matching circuit 1300 is a double-ended circuit that is configured to be connected along a balanced portion of the transmission path 1228 (e.g., between connectors 1228-4 and 1228-5), and other embodiments may include a single-ended (i.e., one input and one output) variable matching circuit that is configured to be connected along the unbalanced portion of the transmission path 1228.

By varying the inductance values of inductors 1311, 1316, 1321 in circuit 1300, the system controller 1212 may increase or decrease the impedance transformation provided by circuit 1300. Desirably, the inductance value changes improve the overall impedance match between the RF signal source 1220 and the cavity plus load impedance, which should result in a reduction of the reflected signal power and/or the reflected-to-forward signal power ratio. In most cases, the system controller 1212 may strive to configure the circuit 1300 in a state in which a maximum electromagnetic field intensity is achieved in the cavity 1260, and/or a maximum quantity of power is absorbed by the load 1264, and/or a minimum quantity of power is reflected by the load 1264.

FIG. 14 is a schematic diagram of a double-ended variable impedance matching circuit 1400 (e.g., matching circuit 1272, FIG. 12) that may be incorporated into a heating system (e.g., system 100, 600, 800, 1200, FIGS. 1, 6, 8, 12), and which may be implemented instead of the variable-inductance impedance matching network 1300 (FIG. 13), in accordance with another example embodiment. As with the matching circuit 600 (FIG. 6), according to an embodiment, the variable matching circuit 1400 includes a network of fixed-value and variable passive components.

Circuit 1400 includes a double-ended input 1401-1, 1401-2 (referred to as input 1401), a double-ended output 1402-1, 1402-2 (referred to as output 1402), and a network of passive components connected between the input 1401 and output 1402. For example, when connected into system 1200, the first input 1401-1 may be connected to a first conductor of balanced conductor 1228-4, and the second input 1401-2 may be connected to a second conductor of balanced conductor 1228-4. Similarly, the first output 1402-1 may be connected to a first conductor of balanced conductor 1228-5, and the second output 1402-2 may be connected to a second conductor of balanced conductor 1228-5.

In the specific embodiment illustrated in FIG. 14, circuit 1400 includes a first variable capacitance network 1411 and a first inductor 1415 connected in series between input 1401-1 and output 1402-1, a second variable capacitance network 1416 and a second inductor 1420 connected in series between input 1401-2 and output 1402-2, and a third variable capacitance network 1421 connected between nodes 1425 and 1426. The inductors 1415, 1420 are relatively large in both size and inductance value, in an embodiment, as they may be designed for relatively low frequency (e.g., about 40.66 MHz to about 40.70 MHz) and high power (e.g., about 120 W to about 1200 W) operation. For example, inductors 1415, 1420 each may have a value in a range of about 100 nH to about 1000 nH (e.g., in a range of about 200 nH to about 600 nH), although their values may be lower and/or higher, in other embodiments. According to an embodiment, inductors 1415, 1420 are fixed-value, lumped inductors (e.g., coils, discrete inductors, distributed inductors (e.g., printed coils), wirebonds, transmission lines, and/or other inductive components, in various embodiments). In other embodiments, the inductance value of inductors 1415, 1420 may be variable. In any event, the inductance values of inductors 1415, 1420 are substantially the same either permanently (when inductors 1415, 1420 are fixed-value) or at any given time (when inductors 1415, 1420 are variable, they are operated in a paired manner), in an embodiment.

The first and second variable capacitance networks 1411, 1416 correspond to "series matching portions" of the circuit 1400. According to an embodiment, the first variable capacitance network 1411 includes a first fixed-value capacitor 1412 coupled in parallel with a first variable capacitor 1413. The first fixed-value capacitor 1412 may have a capacitance value in a range of about 1 pF to about 100 pF, in an embodiment. The first variable capacitor 1413 may include a network of capacitive components that may be selectively coupled together to provide capacitances in a range of 0 pF to about 100 pF. Accordingly, the total capacitance value provided by the first variable capacitance network 1411 may be in a range of about 1 pF to about 200 pF, although the range may extend to lower or higher capacitance values, as well.

Similarly, the second variable capacitance network 1416 includes a second fixed-value capacitor 1417 coupled in parallel with a second variable capacitor 1418. The second fixed-value capacitor 1417 may have a capacitance value in a range of about 1 pF to about 100 pF, in an embodiment. The second variable capacitor 1418 may include a network of capacitive components that may be selectively coupled together to provide capacitances in a range of 0 pF to about 100 pF. Accordingly, the total capacitance value provided by the second variable capacitance network 1416 may be in a range of about 1 pF to about 200 pF, although the range may extend to lower or higher capacitance values, as well.

In any event, to ensure the balance of the signals provided to outputs 1402-1 and 1402-2, the capacitance values of the first and second variable capacitance networks 1411, 1416 are controlled to be substantially the same at any given time, in an embodiment. For example, the capacitance values of the first and second variable capacitors 1413, 1418 may be controlled so that the capacitance values of the first and second variable capacitance networks 1411, 1416 are substantially the same at any given time. The first and second variable capacitors 1413, 1418 are operated in a paired manner, meaning that their capacitance values during operation are controlled, at any given time, to ensure that the RF signals conveyed to outputs 1402-1 and 1402-2 are balanced. The capacitance values of the first and second fixed-value capacitors 1412, 1417 may be substantially the same, in some embodiments, although they may be different, in others.

The "shunt matching portion" of the variable impedance matching network 1400 is provided by the third variable capacitance network 1421 and fixed inductors 1415, 1420.

According to an embodiment, the third variable capacitance network 1421 includes a third fixed-value capacitor 1423 coupled in parallel with a third variable capacitor 1424. The third fixed-value capacitor 1423 may have a capacitance value in a range of about 1 pF to about 500 pF, in an embodiment. The third variable capacitor 1424 may include a network of capacitive components that may be selectively coupled together to provide capacitances in a range of 0 pF to about 200 pF. Accordingly, the total capacitance value provided by the third variable capacitance network 1421 may be in a range of about 1 pF to about 700 pF, although the range may extend to lower or higher capacitance values, as well.

Because the states of the variable capacitance networks 1411, 1416, 1421 may be changed to provide multiple capacitance values, the variable capacitance networks 1411, 1416, 1421 are configurable to optimally match the impedance of the cavity plus load (e.g., cavity 1260 plus load 1264, FIG. 12) to the RF signal source (e.g., RF signal source 1220, 1220', FIG. 12). By varying the capacitance values of capacitors 1413, 1418, 1424 in circuit 1400, the RF heating system controller (e.g., RF heating system controller 1212, FIG. 12) may increase or decrease the impedance transformation provided by circuit 1400. Desirably, the capacitance value changes improve the overall impedance match between the RF signal source 1220 and the impedance of the cavity plus load, which should result in a reduction of the reflected signal power and/or the reflected-to-forward signal power ratio. In most cases, the RF heating system controller 1212 may strive to configure the circuit 1400 in a state in which a maximum electromagnetic field intensity is achieved in the cavity 1260, and/or a maximum quantity of power is absorbed by the load 1264, and/or a minimum quantity of power is reflected by the load 1264.

It should be understood that the variable impedance matching circuits 1300, 1400 illustrated in FIGS. 13 and 14 are but two possible circuit configurations that may perform the desired double-ended variable impedance transformations. Other embodiments of double-ended variable impedance matching circuits may include differently arranged inductive or capacitive networks, or may include passive networks that include various combinations of inductors, capacitors, and/or resistors, where some of the passive components may be fixed-value components, and some of the passive components may be variable-value components (e.g., variable inductors, variable capacitors, and/or variable resistors). Further, the double-ended variable impedance matching circuits may include active devices (e.g., transistors) that switch passive components into and out of the network to alter the overall impedance transformation provided by the circuit.

Referring again to FIG. 12, some embodiments of heating system 1200 may include temperature sensor(s), IR sensor(s), and/or weight sensor(s) 1294. The temperature sensor(s) and/or IR sensor(s) may be positioned in locations that enable the temperature of the load 1264 to be sensed during the heating operation. When provided to the host/thermal system controller 1252 and/or the RF heating system controller 1212, for example, the temperature information enables the host/thermal system controller 1252 and/or the RF heating system controller 1212 to alter the power of the thermal energy produced by the thermal heating components 1254 and/or the RF signal supplied by the RF signal source 1220 (e.g., by controlling the bias and/or supply voltages provided by the power supply and bias circuitry 1226), and/or to determine when the heating operation should be terminated. In addition, the RF heating system controller 1212 may use the temperature information to adjust the state of the variable impedance matching network 1270. The weight sensor(s) are positioned under the load 1264, and are configured to provide an estimate of the weight of the load 1264 to the host/thermal system controller 1252 and/or the RF heating system controller 1212. The host/thermal system controller 1252 and/or RF heating system controller 1212 may use this information, for example, to determine an approximate duration for the heating operation. Further, the RF heating system controller 1212 may use this information to determine a desired power level for the RF signal supplied by the RF signal source 1220, and/or to determine an initial setting for the variable impedance matching network 1270.

According to various embodiments, the circuitry associated with the single-ended or double-ended variable impedance matching networks (e.g., networks 1000, 1100, 1300, 1400, FIGS. 10, 11, 13, 14) discussed herein may be implemented in the form of one or more modules, where a "module" is defined herein as an assembly of electrical components coupled to a common substrate (e.g., a printed circuit board (PCB) or other substrate). In addition, as mentioned previously, the host/thermal system controller (e.g., controller 952, 1252, FIGS. 9, 12) and portions of the user interface (e.g., user interface 992, 1292, FIGS. 9, 12) may be implemented in the form of a host module (e.g., host module 990, 1290, FIGS. 9, 12). Further still, in various embodiments, the circuitry associated with the processing and RF signal generation portions of the RF heating system (e.g., RF heating system 910, 1210, FIGS. 9, 12) also may be implemented in the form of one or more modules.

Figure 15:
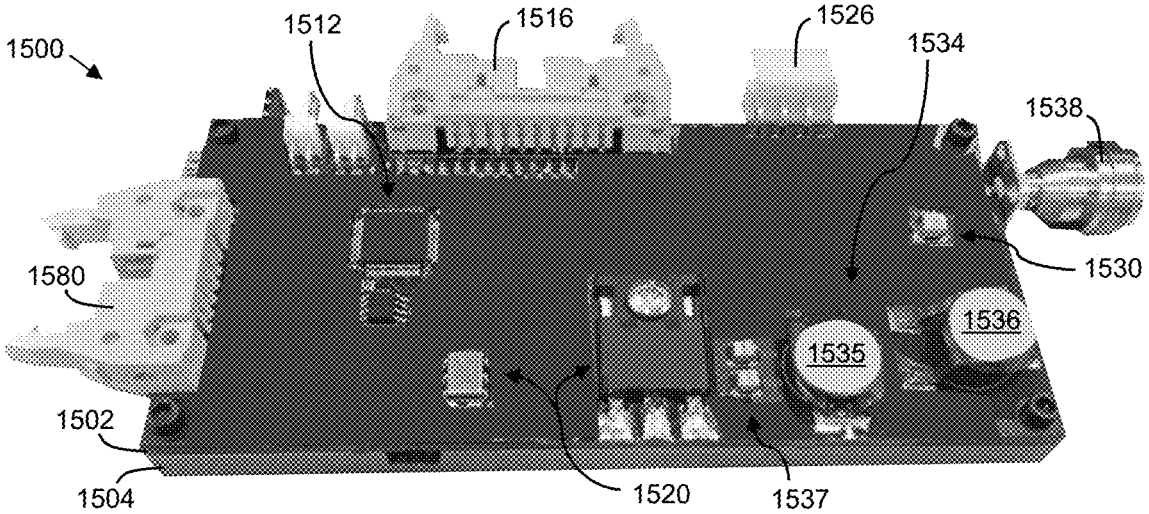
FIG. 15 is a perspective view of an RF module, in accordance with an example embodiment.

For example, FIG. 15 is a perspective view of an RF module 1500 that includes an RF subsystem of the RF heating system (e.g., RF heating system 910, 1210, FIGS. 9, 12), in accordance with an example embodiment. The RF module 1500 includes a PCB 1502 coupled to a ground substrate 1504. The ground substrate 1504 provides structural support for the PCB 1502, and also provides an electrical ground reference and heat sink functionality for the various electrical components coupled to the PCB 1502.

According to an embodiment, the PCB 1502 houses system controller circuitry 1512 (e.g., corresponding to RF heating system controller 912, 1212, FIGS. 9, 12), RF signal source circuitry 1520 (e.g., corresponding to RF signal source 920, 1220, FIGS. 9, 12, including an RF signal generator 922, 1222 and power amplifier 924, 925, 1224), power detection circuitry 1530 (e.g., corresponding to power detection circuitry 930, 1230, FIGS. 9, 12), and impedance matching circuitry 1534 (e.g., corresponding to first matching circuitry 934, 1234, FIGS. 9, 12).

In the embodiment of FIG. 15, the system controller circuitry 1512 includes a processor integrated circuit (IC) and a memory IC, the RF signal source circuitry 1520 includes a signal generator IC and one or more power amplifier devices, the power detection circuitry 1530 includes a power coupler device, and the impedance matching circuitry 1534 includes a plurality of passive components (e.g., inductors 1535, 1536 and capacitors 1537) connected together to form an impedance matching network. The circuitry 1512, 1520, 1530, 1534 and the various sub-components may be electrically coupled together through conductive traces on the PCB 1502 as discussed previously in reference to the various conductors and connections discussed in conjunction with FIGS. 9 and 12.

RF module 1500 also includes a plurality of connectors 1516, 1526, 1538, 1580, in an embodiment. For example, connector 1580 may be configured to connect with a host system that includes a host/thermal system controller (e.g., host/thermal system controller 952, 1252, FIGS. 9, 12) and other functionality. Connector 1516 may be configured to connect with a variable matching circuit (e.g., circuit 970, 1272, FIGS. 9, 12) to provide control signals to the circuit, as previously described. Connector 1526 may be configured to connect to a power supply to receive system power. Finally, connector 1538 (e.g., connector 1236, FIG. 12) may be configured to connect to a coaxial cable or other transmission line, which enables the RF module 1500 to be electrically connected (e.g., through a coaxial cable implementation of conductor 928-2, 1228-3, FIGS. 9, 12) to a variable matching circuit or subsystem (e.g., circuit or subsystem 970, 1270, 1272, FIGS. 9, 12). In an alternate embodiment, components of the variable matching subsystem (e.g., variable matching network 970, balun 1274, and/or variable matching circuit 1272, FIGS. 9, 12) also may be integrated onto the PCB 1502, in which case connector 1536 may be excluded from the module 1500. Other variations in the layout, subsystems, and components of RF module 1500 may be made, as well.

Embodiments of an RF module (e.g., module 1500, FIG. 15), a host module (e.g., module 990, 1290, FIGS. 9, 12), and a variable impedance matching network module (not illustrated) may be electrically connected together, and connected with other components, to form a combined apparatus or system (e.g., apparatus 100, 600, 800, 900, 1200, FIGS. 1, 6, 8, 9, 12). For example, an RF signal connection may be made through a connection (e.g., conductor 928-2, 1228-3, FIGS. 9, 12), such as a coaxial cable, between the RF connector 1538 (FIG. 15) and a variable impedance matching network module, and control connections may be made through connections (e.g., conductors 916, 1216, FIGS. 9, 12), such as a multi-conductor cable, between the connector 1516 (FIG. 15) and the variable impedance matching network module. To further assemble the system, a host system module (e.g., module 990, 1290, FIGS. 9, 12) may be connected to the RF module 1500 through connector 1580, a power supply may be connected to the RF module 1500 through connector 1526, and electrodes (e.g., electrodes 940, 942, 1240, 1242, FIGS. 9, 12) may be connected to outputs of the variable impedance matching network module. Of course, the above-described assembly also would be physically connected to various support structures and other system components so that the electrodes are held in a fixed relationship to each other across a defrosting cavity (e.g., cavity 110, 610, 810, 960, 1260, FIGS. 1, 6, 8, 9, 12), and the defrosting apparatus may be integrated within a larger system (e.g., systems 100, 600, 800, FIGS. 1, 6, 8).

Now that embodiments of the electrical and physical aspects of heating systems have been described, various embodiments of methods for operating such heating systems will be described in conjunction with FIGS. 16-18. More specifically, FIG. 16 is a flowchart of a method of operating a heating system (e.g., system 100, 600, 800, 900, 1200, FIGS. 1, 6, 8, 9, 12) with an RF heating system (e.g., system 150, 650, 850, 910, 1210, FIGS. 1, 6, 8, 9, 12) and a thermal heating system (e.g., system 160, 660, 680, 860, 880, 910, 1210, FIGS. 1, 6, 8, 9, 12), in accordance with an example embodiment.

The method may begin, in block 1602, when the host system controller (e.g., host/thermal system controller 952, 1252, FIGS. 9, 12) receives an indication that a heating operation should start. Such an indication may be received, for example, after a user has place a load (e.g., load 964, 1264, FIGS. 1, 6, 8, 9, 12) into the system's heating cavity (e.g., cavity 110, 610, 810, 960, 1260, FIGS. 1, 6, 8, 9, 12), has sealed the cavity (e.g., by closing a door or drawer), and has pressed a start button (e.g., of the control panel 120, 620, 820, or user interface 992, 1282, FIGS. 1, 6, 8, 9, 12).

As discussed previously, prior to placing the load into the system's heating cavity, the user may install a shelf (e.g., shelf 134, 200, 300, 634, 834, FIGS. 1, 2, 3, 6, 8) into the heating cavity, where the shelf may embody or include an electrode (e.g., electrode 942, 1242, FIGS. 9, 12) of the RF heating system. In an embodiment, sealing of the cavity may engage one or more safety interlock mechanisms, which when engaged, indicate that RF power supplied to the cavity will not substantially leak into the environment outside of the cavity. As will be described later, disengagement of a safety interlock mechanism may cause the system controller immediately to pause or terminate the heating operation.

According to various embodiments, the host system controller optionally may receive additional inputs indicating the load type (e.g., meats, liquids, or other materials), the initial load temperature, and/or the load weight. For example, information regarding the load type may be received from the user through interaction with the user interface (e.g., by the user selecting from a list of recognized load types). Alternatively, the system may be configured to scan a barcode visible on the exterior of the load, or to receive an electronic signal from an RFID device on or embedded within the load. Information regarding the initial load temperature may be received, for example, from one or more temperature sensors and/or IR sensors (e.g., sensors 994, 1294, FIGS. 9, 12) of the system. Information regarding the load weight may be received from the user through interaction with the user interface, or from a weight sensor (e.g., sensor 994, 1294, FIGS. 9, 12) of the system. As indicated above, receipt of inputs indicating the load type, initial load temperature, and/or load weight is optional, and the system alternatively may not receive some or all of these inputs.

Prior to pressing the start button, the user may select a cooking mode, which indicates which heating systems will be activated during the heating process. For example, the user may specify the cooking mode by pressing a dedicated cooking mode button (e.g., of the control panel 120, 620, 820, or user interface 992, 1282, FIGS. 1, 6, 8, 9, 12) or by accessing a cooking mode menu through the control panel and making a selection. As described previously, depending on what type of thermal heating system is combined with the RF heating system, a number of different cooking modes are available for selection, where the different cooking modes can be generally classified as a thermal-only cooking mode, an RF-only cooking mode, and a combined thermal and RF cooking mode. For example, a thermal-only mode may include any of the following, previously-discussed modes: 1) a convection-only cooking mode that may utilize the convection system 160, 660, 860, of any of systems 100, 600, 800 (FIGS. 1, 6, 8); 2) a radiant-only cooking mode that may utilize the radiant heating system 680 of system 600 (FIG. 6); and 3) a gas-only cooking mode that may utilize the gas heating system 880 of system 800 (FIG. 8). As further examples, a combined thermal and RF cooling mode may include any of the following, previously-discussed modes: 1) a combined convection and RF cooking mode; 2) a combined radiant and RF cooking mode; 3) a combined convection, radiant, and RF cooking mode; 4) a combined gas and RF cooking mode; and 5) a combined convection, gas, and RF cooking mode. In addition to the above modes, when a convection system is combined with another type of thermal cooking system, the following additional modes also may be available: 1) a combined convection and radiant cooking mode; and 2) a combined convection and gas cooking mode.

When a user selects a cooking mode that utilizes a thermal heating system (e.g., convection system 160, 660 or 860, radiant heating system 680, or gas heating system 880), the user may be prompted or enabled to enter a desired cavity (oven) temperature (or temperature setpoint) through interaction with the control panel or user interface. Alternatively, the cavity temperature setpoint may otherwise be obtained or determined by the system.

After selecting the cooking mode and, if applicable, the temperature setpoint, and receiving the start indication, the remaining process steps that are performed depend on which cooking mode was selected. Starting with a thermal-only cooking mode selection (e.g., convection-only, radiant-only, and gas-only cooking modes), in block 1630, the system controller (e.g., host/thermal system controller 952, 1252, FIGS. 9, 12) activates the thermal heating components (e.g., thermal heating components 954, 1254, FIGS. 9, 12) of the thermal heating system (e.g., the convection system 160, the radiant heating system 680, the gas heating system 880, the thermal cooking system 950, 1250, FIGS. 1, 6, 8, 9, 12). Once activated, the thermal heating components begin to heat the air within the oven cavity. When a convection cooking mode is selected, the system controller also activates the fan (e.g., fan 958, 1258, FIGS. 9, 12) of the convection system. After a period of time, the oven cavity will be pre-heated to the temperature setpoint.

In block 1632, the oven temperature is maintained at the temperature setpoint. For example, in an embodiment, a closed-loop or feedback-based system that includes the thermal heating component and a system thermostat (e.g., thermostat 956, 1256, FIGS. 9, 12), and possibly the host/thermal system controller, may continuously or periodically monitor the air temperature within the oven cavity, and may maintain the thermal heating system in an activated when the air temperature is below the temperature setpoint. Conversely, when the air temperature is above the temperature setpoint, the system temporarily may deactivate the thermal heating component, and may thereafter continue to monitor the air temperature. Once the air temperature has fallen below the temperature setpoint, the thermal heating component may be re-activated to again increase the air temperature. This process may thereafter continue in a hysteresis loop.

As the oven temperature is being maintained, the host/thermal system controller may evaluate whether or not a cessation or exit condition has occurred, in block 1634. In actuality, determination of whether a cessation or exit condition has occurred may be an interrupt driven process that may occur at any point during the heating process. However, for the purposes of including it in the flowchart of FIG. 16, the process is shown to occur after block 1632.

In any event, some conditions may warrant temporary cessation of the heating operation, and other conditions may warrant an exit altogether of the heating operation. For example, the system may determine that a temporary cessation condition has occurred when the system door (e.g., door 116, 616, 816, FIGS. 1, 6, 8) has been opened during a heating process. For example, FIG. 17 is a flowchart of a method of performing a temporary cessation process associated with the state of a heating system door, in accordance with an example embodiment. The process may be triggered by interrupt, for example, when the host/thermal system controller detects that the system door has been opened in block 1702. For example, opening of the door may be detected when a safety interlock is breached (e.g., when a latching mechanism 118, 618, 818 is disengaged from a corresponding securing structure 119, 619, 819, FIGS. 1, 6, 8).

When the system detects that the system door has been opened, the host/thermal system controller may temporarily deactivate some of the heating system components, in block 1704. For example, if the convection system is active during the selected cooking mode, the host/thermal system controller may send a control signal to the convection fan to deactivate the fan (and possibly an integrated heating element within the convection fan). In addition, if a radiant heating system or a gas heating system is active during the selected cooking mode, the host/thermal system controller may deactivate the corresponding radiant heating element(s) or gas burner(s). Further still, if the RF heating system is active during the selected cooking mode, the host/thermal system controller may send a control signal to the RF system controller, which invokes the RF system controller to discontinue generation and provision of the RF signal to the system electrode(s).

The heating system components that are deactivated in block 1704 will remain deactivated until the system door is subsequently closed, as determined in block 1706. For example, closing of the door may be detected by the host/thermal system controller when the safety interlock is re-engaged (e.g., when the latching mechanism 118, 618, 818 is re-engaged with the corresponding securing structure 119, 619, 819, FIGS. 1, 6, 8). Unless a pre-emptory permanent exit condition occurs before the system door is closed, the host/thermal system controller re-activates the heating system components (e.g., the convection fan, radiant heating element(s), gas burner(s)) in block 1708 after detection that the system door has been closed, and the process returns to block 1634 (FIG. 16).

Referring again to block 1634, the host/thermal system controller alternatively may determine that a permanent cessation (or exit) condition has occurred. For example the host/thermal system controller may make a determination that an exit condition has occurred upon expiration of a timer that was set by the user (e.g., through user interface 992, 1292, FIGS. 9, 12) or upon expiration of a timer that was established by the host/thermal system controller based on the system controller's estimate of how long the heating operation should be performed. In still another alternate embodiment, the host/thermal system controller may otherwise detect completion of the heating operation (e.g., a determination may be made that the load is cooked or has attained a desired temperature).

If a temporary cessation condition has been resolved or a permanent cessation (exit) condition has not occurred, then the heating operation may continue by iteratively performing block 1632 and 1634. When a permanent cessation (exit) condition has occurred, then in block 1636, the host/thermal system controller deactivates (turns off) the thermal heating system. In addition, the host/thermal system controller may send signals to the user interface (e.g., user interface 992, 1292, FIGS. 9, 12) that cause the user interface to produce a user-perceptible indicia of the exit condition (e.g., by displaying "done" on a display device, or providing an audible tone). The method may then end.

Returning again to block 1602, and moving next to the process description when an RF-only cooking mode selection has been made, a determination may first be made, in block 1604, whether the oven cavity may be empty. This determination may be made by the RF heating system controller (e.g., controller 912, 1212, FIGS. 9, 12) to ensure that the RF heating system is not activated when the oven cavity is empty (e.g., if no load has been placed in the oven cavity), because activation of the RF heating system under such a condition may cause damage to the system.

According to an embodiment, the RF heating system controller may determine that an empty cavity condition exists by controlling the RF signal source (e.g., RF signal source 920, 1220, FIGS. 9, 12) to provide a relatively low-power RF signal to the RF system electrode(s) (e.g., electrodes 940, 1240, 1242, FIGS. 9, 12), and receiving a signal from power detection circuitry (e.g., power detection circuitry 930, 1230, 1230', 1230", FIGS. 9, 12) that is indicative of an empty cavity condition. For example, an empty cavity condition may be indicated when the power detection circuitry detects a reflected power that exceeds a pre-determined threshold. In addition or alternatively, the RF heating system controller may determine that an empty cavity condition is indicated when particular match conditions exist (e.g., when the variable impedance matching network is set to particular states, during the calibration process, which are associated with an empty cavity condition). When an empty cavity condition has been detected, in block 1604, then in block 1606, a user-perceptible indication of the empty cavity condition may be output through the user interface (e.g., a message may be displayed), the low-power RF signal may be discontinued, and the RF heating system may be deactivated. The RF heating system may remain in the deactivated state at least until the system door is opened and re-closed, which may be consistent with a user placing a load in the cavity. In such a scenario, once the user has again provided a start indication, block 1604 may be repeated.

When an empty cavity condition is not detected in block 1604 (e.g., the reflected power indicates that a load is present within the cavity), then in block 1608, a variable matching network calibration process is performed. To avoid cluttering the flowchart of FIG. 16, an embodiment of a variable network calibration process is shown in FIG. 18.

The variable network calibration process begins, in block 1802, when the RF heating system controller provides control signals to the variable matching network (e.g., network 970, 1000, 1100, 1272, 1300, 1400, FIGS. 9-14) to establish an initial configuration or state for the variable matching network. The control signals affect the values of variable inductances and/or capacitances (e.g., inductances 1010, 1011, 1311, 1316, 1321, FIGS. 10, 13, and capacitances 1144, 1148, 1413, 1418, 1424, FIGS. 11, 14) within the variable matching network. For example, the control signals may affect the states of bypass switches across the various inductances and capacitances, which are responsive to the control signals from the RF heating system controller, and which are operable to switch sub-inductances and sub-capacitances into and out of the network to increase or decrease the inductance and capacitance values of the variable components. Desirably, the initial configuration of the variable matching network is established to provide an optimum match between the RF signal source and the cavity plus load.

Once the initial variable matching network configuration is established, the system controller may perform a process 1810 of adjusting, if necessary, the configuration of the variable impedance matching network to find an acceptable or best match based on actual measurements that are indicative of the quality of the match. According to an embodiment, this process includes causing the RF signal source (e.g., RF signal source 920, 1220, FIGS. 9, 12) to supply a relatively low power RF signal through the variable impedance matching network to the electrode(s) (e.g., first electrode 940 or both electrodes 1240, 1242, FIGS. 9, 12), in block 1812. The system controller may control the RF signal power level through control signals to the power supply and bias circuitry (e.g., circuitry 926, 1226, FIGS. 9, 12), where the control signals cause the power supply and bias circuitry to provide supply and bias voltages to the amplifiers (e.g., amplifier stages 924, 925, 1224, FIGS. 9, 12) that are consistent with the desired signal power level. For example, the relatively low power RF signal may be a signal having a power level in a range of about 10 W to about 20 W, although different power levels alternatively may be used. A relatively low power level signal during the match adjustment process 1810 is desirable to reduce the risk of damaging the cavity or load (e.g., if the initial match causes high reflected power), and to reduce the risk of damaging the switching components of the variable inductance networks (e.g., due to arcing across the switch contacts).

In block 1814, power detection circuitry (e.g., power detection circuitry 930, 1230, 1230', 1230", FIGS. 9, 12) then measures the reflected and (in some embodiments) forward power along the transmission path (e.g., path 928, 1228, FIGS. 9, 12) between the RF signal source and the electrode(s), and provides those measurements to the RF heating system controller. The RF heating system controller may then determine a ratio between the reflected and forward signal powers, and may determine the S11 parameter and/or VSWR value for the system based on the ratio. The system controller may store the received power measurements (e.g., the received reflected power measurements, the received forward power measurement, or both), and/or the calculated ratios, S11 parameters, and/or VSWR values for future evaluation or comparison, in an embodiment.

In block 1816, the system controller may determine, based on the reflected power measurements, and/or the reflected-to-forward signal power ratio, and/or the S11 parameter, and/or the VSWR value, whether or not the match provided by the variable impedance matching network is acceptable (e.g., the reflected power is below a threshold, or the ratio is 10 percent or less, or the measurements or values compare favorably with some other criteria). Alternatively, the system controller may be configured to determine whether the match is the "best" match. A "best" match may be determined, for example, by iteratively measuring the reflected RF power (and in some embodiments the forward reflected RF power) for all possible impedance matching network configurations (or at least for a defined subset of impedance matching network configurations), and determining which configuration results in the lowest reflected RF power and/or the lowest reflected-to-forward power ratio.

When the RF heating system controller determines that the match is not acceptable or is not the best match, the RF heating system controller may adjust the match, in block 1818, by reconfiguring the variable impedance matching network. For example, this may be achieved by sending control signals to the variable impedance matching network, which cause the network to increase and/or decrease the variable inductances within the network (e.g., by causing the variable inductance networks 1010, 1011, 1311, 1316, 1321 (FIGS. 10, 13) or variable capacitance networks 1142, 1146, 1411, 1416, 1421 (FIGS. 11, 14) to have different inductance or capacitance states, or by switching inductors or capacitors into or out of the circuit. After reconfiguring the variable inductance network, blocks 1814, 1816, and 1818 may be iteratively performed until an acceptable or best match is determined in block 1816.

Figure 16:
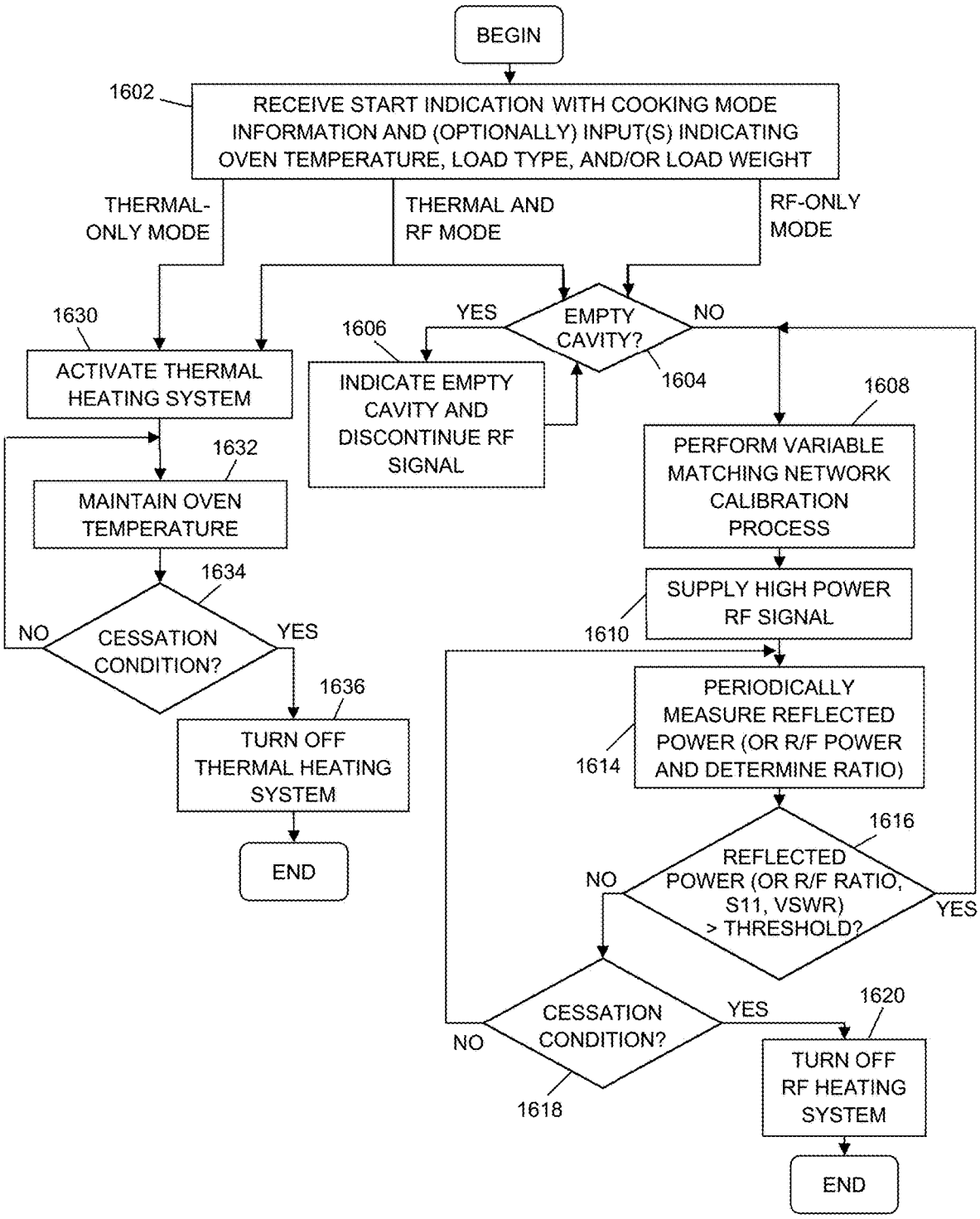
FIG. 16 is a flowchart of a method of operating a heating appliance with an RF heating system and a thermal heating system, in accordance with an example embodiment.
Figure 17:
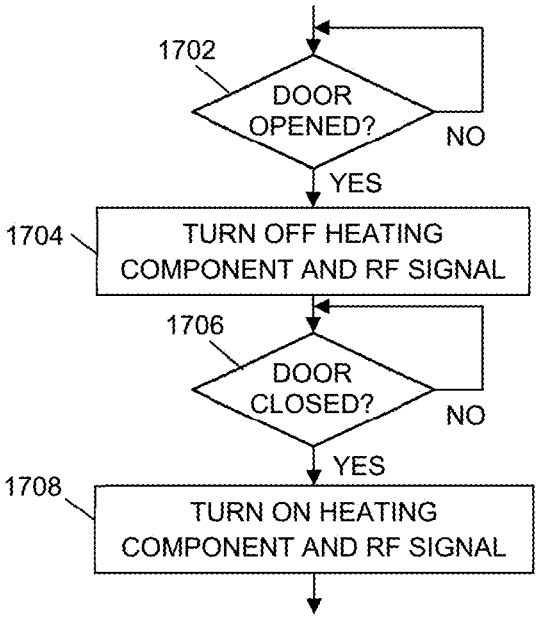
FIG. 17 is a flowchart of a method of performing a temporary cessation process associated with the state of a heating system door, in accordance with an example embodiment.

Once an acceptable or best match is determined, the flow returns to FIG. 16, and the RF heating operation may commence. Commencement of the RF heating operation includes increasing the power of the RF signal supplied by the RF signal source (e.g., RF signal source 920, 1220, FIGS. 9, 12) to a relatively high power RF signal, in block 1610. Once again, the RF heating system controller may control the RF signal power level through control signals to the power supply and bias circuitry (e.g., circuitry 926, 1226, FIGS. 9, 12), where the control signals cause the power supply and bias circuitry to provide supply and bias voltages to the amplifiers (e.g., amplifier stages 924, 925, 1224, FIGS. 9, 12) that are consistent with the desired signal power level. For example, the relatively high power RF signal may be a signal having a power level in a range of about 50 W to about 500 W, although different power levels alternatively may be used.

In block 1614, measurement circuitry (e.g., power detection circuitry 930, 1230, 1230', 1230", FIGS. 9, 12) then periodically measures system parameters such as the one or more currents, one or more voltages, the reflected power and/or the forward power along the transmission path (e.g., path 928, 1228, FIGS. 9, 12) between the RF signal source and the electrode(s), and provides those measurements to the RF heating system controller. The RF heating system controller again may determine a ratio between the reflected and forward signal powers, and may determine the S11 parameter and/or VSWR value for the system based on the ratio. The RF heating system controller may store the received power measurements, and/or the calculated ratios, and/or S11 parameters, and/or the VSWR values for future evaluation or comparison, in an embodiment. According to an embodiment, the periodic measurements of the forward and reflected power may be taken at a fairly high frequency (e.g., on the order of milliseconds) or at a fairly low frequency (e.g., on the order of seconds). For example, a fairly low frequency for taking the periodic measurements may be a rate of one measurement every 10 seconds to 20 seconds.

In block 1616, the RF heating system controller may determine, based on one or more reflected signal power measurements, one or more calculated reflected-to-forward signal power ratios, one or more calculated S11 parameters, and/or one or more VSWR values whether or not the match provided by the variable impedance matching network is acceptable. For example, the RF heating system controller may use a single reflected signal power measurement, a single calculated reflected-to-forward signal power ratio, a single calculated S11 parameter, or a single VSWR value in making this determination, or may take an average (or other calculation) of a number of previously-received reflected signal power measurements, previously-calculated reflected-to-forward power ratios, previously-calculated S11 parameters, or previously-calculated VSWR values in making this determination. To determine whether or not the match is acceptable, the RF heating system controller may compare the received reflected signal power, the calculated ratio, S11 parameter, and/or VSWR value to one or more corresponding thresholds, for example. For example, in one embodiment, the RF heating system controller may compare the received reflected signal power to a threshold of, for example, 5 percent (or some other value) of the forward signal power. A reflected signal power below 5 percent of the forward signal power may indicate that the match remains acceptable, and a ratio above 5 percent may indicate that the match is no longer acceptable. In another embodiment, the RF heating system controller may compare the calculated reflected-to-forward signal power ratio to a threshold of 10 percent (or some other value). A ratio below 10 percent may indicate that the match remains acceptable, and a ratio above 10 percent may indicate that the match is no longer acceptable. When the measured reflected power, the calculated ratio or S11 parameter, or the VSWR value is greater than the corresponding threshold (i.e., the comparison is unfavorable), indicating an unacceptable match, then the RF heating system controller may initiate re-configuration of the variable impedance matching network by again performing process 1608 (e.g., the process of FIG. 17).

As discussed previously, the match provided by the variable impedance matching network may degrade over the course of a heating operation due to impedance changes of the load (e.g., load 964, 1264, FIGS. 9, 12) as the load warms up. It has been observed that, over the course of a heating operation, an optimal cavity match may be maintained by adjusting the cavity match inductance or capacitance and by also adjusting the RF signal source inductance or capacitance.

According to an embodiment, in the iterative process of re-configuring the variable impedance matching network, the RF heating system controller may take into consideration this tendency. More particularly, when adjusting the match by reconfiguring the variable impedance matching network in block 1608, the RF heating system controller initially may select states of the variable inductance networks for the cavity and RF signal source matches that correspond to lower inductances (for the cavity match) and higher inductances (for the RF signal source match). Similar processes may be performed in embodiments that utilize variable capacitance networks for the cavity and RF signal source. By selecting impedances that tend to follow the expected optimal match trajectories, the time to perform the variable impedance matching network reconfiguration process 1608 may be reduced, when compared with a reconfiguration process that does not take these tendencies into account. In an alternate embodiment, the RF heating system controller may instead iteratively test adjacent configurations to attempt to determine an acceptable configuration.

In actuality, there are a variety of different searching methods that the RF heating system controller may employ to re-configure the system to have an acceptable impedance match, including testing all possible variable impedance matching network configurations. Any reasonable method of searching for an acceptable configuration is considered to fall within the scope of the inventive subject matter. In any event, once an acceptable match again is established in block 1608, the heating operation is resumed in blocks 1610 and 1614, and the process continues to iterate.

Referring back to block 1616, when the RF heating system controller determines, based on one or more reflected power measurements, one or more calculated reflected-to-forward signal power ratios, one or more calculated S11 parameters, and/or one or more VSWR values that the match provided by the variable impedance matching network is still acceptable (e.g., the reflected power measurements, calculated ratio, S11 parameter, or VSWR value is less than a corresponding threshold, or the comparison is favorable), the RF heating system controller and/or the host/thermal system controller may evaluate whether or not a cessation or exit condition has occurred, in block 1618. In actuality, determination of whether a cessation or exit condition has occurred may be an interrupt driven process that may occur at any point during the heating process. However, for the purposes of including it in the flowchart of FIG. 16, the process is shown to occur after block 1616. Block 1618 may be substantially the same as block 1636 and the associated discussion of a temporary cessation condition in the flowchart of FIG. 17, which were discussed previously. For purpose of brevity, that discussion will not be repeated here, but is intended to apply equally.

If a temporary cessation condition has been resolved, or a permanent cessation condition has not occurred, then the heating operation may continue by iteratively performing blocks 1614 and 1616 (and the matching network reconfiguration process 1608, as necessary). When a permanent cessation (exit) condition has occurred, then in block 1620, the RF heating system controller causes the supply of the RF signal by the RF signal source to be discontinued. For example, the RF heating system controller may disable the RF signal generator (e.g., RF signal generator 922, 1222, FIGS. 9, 12) and/or may cause the power supply and bias circuitry (e.g., circuitry 926, 1226, FIGS. 9, 12) to discontinue provision of the supply current. In addition, the host/thermal system controller may send signals to the user interface (e.g., user interface 992, 1292, FIGS. 9, 12) that cause the user interface to produce a user-perceptible indicia of the exit condition (e.g., by displaying "done" on a display device, or providing an audible tone). The method may then end.

Returning once again to block 1602, when a combined thermal and RF cooking mode has been selected that includes activation of both a thermal heating system and the RF heating system, the previously-discussed thermal cooking process (i.e., including blocks 1630, 1632, 1634) and RF cooking process (i.e., blocks 1604, 1606, 1608, 1610, 1614, 1616, 1618) are performed in parallel and simultaneously. More specifically, the host/thermal system controller controls the appropriate thermal heating system to heat the air in the oven cavity at the same time that the RF system controller controls the RF heating system to radiate RF energy into the oven cavity. During some periods of the cooking process, either the thermal heating system or the RF heating system may be temporarily de-activated, while the other system remains activated. Overall control of the activation states of the thermal heating system and the RF heating system may be performed by the host/thermal system controller, in an embodiment.

Implementation of an embodiment of a system that combines RF capacitive cooking by an RF heating system with thermal cooking by a thermal heating system may have significant performance advantages over conventional systems. For example, FIGS. 19 and 20 are charts plotting the internal temperature of initially frozen and refrigerated food loads, respectively, during a convection-only cooking process and during a combined convection and RF cooking process.

Figure 19:
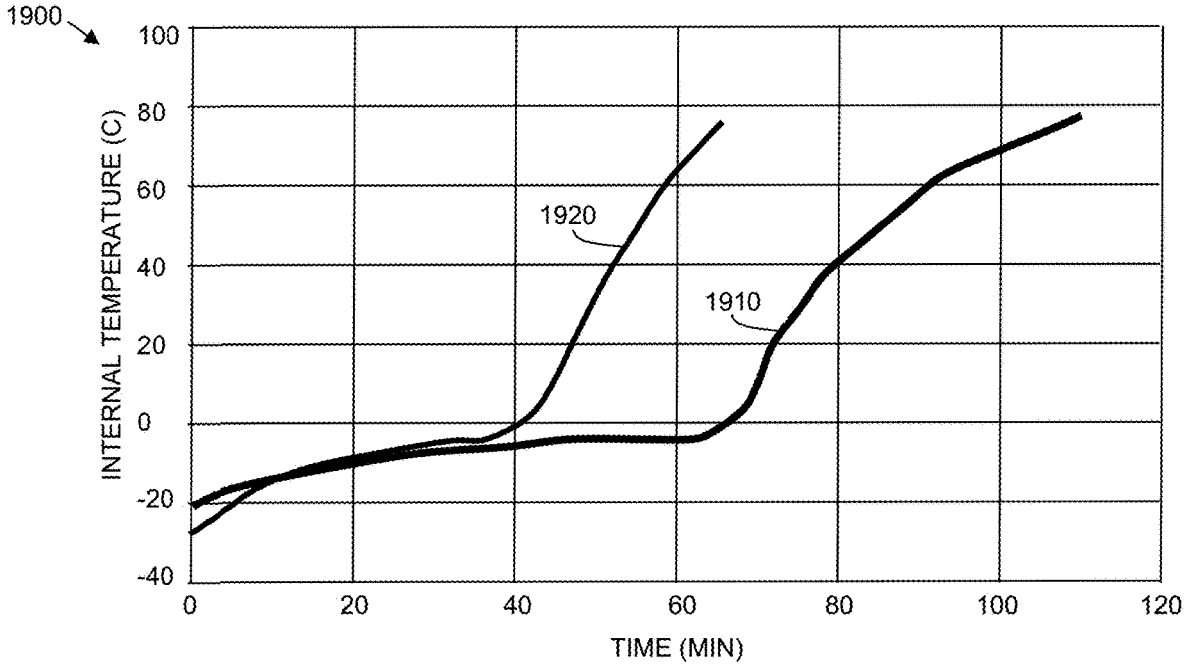
FIG. 19 is a chart plotting internal temperature of an initially frozen food load versus processing time for a convection-only heating appliance and an embodiment of a heating appliance that includes an RF heating system and a thermal heating system.

Referring first to FIG. 19, chart 1900 plots internal load temperature (in degrees Celsius along the vertical axis) over cooking time (in minutes along the horizontal axis) for an initially frozen mass of chicken. Specifically, trace 1910 plots internal load temperature over time when the load was heated using a convection-only heating process, and trace 1920 plots internal load temperature over time when the load was heated using an embodiment of a heating apparatus that includes both an RF heating system and a convection heating system (e.g., system 100, FIG. 1). Trace 1910 shows that the convection-only heating process raised the internal temperature of the load from about −20 degrees Celsius to about 80 degrees Celsius in about 108 minutes. Conversely, trace 1920 shows that the combined RF and convection heating process raised the internal temperature of the load from about −20 degrees Celsius to about 80 degrees Celsius in about 62 minutes, which represents a significant reduction in the cooking time for the initially frozen load.

Figure 20:
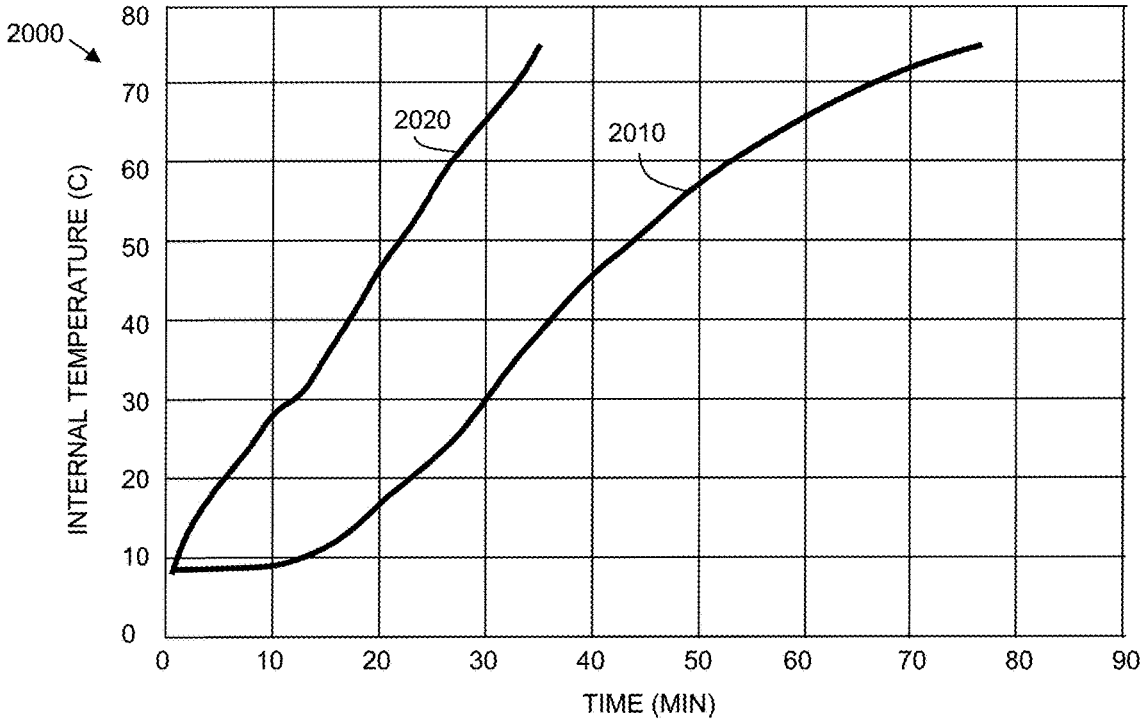
FIG. 20 is a chart plotting internal temperature of an initially refrigerated food load versus processing time for a convection-only heating appliance and an embodiment of a heating appliance that includes an RF heating system and a thermal heating system.

Referring next to FIG. 20, chart 2000 plots internal load temperature (in degrees Celsius along the vertical axis) over cooking time (in minutes along the horizontal axis) for an initially refrigerated mass of chicken. Specifically, trace 2010 plots internal load temperature over time when the load was heated using a convection-only heating process, and trace 2020 plots internal load temperature over time when the load was heated using an embodiment of a heating apparatus that includes both an RF heating system and a convection heating system (e.g., system 100, FIG. 1). Trace 2010 shows that the convection-only heating process raised the internal temperature of the load from about 5 degrees Celsius to about 75 degrees Celsius in about 75 minutes. Conversely, trace 2020 shows that the combined RF and convection heating process raised the internal temperature of the load from about 5 degrees Celsius to about 75 degrees Celsius in about 36 minutes, which again represents a significant reduction in the cooking time.

Accordingly, given the results depicted in FIGS. 19 and 20, it is evident that implementation of embodiments of the inventive subject matter that include combined RF and thermal heating systems may achieve significantly reduced cooking times, when compared with conventional systems.

The connecting lines shown in the various figures contained herein are intended to represent exemplary functional relationships and/or physical couplings between the various elements. It should be noted that many alternative or additional functional relationships or physical connections may be present in an embodiment of the subject matter. In addition, certain terminology may also be used herein for the purpose of reference only, and thus are not intended to be limiting, and the terms "first", "second" and other such numerical terms referring to structures do not imply a sequence or order unless clearly indicated by the context.

As used herein, a "node" means any internal or external reference point, connection point, junction, signal line, conductive element, or the like, at which a given signal, logic level, voltage, data pattern, current, or quantity is present. Furthermore, two or more nodes may be realized by one physical element (and two or more signals can be multiplexed, modulated, or otherwise distinguished even though received or output at a common node).

The foregoing description refers to elements or nodes or features being "connected" or "coupled" together. As used herein, unless expressly stated otherwise, "connected" means that one element is directly joined to (or directly communicates with) another element, and not necessarily mechanically. Likewise, unless expressly stated otherwise, "coupled" means that one element is directly or indirectly joined to (or directly or indirectly communicates with) another element, and not necessarily mechanically. Thus, although the schematic shown in the figures depict one exemplary arrangement of elements, additional intervening elements, devices, features, or components may be present in an embodiment of the depicted subject matter.

An embodiment of a heating system includes a cavity configured to contain a load, a thermal heating system in fluid communication with the cavity and configured to heat air, and an RF heating system. The RF heating system includes an RF signal source configured to generate an RF signal, first and second electrodes positioned across the cavity and capacitively coupled, a transmission path electrically coupled between the RF signal source and one or more of the first and second electrodes, and a variable impedance matching network electrically coupled along the transmission path between the RF signal source and the one or more electrodes. At least one of the first and second electrodes receives the RF signal and converts the RF signal into electromagnetic energy that is radiated into the cavity.

An embodiment of a method of operating a heating system that includes a cavity configured to contain a load, includes heating air in the cavity by a thermal heating system in fluid communication with the cavity. The method further includes, simultaneously with heating the air in the cavity, supplying, by an RF signal source, one or more RF signals to a transmission path that is electrically coupled between the RF signal source and first and second electrodes that are positioned across the cavity and capacitively coupled. At least one of the first and second electrodes receives the RF signal and converts the RF signal into electromagnetic energy that is radiated into the cavity. The method further includes detecting, by power detection circuitry, reflected signal power along the transmission path, and modifying, by a controller, one or more component values of one or more components of a variable impedance matching network to reduce the reflected signal power.

While at least one exemplary embodiment has been presented in the foregoing detailed description, it should be appreciated that a vast number of variations exist. It should also be appreciated that the exemplary embodiment or embodiments described herein are not intended to limit the scope, applicability, or configuration of the claimed subject matter in any way. Rather, the foregoing detailed description will provide those skilled in the art with a convenient road map for implementing the described embodiment or embodiments. It should be understood that various changes can be made in the function and arrangement of elements without departing from the scope defined by the claims, which includes known equivalents and foreseeable equivalents at the time of filing this patent application.

What is claimed is:

1. A heating system comprising:

a cavity configured to contain a load;

a thermal heating system in fluid communication with the cavity, wherein the thermal heating system includes at least one component configured to heat air; and a radio frequency (RF) heating system that includes an RF signal source configured to generate an RF signal, first and second electrodes positioned across the cavity and capacitively coupled, wherein at least one of the first and second electrodes receives the RF signal and converts the RF signal into electromagnetic energy that is radiated into the cavity, wherein the first electrode is physically positioned between the cavity and the at least one component configured to heat the air, and the first electrode includes one or more openings that enable air flow between the at least one component and the cavity, a transmission path electrically coupled between the RF signal source and one or more of the first and second electrodes, and a variable impedance matching network electrically coupled along the transmission path between the RF signal source and the one or more electrodes.

2. The heating system of claim 1, wherein the RF signal source includes a solid-state power amplifier, and the RF signal has a frequency in a range of 10.0 megahertz (MHz) to 100 MHz.

3. The heating system of claim 1, wherein the RF heating system further comprises:

power detection circuitry configured to detect reflected signal power along the transmission path; and an RF heating system controller electrically coupled to the power detection circuitry and to the variable impedance matching network, wherein the RF heating system controller is configured to modify, based on the reflected signal power, variable component values of the impedance matching network to reduce the reflected signal power.

4. The heating system of claim 3, wherein:

the power detection circuitry is further configured to detect the forward signal power along the transmission path; and the RF heating system controller is configured to modify the variable component values of the impedance matching network to reduce the reflected signal power and to increase the forward signal power.

5. The heating system of claim 3, wherein the RF heating system is an unbalanced system, and wherein:

the transmission path is electrically coupled between the RF signal source and the first electrode; and the second electrode is coupled to a ground reference.

6. The heating system of claim 5, wherein the variable impedance matching network is a single-ended network that includes one or more variable inductors, and wherein the RF heating system controller is configured to modify, based on the reflected signal power, inductance values of the one or more variable inductors to reduce the reflected signal power.

7. The heating system of claim 5, wherein the variable impedance matching network is a single-ended network that includes one or more variable capacitors, and wherein the RF heating system controller is configured to modify, based on the reflected signal power, capacitance values of the one or more variable capacitors to reduce the reflected signal power.

8. The heating system of claim 3, wherein the RF heating system is a balanced system, and wherein:

the transmission path is electrically coupled between the RF signal source and both the first electrode and the second electrode.

9. The heating system of claim 8, wherein the variable impedance matching network is a double-ended network that includes one or more variable inductors, and wherein the RF heating system controller is configured to modify, based on the reflected signal power, inductance values of the one or more variable inductors to reduce the reflected signal power.

10. The heating system of claim 8, wherein the variable impedance matching network is a double-ended network that includes one or more variable capacitors, and wherein the RF heating system controller is configured to modify, based on the reflected signal power, capacitance values of the one or more variable capacitors to reduce the reflected signal power.

11. The heating system of claim 1, wherein the thermal heating system comprises a convection heating system.

12. The heating system of claim 1, wherein the thermal heating system comprises a radiant heating system, and the at least one component includes one or more radiant heating elements.

13. A heating system comprising:

a cavity configured to contain a load;

a thermal heating system in fluid communication with the cavity, wherein the thermal heating system is configured to heat air, wherein the thermal heating system comprises a radiant heating system that includes one or more radiant heating elements; and a radio frequency (RF) heating system that includes an RF signal source configured to generate an RF signal, first and second electrodes positioned across the cavity and capacitively coupled, wherein at least one of the first and second electrodes receives the RF signal and converts the RF signal into electromagnetic energy that is radiated into the cavity, and wherein the first electrode is physically positioned between the cavity and a first radiant heating element of the one or more heating elements, and the first electrode includes one or more openings that enable air flow between the radiant heating element and the cavity, a transmission path electrically coupled between the RF signal source and one or more of the first and second electrodes, and a variable impedance matching network electrically coupled along the transmission path between the RF signal source and the one or more electrodes.

14. The heating system of claim 13, wherein the thermal heating system further comprises:

a convection fan that circulates the air heated by the one or more radiant heating elements within the cavity.

15. The heating system of claim 1, wherein the at least one component of the thermal heating system comprises one or more gas burners.

16. The heating system of claim 1, wherein the second electrode forms at least a portion of a shelf that is inserted in the cavity at a height above a bottom cavity surface.

17. A method of operating a heating system that includes a cavity configured to contain a load, the method comprising:

heating air in the cavity by a thermal heating system in fluid communication with the cavity, wherein the thermal heating system includes at least one component configured to heat the air;

simultaneously with heating the air in the cavity, supplying, by a radio frequency (RF) signal source, one or more RF signals to a transmission path that is electrically coupled between the RF signal source and first and second electrodes that are positioned across the cavity and capacitively coupled, wherein at least one of the first and second electrodes receives the RF signal and converts the RF signal into electromagnetic energy that is radiated into the cavity, the first electrode is physically positioned between the cavity and the at least one component configured to heat the air, and the first electrode includes one or more openings that enable air flow between the at least one component and the cavity;

detecting, by power detection circuitry, reflected signal power along the transmission path; and modifying, by a controller, one or more component values of one or more components of a variable impedance matching network to reduce the reflected signal power.

18. The method of claim 17, wherein the thermal heating system is selected from a convection heating system, a radiant heating system, and a gas heating system.

19. The method of claim 17, wherein modifying the one or more component values comprises modifying one or more component values of one or more components selected from one or more variable inductors and one or more variable capacitors.

* * * * *